US005658701A

United States Patent [19]

Kato

[11] Patent Number: 5,658,701

[45] Date of Patent: Aug. 19, 1997

[54] METHOD FOR PREPARATION OF WATERLESS LITHOGRAPHIC PRINTING PLATE BY ELECTROPHOTOGRAPHIC PROCESS

[75] Inventor: Eiichi Kato, Kanagawa, Japan

[73] Assignee: Fuji Photo Film Co., Ltd., Kanagawa, Japan

[21] Appl. No.: 734,633

[22] Filed: Oct. 21, 1996

[30] Foreign Application Priority Data

Oct. 20, 1995 [JP] Japan ..... 7-273030

[51] Int. Cl.[6] ..... G03G 13/22; G03G 13/32

[52] U.S. Cl. ..... 430/49; 430/126

[58] Field of Search ..... 430/49, 126

[56] References Cited

U.S. PATENT DOCUMENTS

| | | | |
|---|---|---|---|
| 3,847,642 | 11/1974 | Rhodes | 430/126 |
| 3,999,481 | 12/1976 | Sankus | 430/126 |
| 5,176,974 | 1/1993 | Till et al. | 430/42 |
| 5,370,960 | 12/1994 | Cahill et al. | 430/126 |
| 5,501,929 | 3/1996 | Kato et al. | 430/49 |
| 5,526,102 | 6/1996 | Kato | 430/126 |
| 5,561,014 | 10/1996 | Kato | 430/49 |
| 5,582,941 | 12/1996 | Kato et al. | 430/126 |
| 5,589,308 | 12/1996 | Kato et al. | 430/49 |

*Primary Examiner*—Roland Martin

*Attorney, Agent, or Firm*—McAulay Fisher Nissen Goldberg & Kiel, LLP

[57] ABSTRACT

A method for preparation of a waterless lithographic printing plate by an electrophotographic process comprising providing a peelable transfer layer (T) containing a thermoplastic resin (A) on a surface of an electrophotographic light-sensitive element, forming a non-fixing toner image by an electrophotographic process using a liquid developer on the transfer layer, transferring the toner image together with the transfer layer (T) from the electrophotographic light-sensitive element onto a primary receptor, transferring the toner image together with the transfer layer (T) from the primary receptor onto a support for lithographic printing plate, providing on the transfer layer (T) bearing the toner image a non-tacky resin layer having adhesion to the transfer layer (T) larger than adhesion between the toner image and the non-tacky resin layer, and selectively removing the non-tacky resin layer provided on the toner image.

The method is suitable for a scanning exposure system using a laser beam of a low power, and simply and rapidly provides a waterless lithographic printing plate excellent in image qualities and printing durability.

31 Claims, 6 Drawing Sheets

METHOD FOR PREPARATION OF WATERLESS LITHOGRAPHIC PRINTING PLATE BY ELECTROPHOTOGRAPHIC PROCESS

FIELD OF THE INVENTION

The present invention relates to a method for preparation of a waterless lithographic printing plate by an electrophotographic process. More particularly, it relates to a method for preparation of a waterless lithographic printing plate including an electrophotographic toner image-forming step to which method a scanning exposure using a laser beam having a low power can be applied and which method provides a lithographic printing plate excellent in image qualities and printing durability.

BACKGROUND OF THE INVENTION

In general, lithographic printing involves a step of applying water to a hydrophilic non-image areas of a printing plate to prevent adherence of oily printing ink and a step of feeding oily printing ink to oleophilic image areas of the printing plate. However, maintaining of the delicate balance between the amount of water applied to the plate and the amount of ink fed to the plate is difficult and needs a skilled worker.

In order to overcome these problems of conventional lithography, waterless lithographic printing plate capable of printing in the absence of dampening water have been provided. Waterless lithographic printing plates have oil repellant areas and oleophilic areas. Oily ink is applied to the plate and adheres only to the oleophilic areas and an ink image thus formed on the plate is transferred to paper. One method practically used comprises imagewise exposing to light a light-sensitive material having a silicone rubber layer and a light-sensitive layer composed of a photosensitive resin to make difference in adhesion between the silicon rubber layer and the light-sensitive layer in the exposed area from the non-exposed areas and removing the imaging areas by a wet development processing to prepare a lithographic printing plate. This method requires contact imagewise exposure using a light source having a short wavelength and a high power due to low-sensitivity of the light-sensitive element and the wet development processing. Therefore, this method has problems in simplicity, rapidness and laborsaving and is very difficult to apply to the preparation of lithographic printing plate accepting a recent image-forming system using a digital signal, i.e. a digital direct printing plate.

A system has been commercialized by Heiderberg Co., Ltd. wherein a material comprising a heat-sensitive layer containing a substance capable of converting radiation into heat and a silicon layer provided thereon is subjected to scanning exposure by a laser beam corresponding to a digital signal to destroy the silicon layer together with the heat-sensitive layer using the heat generated in the exposed portion, followed by removing these layers in the exposed portion by a dry development processing thereby providing a waterless printing plate.

According to the system, writing by a laser beam using a heat mode and a dry development processing are employed. However, a laser writing device of high power is necessary because of low sensitivity of the recording material which leads to increase in a size of apparatus, a period of plate-making and a cost of the system.

JP-A-47-19305 (the term "JP-A" as used herein means an "unexamined published Japanese patent application"), JP-A-49-19904, JP-A-59-125752 and JP-A-62-160466 each discloses a method capable of image-forming simply in an apparatus of a small size using an electrophotographic light-sensitive element suitable for scanning exposure by a semiconductor laser beam of a low power. On the electrophotographic light-sensitive element is provided a silicon layer and then an oleophilic toner image is formed thereon by an electrophotographic process to prepare a waterless printing plate.

However, adhesion of the toner image portion to the silicon layer is poor in the printing plate and the image portion is apt to be damaged by tack of ink supplied which results in the occurrence of image failure. Thus a printing durability of the plate is very low.

In order to improve a printing durability there have been proposed methods for increasing adhesion between the toner image portion and the silicon layer. For example, there are a method wherein a unhardened silicon rubber layer is provided and after the formation of toner image, the silicon rubber is hardened as described, for example, in JP-A-50-53110 and JP-A-52-105003, and a method using a reactive group-containing silicon rubber layer as described, for example, in JP-A-52-29305, JP-A-56-83750 and JP-A-57-178893. However, these methods are still insufficient in the adhesion for the practical purpose.

JP-A-49-121602 discloses a method comprising forming an image composed of dry toner on a support for lithographic printing plate by a PPC copying machine such as a laser printer using a semiconductor of low power or a printer of heat-sensitive transfer, providing a silicon layer on the whole surface of the support, hardening the silicon layer and then selectively removing the silicon layer on the image portion upon a wet development processing using a solvent to prepare a printing plate.

Also, JP-A-3-118154 discloses a method comprising forming a light absorber-containing image or a non-adhesive image using dry toner on a support for lithographic printing plate by a PPC copying machine such as laser printer using a semiconductor of low power or a printer of heat-sensitive transfer, providing a silicon layer on the whole surface of the support, hardening the silicon layer and then selectively removing the silicon layer on the image portion upon a dry development processing using heat or mechanical means to prepare a printing plate.

According to these methods described in JP-A-49-121602 and JP-A-3-118154, poor adhesion of toner image to a silicon layer occurred in the printing plate prepared by forming the toner image on the silicon layer as described hereinbefore can be solved. Further, a simple dry process can be used for removing the silicon layer on the image portion in the method described in JP-A-3-118154.

However, these methods still have problems. Specifically, since adhesion between the silicon layer and the support in the non-image portion is insufficient and releasability of the silicon layer depends on a conversion rate of radiation to heat of a dye or pigment employed, a difference of adhesion between the silicon layer and the support in the non-image portion from adhesion between the image portion and the silicon layer is small in fact. Accordingly, it is difficult to selectively remove the silicon layer on the image portion in fine image regions, particularly by a dry process, and thus these methods are not sufficient for providing constantly good printing plates.

Further, there is a limit to forming highly accurate image using a PPC copying machine or printer of heat-sensitive transfer as well known in the art and a printing plate having excellent image qualities is hardly obtained.

Recently, a printing system providing prints of highly accurate full color image in a simple, rapid and laborsaving manner including edition in a workstation and digital image processing has been highly desired. However, such a desire cannot be answered by the techniques describe about.

SUMMARY OF THE INVENTION

Therefore, an object of the present invention is to provide a method for preparation of a waterless lithographic printing plate by an electrophotographic process which is suitable for scanning exposure system using a laser beam of a low power and which provides a lithographic printing plate excellent in image qualities and printing durability in a simple, rapid and laborsaving manner.

Another object of the present invention is to provide a method for preparation of a waterless lithographic printing plate by an electrophotographic process which is capable of faithfully reproducing a highly accurate image.

A further object of the present invention is to provide a method for preparation of a waterless lithographic printing plate by an electrophotographic process in which a toner image portion is removable by a dry process and which provides a highly accurate image in a stable manner even when a condition of removing step is fluctuated.

Onother objects of the present invention will become apparent from the following description.

It has been found that the above described objects of the present invention are accomplished by a method for preparation of a waterless lithographic printing plate by an electrophotographic process comprising providing a peelable transfer layer (T) containing a thermoplastic resin (A) on a surface of an electrophotographic light-sensitive element, forming a non-fixing toner image by an electrophotographic process using a liquid developer on the transfer layer, transferring the toner image together with the transfer layer (T) from the electrophotographic light-sensitive element onto a primary receptor, transferring the toner image together with the transfer layer (T) from the primary receptor onto a support for lithographic printing plate, providing on the transfer layer (T) bearing the toner image a non-tacky resin layer having adhesion to the transfer layer (T) larger than adhesion between the toner image and the non-tacky resin layer, and selectively removing the non-tacky resin layer provided on the toner image.

BRIEF DESCRIPTION OF THE ACCOMPANYING DRAWINGS

Figure 1:
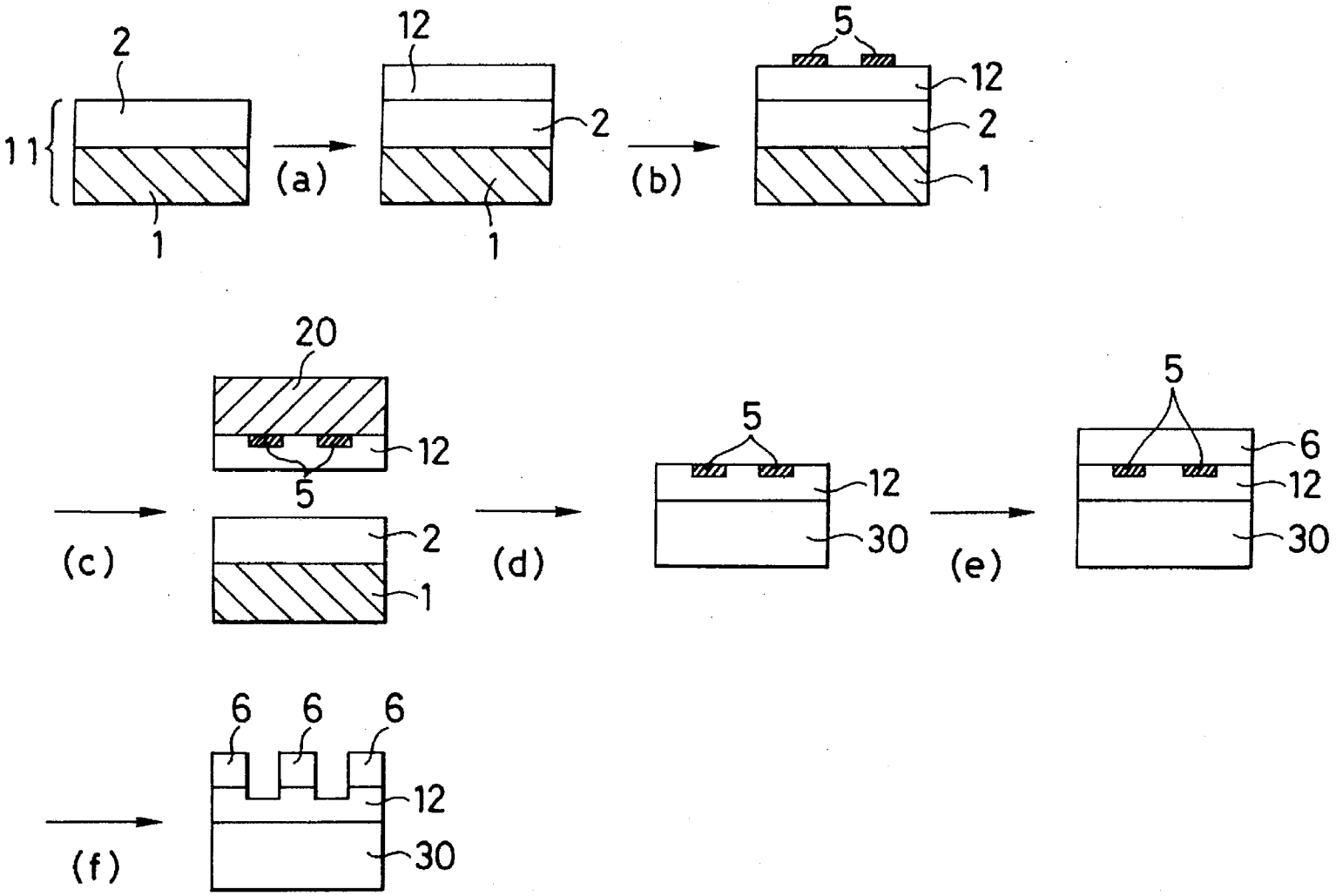
FIG. 1 is a schematic view for explanation of the method according to the present invention.

Explanation of the Symbols:

Support of light-sensitive element
2 Light-sensitive layer
5 Toner image
6 Non-tacky resin layer
10 Device for applying compound (S)
11 Electrophotographic light-sensitive element
12 Transfer layer
13 Unit for providing transfer layer
14 Liquid developing unit set
14T Unit for forming toner image
15 Suction/exhaust unit
**15*a*** Suction part
**15*b*** Exhaust part
16 Heating means
17 Temperature controller
18 Corona charger
19 Exposure device
20 Primary receptor
21 Cooling part
24 Release paper
**25*a*** Heating means
**25*b*** Heating roller
**25*c*** Cooling roller
30 Support for lithographic printing plate
31 Backup roller for transfer
32 Backup roller for release

DETAILED DESCRIPTION OF THE INVENTION

A method for preparation of a waterless lithographic printing plate by an electrophotographic process according to the present invention will be diagrammatically described with reference to FIG. 1 of the accompanying drawings.

As shown in FIG. 1, a transfer layer (T) 12 is first provided on a surface of an electrophotographic light-sensitive element 11 comprising a support 1 having provided thereon a light-sensitive layer 2 in Step (a). A non-fixing toner image 5 is formed by an electrophotographic process using a liquid developer on the transferlayer (T) 12 in Step (b). The toner image 5 is transferred together with the transfer layer (T) 12 to a primary receptor (hereinafter also referred to as an intermediate transfer medium) 20 in Step (c) and then it is transferred together with the transfer layer (T) 12 from the primary receptor to a support for lithographic printing plate 30 as in Step (d).

On the whole surface of transfer layer (T) 12 and the toner image 5 on the support for lithographic printing plate 30 is provided a non-tacky resin layer 6 having adhesion to the surface of transfer layer (T) 12 larger than adhesion between the toner image 5 and the non-tacky resin layer 6 in Step (e). Utilizing the difference in adhesion, the non-tacky resin layer 6 provided on the toner image 5 is selectively removed and the non-tacky resin layer 6 is left on the support 30 in the non-image portion to prepare a waterless lithographic printing plate in Step (f).

According to the method of the present invention, since the adhesion between the transfer layer (T) and the non-tacky resin layer in the non-image portion is larger than the adhesion between the non-tacky resin layer and the toner image, even fine image regions are easily and selectively removed. Further, since a toner image formed on a transfer layer provided on an electrophotographic light-sensitive element is transferred together with the transfer layer onto a support for lithographic printing plate through a primary receptor, the toner image is completely transferred in comparison with a case wherein only a toner image is transferred. Accordingly, the lithographic printing plate obtained has excellent image qualities and faithful reproduction of highly accurate image can be achieved.

In accordance with the present invention, the non-tacky resin layer is provided on the transfer layer (T) bearing the non-fixing toner image on support for lithographic printing plate and the adhesion between the transfer layer (T) on support for lithographic printing plate and the non-tacky resin layer is controlled to be larger than that between the toner image and the non-tacky resin layer.

Specifically, a force necessary for releasing the non-tacky resin layer from the transfer layer (T) on support for lithographic printing plate in the non-image portion (i.e., adhesion between the non-tacky resin layer and the transfer layer (T) on support) is preferably not less than 200 gram force (g•f) and, on the other hand, a force necessary for removing the non-tacky resin layer from the transfer layer (T) on support for lithographic printing plate in the image portion (i.e., adhesion between the toner image and the non-tacky resin layer) is preferably not more than 20 g•f. More preferably, the adhesion in the non-image portion is not less than 300 g•f and the adhesion in the image portion is not more than 5 g•f.

Making such a substantial difference in the adhesion of non-tacky resin layer between the non-image portion and the image portion, the non-tacky resin layer on the toner image is selectively removed in the image portion without damaging the non-tacky resin layer in the non-image portion.

Measurement of the adhesion described above is conducted according to JIS Z 0237-1980 8.3.1. 180 *Degrees Peeling Method* with the following modifications:

(i) As a test plate of the non-image portion, a support for lithographic printing plate having a transfer layer (T) provided thereon a non-tacky resin layer is used. As a test plate of the image portion, a support for lithographic printing plate having transfer layer (T) bearing a toner image on the whole surface thereof and having the non-tacky resin layer provided thereon is used.

(ii) As a test piece, a silicon adhesive tape of 25 mm in width (#851A manufactured by Minnesota Mining and Manufacturing Co.) is used.

(iii) A peeling rate is 25 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the non-tacky resin layer is peeled approximately 25 mm in length and then peeled continuously at the rate of 25 mm/min using the constant rate of traverse type tensile testing machine. The strength is read at an interval of approximately 5 mm in length of peeling, and eventually read 4 times. The test is conducted on three test pieces. The mean value is determined from 12 measured values for three test pieces and the resulting mean value is converted in terms of 10 mm in width.

With respect to adherence of a transfer layer (T) to a support for lithographic printing plate, the adhesion there between measured according to the above-described method is preferably not less than 500 g•f and more preferably not less than 800 g•f.

According to the method of the present invention, due to the large adhesion between the support for lithographic printing plate and the non-tacky resin layer in the non-image portion, a film strength of the non-image portion is sufficiently maintained against tack of ink and pressure applied at printing and thus, excellent printing durability is obtained. Since the image portion is easily removed due to the small adhesion between the toner image and the non-tacky resin layer and superfluous steps and devices are unnecessary, rapidness and laborsaving of the image formation and downsizing of an apparatus for the method are realizable.

In a preferred embodiment of the present invention, the non-tacky resin layer in the image portion is removable by a dry process. In such a case, the non-tacky resin layer in the image portion is more selectively and simply removed due to cohesive failure of the toner image. For instance, the non-tacky resin layer in the image portion is easily removed by the application of mechanical power including peel-apart or brushing to form a pattern or the non-tacky resin layer on the support.

According to another preferred embodiment of the present invention, the surface of transfer layer (T) transferred onto a support for lithographic printing plate used has a reactive group capable of forming a chemical bond with the non-tacky resin layer at the interface thereof. A chemical reaction occurs at least at the interface between the transfer layer (T) on the support for lithographic printing plate and the non-tacky resin layer in the non-image portion to form a crosslinked structure and the adhesion between the non-tacky resin layer and the transfer layer (T) on the support is more increased and maintained. As a result, it is possible to make a larger difference in the adhesion of the non-tacky resin layer between the image portion and the non-image portion.

Now, the method for preparation of a waterless lithographic printing plate according to the present invention will be described in more detail below.

The construction and material used for the electrophotographic light-sensitive element according to the present invention are not particularly limited and any of those conventionally known can be employed.

Suitable examples of electrophotographic light-sensitive element used are described, for example, in Denshishashin Gakkai (ed), *Denshishashin Gijutsu no Kiso to Oyo,* Corona (1988), Hiroshi Kokado (ed.), *Saikin no Kododen Zairyo to Kankotai no Kaihatsu-Jitsuyoka,* Nippon Kagaku Joho (1985), Takaharu Shibata and Jiro Ishiwatari, *Kobunshi,* Vol. 17, P. 278 (1968), Harumi Miyamoto and Hidehiko Takei, *Imaging,* Vol. 1973, No. 8, Denshishashin Gakkai (ed.), *Denshishashinyo Yukikankotai no Genjo Symposium* (preprint) (1985), R. M. Schaffert, *Electrophotography,* Forcal Press, London (1980), S. W. Ing, M. D. Tadak and W. E. Haas, *Electrophotography Fourth International Conference,* SPSE (1983), Isao Shinohara, Hidetoshi Tsuchida and Hideaki Kusakawa (ed.), *Kirokuzairyo to Kankoseijushi,* Gakkai Shuppan Center (1979), and Hiroshi Kokado, *Kagaku to Kogyo,* Vol. 39, No. 3, P. 161 (1986).

A photoconductive layer for the electrophotographic light-sensitive element which can be used includes a single layer made of a photoconductive compound itself and a photoconductive layer comprising a binder resin having dispersed therein a photoconductive compound. The dispersed type photoconductive layer may have a single layer structure or a laminated structure. The photoconductive compounds used in the present invention may be inorganic compounds or organic compounds.

Inorganic photoconductive compounds used in the present invention include those conventionally known, for example, zinc oxide, titanium oxide, zinc sulfide, cadmium sulfide, selenium, selenium-tellurium, amorphous silicon, and lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer comprising an organic photoconductive compound, a sensitizing dye, and a binder resin, and (ii) a layer comprising a charge generating agent, a charge transporting agent and a binder resin, or a double-layered structure containing a charge generating agent and a charge transporting agent in separate layers.

The photoconductive layer of the electrophotographic light-sensitive element according to the present invention may have any of the above-described structure.

In the latter case, an organic photoconductive compound is employed as the charge transporting agent.

The organic photoconductive compounds which may be used in the present invention include, for example, triazole derivatives, oxadiazole, derivatives, imidazole derivatives, polyarylalkane derivatives, pyrazoline derivatives, pyrazolone derivatives, arylamine derivatives, azulenium salt derivatives, amino-substituted chalcone derivatives, N,N-bicarbazyl derivatives, oxazole derivatives, styrylanthracene derivatives, fluorenone derivatives, hydrazone derivatives, benzidine derivatives, stilbene derivatives, polyvinylcarbazole and derivatives thereof, vinyl polymers, such as polyvinylpyrene, polyvinylanthracene, poly-2-vinyl-4-(4'-dimethylaminophenyl)-5-phenyloxazole and poly-3-vinyl-N-ethylcarbozole, polymers such as polyacenaphthylene, polyindene and an acenaphthylene-styrene copolymer, triphenylmethane polymers, and condensed resins such as pyrene-formaldehyde resin, bromopyrene-formaldehyde resin and ethylcarbazole-formaldehyde resin.

The organic photoconductive compounds which can be used in the present invention are not limited to the above-described compounds, and any of known organic photoconductive compounds may be employed in the present invention. The organic photoconductive compounds may be used either individually or in combination of two or more thereof.

The charge generating agents which can be used in the photoconductive layer include various conventionally known charge generating agents, either organic or inorganic, such as selenium, selenium-tellurium, cadmium sulfide, zinc oxide, and organic pigments described below. The charge generating agent is appropriately selected to have spectral sensitivity suitable for a wavelength of a light source employed for image exposure.

The organic pigments used include azo pigments (including monoazo, bisazo, trisazo and tetraazo pigments), metal-free or metallized phthalocyanine pigments, perylene pigments, indigo or thioindigo derivatives, quinacridone pigments, polycyclic quinone pigments, bisbenzimidazole pigments, squarylium salt pigments, and azulenium salt pigments.

These charge generating agents may be used either individually or in combination of two or more thereof.

The charge transporting agents used in the photoconductive layer include those described for the organic photoconductive compounds above. The charge transporting agent is appropriately selected so as to suite the charge generating agent to be employed in combination.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resin.

Binder resins which can be used in the electrophotographic light-sensitive element according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to 200° C., and more preferably from −10° to 140° C.

Suitable examples of the binder resin used are described, for example, in Koichi Nakamura (ed.), *Kioku Zairyoyo Binder no Jissai Gijutsu,* Ch. 10, C.M.C. (1985), Tsuyoshi Endo, *Netsukokasei Kobunshi no Seimitsuka,* C.M.C. (1986), Yuji Harasaki, *Saishin Binder Gijutsu Binran,* Ch. II-1, Sogo Gijutsu Center (1985), Takayuki Otsu, *Acryl Jushi no Gosei•Sekkei to Shinyoto Kaihatsu,* Chubu Kei-ei Kaihatsu Center Shuppanbu (1985), Eizo Omori, *Kinosei Acryl-Kei Jushi,* Techno System (1985), D. Tatt and S. C. Heidecker, *Tappi,* Vol. 49, No. 10, P. 439 (1966), E. S. Baltazzi and R. G. Blanchlotte, et al., *Photo. Sci. Eng.,* Vol. 16, No. 5, P. 354 (1972), and Nguyen Chank Keh, Isamu Shimizu and Eiichi Inoue, *Denshi Shashin Gakkaishi,* Vol. 18, No. 2, P. 22 (1980), in addition to the literature references mentioned with respect to the electrophotographic light-sensitive element above.

Specific examples of binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, polyester resins, silicone resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings), and epoxy resins.

Further, the electrostatic characteristics of photoconductive layer are improved by using as the binder resin a resin having a relatively low molecular weight (e.g., a weight average molecular weight of from $10^3$ to $10^4$ and containing an acidic group such as a carboxy group, a sulfo group or a phosphono group. Suitable examples of such a resin are described, for example, in JP-A-64-70761, JP-A-2-67563, JP-A-3-181948 and JP-A-3-249659.

Moreover, in order to maintain a relatively stable performance even when ambient conditions are widely fluctuated, a specific medium to high molecular weight resin is employed as the binder resin. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Also, JP-A-3-206464 and JP-A-3-223762 discloses a resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Further, excellent electrostatic characteristics can be maintained even when ambient conditions are fluctuated or when a scanning exposure system using a semiconductor laser beam is utilized for the image exposure.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described, for example, in *Denshishashin,* Vol. 12, p. 9 (1973), *Yuki Gosei Kagaku,* Vol. 24, No. 11, p. 1010 (1966), Harumi Miyamoto and Hidehiko Takei, *Imaging,* Vol. 1973, No. 8, p. 12, C. J. Young et al., *RCA Review,* Vol. 15, p. 469 (1954), Kohei Kiyota et al., *Denkitsushin Gakkai Ronbunshi,* Vol. J 63-C, No. 2, p. 97 (1980), Yuji Harasaki et al., *Kogyo Kagaku Zasshi,* Vol. 66, p. 78 and 188 (1963), Tadaaki Tani, *Nihon Shashin Gakkaishi,* Vol. 35, p. 208 (1972), *Research Disclosure,* No. 216, pp. 117–118 (1982), and F. M. Hamer, *The Cyanine Dyes and Related Compounds,* in addition to the literature references mentioned with respect to the electrophotographic light-sensitive element above.

If desired, the electrophotographic light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone,, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu•Jitsuyoka,* Chs. 4 to 6, Nippon Kagaku Joho (1986). In addition, the compounds as described in JP-A-58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has A thickness of from 0.01 to 5 μm, and preferably from 0.05 to 2 μm.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin,* Vol. 14, No. 1, pp. 2–11 (1975), Hiroyuki Moriga, *Nyumon Tokushushi no Kagaku,* Kobunshi Kankokai (1975), and M. F. Hoover, *J. Macromol. Sci. Chem.,* Vol. A-4, No. 6, pp. 1327–1417 (1970). It is desirable that a surface of the electrophotographic light-sensitive element has releasability. More specifically, an electrophotographic light-sensitive element wherein a surface adhesion thereof is not more than 20 g•f is preferably employed.

Measurement of the surface adhesion is conducted according to JIS Z 0237-1980 8.3.1 180 *Degrees Peeling Method* with the following modifications:

(i) As a test plate, an electrophotographic light-sensitive element on which a transfer layer (T) is to be formed is used.

(ii) As a test piece, a pressure resistive adhesive tape of 6 mm in width prepared according to JIS C2338-1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width. The surface adhesion of primary receptor and support for lithographic printing plate are measured in the same manner.

The surface adhesion of electrophotographic light-sensitive element is more preferably not more than 10 g•f.

By using such an electrophotographic light-sensitive element having the controlled surface adhesion, a transfer layer and a toner image formed on the electrophotographic light-sensitive element is easily released therefrom and transferred together onto a primary receptor.

It is also desired that the surface of electrophotographic light-sensitive element have good smoothness. Specifically, the arithmetic mean roughness (Ra) of the surface is preferably not more than 2.0 μm, more preferably not more than 1.5 μm. The arithmetic mean roughness (Ra) is defined in JIS B 0601 and the value is determined using a contact profile meter as described in JIS B 0651 (cutoff value (λc): 0.16 mm, pricing length (ln): 2.5 mm). By using an electrophotographic light-sensitive element having such a surface smoothness, the releasability of transfer layer at the time of transfer to a primary receptor is further increased and as a result the transferability is improved.

While an electrophotographic light-sensitive element which has already the surface exhibiting the desired releasability can be employed in the present invention, it is also possible to apply a compound (S) containing at least a fluorine atom and/or a silicon atom onto the surface of electrophotographic light-sensitive element for imparting the releasability thereto before the formation of transfer layer (T). Thus, conventional electrophotographic light-sensitive elements can be utilized without taking releasability of the surface thereof into consideration.

Further, when releasability of the surface of electrophotographic light-sensitive element tends to decrease during repeated use of the light-sensitive element having the surface releasability according to the present invention, the method for applying a compound (S) can be employed. By the method, the releasability of light-sensitive element is easily maintained.

The impartation of releasability onto the surface of electrophotographic light-sensitive element is preferably carried out in an apparatus for conducting an electrophotographic process. For such a purpose, a means for applying the compound (S) to the surface of electrophotographic light-sensitive element is further provided in an electrophotographic apparatus.

In order to obtain an electrophotographic light-sensitive element having a surface of the releasability, there are a method of selecting an electrophotographic light-sensitive element previously having such a surface of the releasability, and a method of imparting the releasability to a surface of electrophotographic light-sensitive element conventionally employed by applying the compound (S) for imparting releasability onto the surface of electrophotographic light-sensitive element.

Suitable examples of the electrophotographic light-sensitive elements previously having the surface of releasability used in the former method include those employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750. Also, a method of adsorbing and fixing the Compound (S) according to the present invention, particularly a releasing agent containing a component having a fluorine atom and/or a silicon atom as a substituent in the form of a block (for example, a polyether-, carboxylic acid-, amino group- or carbinol-modified polydialkylsilicone) as described in detail below can be employed.

Further, another example of the electrophotographic light-sensitive elements previously having the surface of releasability is an electrophotographic light-sensitive element containing a polymer having a polymer component containing a fluorine atom and/or a silicon atom in the region near to the surface thereof.

The term "region near to the surface of electrophotographic light-sensitive element" used herein means the uppermost layer of the electrophotographic light-sensitive element and includes an overcoat layer provided on a photoconductive layer and the uppermost photoconductive layer. Specifically, an overcoat layer which contains the above-described polymer to impart the releasability is provided on the electrophotographic light-sensitive element having a photoconductive layer as the uppermost layer, or the above-described polymer is incorporated into the uppermost layer of a photoconductive layer (including a single photoconductive layer and a laminated photo-conductive layer) to modify the surface thereof so as to exhibit the releasability. By using such an electrophotographic light-sensitive element, a toner image can be easily and completely transferred since the surface of electrophotographic light-sensitive element has the good releasability.

In order to impart the releasability to the overcoat layer or the uppermost photoconductive layer, a polymer containing a silicon atom and/or a fluorine atom is used as a binder resin of the layer. It is preferred to use a block copolymer containing a polymer segment comprising a silicon atom and/or fluorine atom-containing polymer component described in detail below (hereinafter referred to as a surface-localized type copolymer sometimes) in combination with other binder resins. Further, such polymers containing a silicon atom and/or a fluorine atom are employed in the form of grains.

In the case of providing an overcoat layer, the above-described surface-localized type block copolymer is used together with other binder resins of the layer for maintaining sufficient adhesion between the overcoat layer and the photoconductive layer.

The surface-localized type copolymer is ordinarily used in a proportion of from 0.1. to 95 parts by weight per 100 parts by weight of the total composition of the overcoat layer.

Specific examples of the overcoat layer include a protective layer which is a surface layer provided on an electrophotographic light-sensitive element for protection known as one means for ensuring durability of the surface of electrophotographic light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-

189559, JP-A-62-75461, JP-A-62-139556, JP-A-62-139557, and JP-A-62208055. Techniques relating to a protective layer using a fluorine type block copolymer are described, for example, in JP-A-61-116362, JP-A-61-117563, JP-A-61-270768, and JP-A-6214657. Techniques relating to a protecting layer using grains of a resin containing a fluorine-containing polymer component in combination with a binder resin are described in JP-A-63-249152 and JP-A-63-221355. Further, a resin layer having the same composition as the non-tacky resin layer described in detail hereinafter may be employed as the overcoat layer.

On the other hand, the method of modifying the surface of the uppermost photoconductive layer so as to exhibit the releasability is effectively applied to a so-called disperse type electrophotographic light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Application No. 534,479A1.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo-and/or heat-curable group-containing component are described in European Patent Application No. 534,479A1. Alternatively, a photo- and/or heat-curable resin may be used in combination wit the fluorine atom and/or silicon atom-containing resin in the present invention.

The polymer comprising a polymer component containing a fluorine atom and/or a silicon atom effectively used for modifying the surface of the electrophotographic light-sensitive material according to the present invention include a resin (hereinafter referred to as resin (P) sometimes) and resin grains (hereinafter referred to as resin grains (PL) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. More preferably, the polymer segment (β) of the block polymer contains at least one polymer component containing at least one photo-and/or heat-curable functional group-containing polymer component.

It is preferred that the polymer segment (β) does not contain any fluorine atom and/or silicon atom-containing polymer component.

As compared with the random copolymer, the block copolymer comprising the polymer segments (α) and (β) (surface-localized type copolymer) is more effective not only for improving the surface releasability but also for maintaining such a releasability.

More specifically, where a film is formed in the presence of a small amount of the resin or resin grains of block copolymer containing a fluorine atom and/or a silicon atom, the resins (P) or resin grains (PL) easily migrate to the surface portion of the film and are localized in situ by the end of a drying step of the film to thereby modify the film surface so as to exhibit the releasability. The copolymer is crosslinked and firmly fixed in the region near to the surface of layer.

Where the resin (P) is the block copolymer in which the fluorine atom and/or silicon atom-containing polymer segment (α) exists as a block, the other polymer segment (β) containing no, or if any a small proportion of, fluorine atom and/or silicon atom-containing polymer component undertakes sufficient interaction with the film-forming binder resin since it has good compatibility therewith. Thus, during the formation of a transfer layer on the electrophotographic light-sensitive element, further migration of the resin into the transfer layer is inhibited or prevented by an anchor effect to form and maintain the definite interface between the transfer layer and the electrophotographic light-sensitive element.

Further, where the segment (β) of the block copolymer contains a photo-and/or heat-curable group, crosslinking between the polymer molecules takes place during the film formation to thereby ensure retention of the releasability at the interface of the electrophotographic light-sensitive element.

The above-described polymer may be used in the form of resin grains as described above.

Where the resin grains according to the present invention are used in combination with a binder resin, the insolubilized polymer segment (α) undertakes migration of the grains to the surface portion and is localized in situ while the polymer segment (β) soluble to a non-aqueous solvent exerts an interaction with the binder resin (an anchor effect) similarly to the above-described resin. When the resin grains or binder resin contain a photo-and/or heat-curable group, further migration of the grains to the transfer layer can be avoided.

The moiety having a fluorine atom and/or a silicon atom contained in the resin (P) or resin grains (PL) includes that incorporated into the main chain of the polymer and that contained as a substituent in the side chain of the polymer.

Suitable examples of the resin (P) and resin grains (PL) are described in European Patent Application No. 534,479A1.

Now, the latter method for obtaining an electrophotographic light-sensitive element having the surface of releasability by applying the compound (S) for imparting the desired releasability to the surface of a conventionally known electrophotographic light-sensitive element before the formation of transfer layer will be described in detail below.

The compound (S) is a compound containing a fluorine atom and/or a silicon atom. The compound (s) containing a moiety having a fluorine and/or silicon atom is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine atom and/or silicon atom-containing moieties include those described with respect to the resin (P) above.

When the compound (S) is a so-called block copolymer, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block.

Specific examples of the compound (S) containing a fluorine and/or silicon atom which can be used in the present invention include fluorine and/or silicon containing organic compounds described, for example, in Tokiyuki Yoshida, et al. (ed.), *Shin-ban Kaimenkasseizai Handbook,* Kogaku Tosho (1987), Takao Karikome, *Saishin Kaimenkasseizai Oyo Gijutsu,* C.M.C. (1990), Kunio Ito (ed.), *Silicone Handbook,* Nikkan Kogyo Shinbunsha (1990), Takao Karikome, *Tokushukino Kaimenkasseizai,* C.M.C. (1986), and A. M. Schwartz, et al., *Surface Active Agents and Detergents,* Vol. II.

Further, the compound (S) according to the present invention can be synthesized by utilizing synthesis methods as described, for example, in Nobuo Ishikawa, *Fussokagobutsu no Gosei to Kino,* C.M.C. (1987), Jiro Hirano et al. (ed.), *Ganfussoyukikagobutsu-Sono Gosei to Oyo,* Gijutsu Joho Kokai (1991), and Mitsuo Ishikawa, *Yukikeiso Senryaku Shiryo,* Chapter 3, Science Forum (1991).

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku,* Asakura Shoten (1971), Yuji Harasaki, *Coating Hoshiki,* Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the surface of electrophotographic light-sensitive element, a method of pressing a curable resin impregnated with the compound (S) on the surface of electrophotographic light-sensitive element, a method wherein an electrophotographic light-sensitive element is wetted with a non-aqueous solvent containing the compound (S) dissolved therein, and then dried to remove the solvent, and a method wherein the compound (S) dispersed in a non-aqueous solvent is migrated and adhered on the surface of electrophotographic light-sensitive element by electrophoresis can also be employed.

Further, the compound (S) can be applied on the surface of electrophotographic light-sensitive element by utilizing a non-aqueous solvent containing the compound (S) according to an ink jet method, followed by drying. The ink jet method can be performed with reference to the descriptions in Shin Ohno (ed.), *Non-impact Printing,* C.M.C. (1986). More specifically, a Sweet process or Hartz process of a continuous jet type, a Winston process of an intermittent jet type, a pulse jet process of an ink on-demand type, a bubble jet process, and a mist process of an ink mist type are illustrated.

Silicon rubber is used as the compound (S). It is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 Kgf/cm$^2$ and a time for contact is ordinarily in a range of from 1 second to 30 minutes. Also, the electrophotographic light-sensitive element and/or Silicone rubber roller may be heated up to a temperature of 150° C., According to this method, it is believed that a part of low molecular weight components contained in silicone rubber is moved from the silicone rubber roller onto the surface of electrophotographic light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controlled using a heat medium, if desired.

The application of compound (S) is preferably performed by a means which is easily incorporated into an electrophotographic apparatus.

An amount of the compound (S) applied to the surface of electrophotographic light-sensitive element is not particularly limited and is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints,* Academic Press (1961), the releasability-imparting effect of the present invention can be obtained. Specifically, when an adhesive strength of the surface of an electrophotographic light-sensitive element to which the compound (S) has been applied is measured according to the method described above, the resulting adhesive strength is preferably not more than 20 g•f.

In accordance with the present invention, the surface of electrophotographic light-sensitive element is provided with the desired releasability by the application of compound (S), and the electrophotographic light-sensitive element can be repeatedly employed as far as the releasability is maintained. Specifically, the application of compound (S) is not always necessarily whenever a series of steps for the preparation of a printing plate according to the present invention is repeated. The application may be suitably performed by an appropriate combination of an electrophotographic light-sensitive element, an ability of compound (S) for imparting the releasability and a means for the application.

Suitable examples of the compound (S) and the application thereof are described in JP-A-7-5727.

In the method of the present invention, a peelable transfer layer (T) is then formed on the electrophotographic light-sensitive element of the surface releasability. The formation of transfer layer is preferably performed together with the electrophotographic process and transfer process in the same apparatus, although it may be conducted independently of these processes.

Now, the transfer layer which can be used in the present invention will be described in greater detail below.

The transfer layer of the present invention mainly composed of the thermoplastic resin (A) is not particularly limited as far as it is radiation-transmittive. Specifically, it is a layer capable of transmitting a radiation having a wavelength which constitutes at least one part of the spectrally sensitive region of electrophotographic light-sensitive element. The layer may be colored. In a case wherein an image transferred onto a support for lithographic printing plate is requested to be distinguished from a background, the transfer layer preferably has a color different from the toner image.

The transfer layer is preferably peelable under a transfer condition of temperature of not more than 180° C. or pressure of not more than 20 Kgf/cm$^2$, more preferably under a condition of temperature of not more than 160° C. or pressure of not more than 10 Kgf/cm$^2$. When the transfer condition is lower than the above-described upper limit, there is no problem in practice since a large-sized apparatus is almost unnecessary in order to maintain the heat capacity and pressure sufficient for release of the transfer layer from the surface of light-sensitive element and transfer to a primary receptor, and the transfer is sufficiently performed at an appropriate transfer speed. While there is no particular lower limit thereof, ordinarily it is preferred to use the transfer layer which is peelable at temperature of not less than room temperature or at a pressure of not less than 100 gf/cm$^2$.

The resin (A) preferably used may be any resin which is peelable under the transfer condition described above.

With respect to the thermal property, the resin (A) has a preferably a glass transition point of not more than 90° C. or a softening point of not more than 100° C., and more preferably a glass transition point of not more than 80° C. or a softening point of not more than 90° C.

The resins (A) may be employed either individually or in combination of two or more thereof. For instance, at least two resins having a glass transition point or a softening point different from each other are preferably used in combination in order to improve transferability. Specifically, a transfer layer comprising a resin having a glass transition point of from 25° C. to 90° C. or a softening point of from 35° C. to 100° C. (hereinafter referred to as resin (AH) sometimes) and a resin having a glass transition point of not more than 30° C. or a softening point of not more than 45° C. (hereinafter referred to as resin (AL) sometimes) and its glass transition point or softening point is at least 2° C. lower than that of the resin (AH) is preferred The resin (AH) has a glass transition point of preferably from 28° C. to 60° C. and more preferably from 30° C. to 50° C., or a softening point of preferably from 38° C. to 80° C. and more preferably from 40° C. to 70° C. and on the other hand, the resin (AL) has a glass transition point of preferably from −50° C. to 28° C. and more preferably from −20° C. to 23° C., or a softening point of preferably from −30° C. to 40° C., and more preferably from 0° C. to 35° C. The glass transition point or softening point of resin (AL) is preferably at least 5° C. lower than that of resin (AH). The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

The resin (AH) and resin (AL) are preferably present in the transfer layer in a weight ratio of resin (AH)/resin (AL) ranging from 5/95 to 90/10, particularly from 10/90 to 70/30. In the above described range of weight ratio of resin (AH)/resin (AL), the advantage of the combination can be effectively obtained.

The transfer layer may be composed of two or more layers, if desired. In accordance with a preferred embodiment, the transfer layer is composed of a first transfer layer ($T_1$) which is provided on the light-sensitive element and comprises a resin having a relatively high glass transition point or softening point, for example, one of the resins (AH) described above, and a second transfer layer ($T_2$) provided thereon comprising a resin having a relatively low glass transition point or softening point, for example, one of the resins (AL) described above, and in which the difference in the glass transition point or softening point therebetween is at least 2° C., and preferably at least 5° C. By introducing such a configuration of the transfer layer, transferability of the transfer layer is remarkably improved, and a further enlarged latitude of transfer condition (e.g., heating temperature, pressure, and transportation speed) can be achieved.

In accordance with a preferred embodiment of the present invention, the transfer layer is chemically bonded to a non-tacky resin layer provided thereon after the transfer to a support for lithographic printing plate at the interface thereof. Specifically, the surface potion of transfer layer has a reactive group capable of forming a chemical bond with a reactive group present in a resin constituting the non-tacky resin layer by the action of radiation, heat or moisture to form a crosslinked structure between the transfer layer and the non-tacky resin layer. For this purpose, a resin containing the reactive group is incorporated into the uppermost portion of transfer layer.

The reactive groups used are same as the curable reactive groups which may be present in the non-tacky resin described hereinafter. The reactive group is employed individually or in combination of two or more thereof. The usable group is appropriately selected so as to react with the reactive group in the non-tacky resin to form a chemical bond.

The content of a polymer component containing the reactive group is at least 1% by weight, preferably not less than 5% by weight based on the total polymer component.

It is more preferred to employ a resin having a polymer component containing a fluorine atom and/or silicon atom in addition to the reactive group in the uppermost portion of transfer layer. The fluorine atom and/or silicon atom may be present in a polymer component containing the reactive group or in other polymer component.

Such a type of the reactive group-containing resin is concentrated and localized near the surface portion of transfer layer during the formation of the layer or the formation of non-tacky resin layer due to difference in a surface free energy. As a result, the crosslinking reaction at the interface between the transfer layer and the non-tacky resin layer effectively proceeds.

The polymer components containing a fluorine atom and/or silicon atom may present at random or in the form of block. A block copolymer containing a polymer segment having a fluorine atom and/or silicon atom as a block is preferred. The polymer component containing a fluorine atom and/or a silicon atom and the block copolymer which can be used are described in detail in EP-A-534,479.

Where the polymer containing a fluorine atom and/or silicon atom-containing polymer component used in the present invention is a random copolymer, the content of the fluorine atom and/or silicon atom-containing polymer component is preferably at least 40% by weight, and more preferably at least 60% by weight based on the total polymer component.

In a preferred embodiment, the above-described polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks. In the block copolymer, the above-described reactive group may be present in the polymer segment (α), polymer segment (β) or both of them.

The reactive group-containing resin is preferably employed in such an amount that the content of the reactive group-containing polymer component present therein is from 1 to 30% by weight based on the total component of the transfer layer.

When resins having different thermal properties, for example, a resin (AH) and a resin (AL) are employed in a combination as described above, the reactive group may be incorporated into either or both of these resins.

Further, in the stratified transfer layer as described above, the reactive group is introduced to a resin, for example, a resin (AL) used in the uppermost transfer layer.

A weight average molecular weight of the resin (A) is preferably from $1\times10^3$ to $5\times10^5$, more preferably from $3\times10^3$ to $8\times10^4$. The molecular weight herein used in measured by a GPC method and calculated in terms of polystyrene.

The resins (A) which can be used in the transfer layer include thermoplastic resins and resins conventionally known as adhesive or stick. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic, ester copolymers, styrene-methacrylic ester copolymers, itaconic diester polymers or copolymers, maleic anhydride copolymers, acrylamide copolymers, methacrylamide copolymers, hydroxy-modified silicone resins, polycarbonate resins, ketone resins, olyester resins, silicon resins, amide resins, hydroxy- or carboxy-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins.

Specific examples of resins are descried, e.g., in *Plastic Zairyo Koza Series,* Vols. 1 to 18, Nikkan Kogyo Shinbunsha (1981), Kinki Kagaku Kyokai Vinyl Bukai (ed.), *Polyenka Vinyl,* Nikkan Kogyo Shinbunsha (1988), Eizo Omori, *Kinosei Acryl Jushi,* Techno System (1985), Ei-ichiro Takiyama, *Polyester Jushi Handbook,* Nikkan Kogyo Shinbunsha (1988), Kazuo Yuki, *Howa polyester Jushi Handbook,* Nikkan Kogyo Shinbunsha (1989), Kobunshi Gakkai (ed.), *Kobunshi Data Handbook* (*Oyo-hen*), Ch. 1, Baifukan (1986), Yuji Harasaki, *Saishin Binder Gijutsu Binran,* Ch. 2, Sogo Gijutsu Center (1985), Taira Okuda (ed.), *Kobunshi Koko,* Vol. 20, Supplement "Nenchaku", Kobunshi Kankokai (1976), Keizi Fukuzawa, *Nenchaku Gijutsu,* Kobunshi Kankokai (1987), Mamoru Nishiguchi, *Secchaku Binran,* 14th Ed., Kobunshi Kankokai (1985), and Nippon Secchaku Kokai (ed.), *Secchaku Handbook,* 2nd Ed., Nikkan Kogyo Shinbunsha (1980).

The resin (A) used in the transfer layer according to the present invention may contain a polymer component (f) containing a moiety having at least one of a fluorine atom and a silicon atom which is effective to increase the peelability of the resin (A) itself. Using such a resin, releasability of the transfer layer from an electrophotographic light-sensitive element is increased and as a result, the transferability is improved.

The moiety having a fluorine atom and/or a silicon atom contained in the resin (A) includes that incorporated into the main chain of the polymer and that contained as a substituent in the side chain of the polymer.

The polymer component (f) is the same as the polymer component containing a fluorine atom and/or a silicon atom described with respect to the resin (P) used in the electrophotographic light-sensitive element above. The content of polymer component (f) is preferably from 3 to 40 parts by weight, more preferably from 5 to 25 parts by weight per 100 parts by weight of the resin (A).

The polymer component (f) may be incorporated into any of the resin (AH) and the resin (AL), when at least two resins (A) having a glass transition point or a softening point different from each other are employed in combination.

In case of the transfer layer having a stratified structure as described above, the resin (A) containing the polymer component (f) is preferably used in the first transfer layer ($T_1$) which is in contact with the electrophotographic light-sensitive element. Releasability of the transfer layer from the light-sensitive element is increased and the transferability is improved.

The polymer components (f) are preferably present as a block in the resin (A). The resin (A) may be any type of copolymer as far as it contains the fluorine atom and/or silicon atom-containing polymer components (f) as a block. The term "to be contained as a block" means that the resin has a polymer segment comprising at least 70% by weight of the fluorine atom and/or silicon atom-containing polymer component based on the weight of the polymer segment. The forms of block include an A-B type block, an A-B-A type block, a B-A-B type block, a grafted type block, and a starlike type block as schematically illustrated with respect to the resin (P) above.

These various types of block copolymers of the thermoplastic resins can be synthesized in accordance with conventionally known polymerization methods. Specifically, those described with respect to the resin (P) above can be employed.

The resin (A) is preferably used at least 70% by weight, more preferably at least 90% by weight based on the total amount of the composition for the transfer layer.

If desired, the transfer layer may contain various additives for improving physical characteristics, such as adhesion, film-forming property, and film strength. For example, rosin, petroleum resin, or silicon oil may be added for controlling adhesion; polybutene, DOP, DBP, low-molecular weight styrene resins, low molecular weight polyethylene wax microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hotmelt Secchaku no Jissai,* pp. 29 to 107, Kobunshi Kankokai (1983).

A total thickness of the transfer layer is suitable from 0.1 to 10 μm, preferably from 0.5 to 8 μm and more preferably from 1 to 5 μm. when the transfer layer has a stratified structure, a thickness ratio of first transfer layer ($T_1$)/second transfer layer ($T_2$) is preferably from 99/1 to 5/95 and more preferably from 95/5 to 30/70. If the transfer layer is too thin, transfer is not performed sufficiently. On the other hand, it is net preferred that the transfer layer is too thick because distortion may occur in the transferred image due to expansion and contraction of the transfer layer.

According to the method of the present invention, the transfer layer is provided on the electrophotographic light-sensitive element before the formation of toner image. It is preferred that the transfer layer is provided each time on the light-sensitive element in an apparatus for performing the electrophotographic process. By the installation of a device of providing the transfer layer in the apparatus for performing the electrophotographic process, the light-sensitive element can be repeatedly employed after the transfer layer is released therefrom. Therefore, it is advantageous in that the formation and release of transfer layer can be performed in sequence with the electrophotographic process in the electrophotographic apparatus. As a result, a cost for the formation of printing plate can be remarkably reduced.

In order to provide the transfer layer on the light-sensitive element in the present invention, conventional layer-forming methods can be employed. For instance, a solution or dispersion containing the composition for the transfer layer is applied onto the surface of light-sensitive element in a known manner. In particular, for the formation of transfer layer on the surface of light-sensitive element, a hot-melt coating method, an electrodeposition coating method or a transfer method from a releasable support is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above mentioned *Hot-melt Secchaku no Jissai,* pp. 197 to 215 can be utilized with modification to suit with coating onto the light-sensitive element. Suitable examples of coating machines include a direct roll coater, an offset gravure roll coater, a rod coater, an extrusion coater, a slot orifice coater, and a curtain coater.

A melting temperature of the resin (A) at coating is usually in a range of from 50° to 180° C., while the optimum temperature is determined depending on the composition of the resin to be used. It is preferred that the resin is first molten using a closed preheating device having an automatic temperature controlling means and then heated in a short time to the desired temperature in a position to be coated on the light-sensitive element. To do so can prevent from degradation of the resin upon thermal oxidation and unevenness in coating.

A coating speed may be varied depending on flowability of the resin at the time of being molten by heating, a kind of coater, and a coating amount, etc., but is suitably in a range of from 1 to 200 mm/sec, preferably from 10 to 100 mm/sec.

Now, the electrodeposition coating method will be described below. According to this method, the resin (A) is electrostatically adhered or electrodeposited (hereinafter simply referred to as electrodeposition sometimes) on the surface of light-sensitive element in the from of resin grains and then transformed into a uniform thin film, for example, by heating, thereby forming the transfer layer. Grains of the resins (A) are sometimes referred to as resin grains (AR) hereinafter.

The resin grains must have either a positive charge or a negative charge. The electroscopicity of the resin grains is appropriately determined depending on a charging property of the light-sensitive element to be used in combination.

The resin grains may contain two or more resins, if desired. For instance, when a combination of resins, for example, those selected from the resins (AH) and (AL) described above, whose glass transition points or softening points are different at least 2° C. from each other is used, improvement in transferability of the transfer layer formed therefrom and an enlarged latitude of transfer conditions can be achieved. Further, durability of the transfer layer increases and printing durability of the resulting waterless lithographic printing plate is improved.

The resin grains containing at least two kinds of resins therein are sometimes specifically referred to as resin grains (ARW) hereinafter.

In the resin grain (ARW), a weight ratio of resin (AH)/resin (AL) is preferably in a range of from 10/90 to 95/5. In such a mixing ratio, the transferability of transfer layer is further improved and the resulting waterless lithographic printing plate exhibits a sufficient strength against tackiness of ink and a mechanical strength of impression cylinder at offset printing and provides a large number of good prints without cutting of image and stains in the non-image areas. A more preferred weight ratio of resin (AH)/resin (AL) is from 30/70 to 90/10.

Two or more kinds of the resin (AH) and resin (AL) may be resent in the state of admixture or may form a layered structure such as a core/shell structure composed of a portion mainly comprising the resin (AH) and a portion mainly comprising the resin (AL) in the resin grain (ARW). In case of core/shell structure, the resin constituting the core portion is not particularly limited and may be the resin (AH) or the resin (AL).

An average grain diameter of the resin grains having the physical property descried above is generally in a range of from 0.01 to 10 μm, preferably from 0.05 to 5 μm and more preferably from 0.1 to 1 μm. The resin grains may be employed as grains dispersed in a non-aqueous system (in case of wet type electrodeposition), or grains dispersed in an electrically insulating organic substance which is solid at normal temperature but becomes liquid by heating (in case of pseudo-wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method.

The mechanical powdering method includes a method wherein the thermoplastic resin is dispersed together with a dispersion polymer in a wet type dispersion machine (for example, a ball mill, a paint shaker, Keddy mill, and Dyno mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan,* Kyoritsu Shuppan (1971), D. H. Solomon, *The Chemistry of Organic Film Formers,* John Wiley & Sons (1976), *Paint and Surface Coating Theory and Practice,* Yuji Harasaki, *Coating Kogaku,* Asakura Shoten (1971), and Yuji Harasaki, *Coating no Kiso Kagaku,* Maki Shoten (1977).

The polymerization granulation method includes a dispersion polymerization method in a non-aqueous system conventionally known and is specifically described, for example, in *Chobiryushi Polymer no Saisentan Gijutsu,* Ch. 2, mentioned above, *Saikin no Denshishashin Genzo System to Toner Zairyo no Kaihatsu-Jitsuyoka,* Ch. 3, mentioned above, and K. E. J. Barrett, *dispersion Polymerization in Organic Media,* John Wiley & Sons (1975).

The resin grains (ARW) containing at least two kinds of resin shaving different glass transition points or softening points from each other therein described above can also be prepared easily using the seed polymerization method. Specifically, fine grains composed of the first resin are prepared by a conventionally known dispersion polymerization method in a non-aqueous system and then using these fine grains as seeds, a monomer corresponding to the second resin is supplied to conduct polymerization in the same manner as above.

The resin grains (AR) composed of a random copolymer containing the polymer component (f) to increase the peelability of the resin (A) can be easily obtained by performing a polymerization reaction using one or more monomers forming the resin (A) which are soluble in an organic solvent but becomes insoluble therein by being polymerized together with a monomer corresponding to the polymer component (f) according to the polymerization granulation method described above.

The resin grains (AR) containing the polymer component (f) as a block can be prepared by conducting a polymerization reaction using, as a dispersion stabilizing resins, a block copolymer containing the polymer component (f) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (f) as the main repeating unit together with one or more monomers forming the resin (A). Alternatively, the resin grains composed of block copolymer can be obtained by conducting a polymerization reaction using a polymer initiator (for example, azobis polymer initiator or peroxide polymer initiator) containing the polymer component (f) as the main repeating unit.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters.

A dispersive medium used for the resin grains dispersed in a non-aqueous system is usually a non-aqueous solvent having an electric resistance of not less than $10^8$ Ω•cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples, of the solvent include octane, isooctane, decane, isodecane, decalin, nonane, dodecane, isododecane, cyclohexane, cyclooctane, cyclodecane, benzene, toluene, xylene, mesitylene, Isopar E. Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as anon-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω•cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu-Jitsuyoka,* pp. 139 to 148, mentioned above, Denshishashin Gakkai (ed.), *Denshishashin Gijutsu no Kiso to Oyo,* pp. 497 to 505, Corona Sha (1988), and Yuji Harasaki, *Denshishashin,* Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are also employed.

The dispersion of resin grains in a non-aqueous system (latex) which can be employed for electrodeposition usually comprises from 0.1 to 30 g of grains mainly containing the resin (A), from 0.01 to 100 g of a dispersion stabilizing resin and if desired, from 0.0001 to 10 g of a charge control agent per one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicon oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω•cm, a sufficient amount of the resin grains deposited is reluctant to obtain and, hence, it is necessary to control the amounts of these additives in the range of not lowering the electric resistance than $10^8$ Ω•cm.

The resin grains which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo,* pp. 275 to 285, mentioned above. Specifically, the grains comprising the resin (A) are supplied between the light-sensitive element and an electrode placed in face of the light-sensitive element, and migrated by electrophoresis according to a potential gradient applied from an external power source to cause the grains to adhere to or electrodeposit on the light-sensitive element, thereby a film being formed.

In general, if the charge of grains is positive, an electric voltage was applied between an electroconductive support of the light-sensitive element and a development electrode of a developing device from an external power source so that the light-sensitive element is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toned development as described in *Denshishashin Gijutsu no Kiso to Oyo,* pp. 46 to 79, mentioned above.

The medium for the resin grains dispersed therein which becomes liquid by heating is an electrically insulating organic compound which is solid at normal temperature and becomes liquid by heating at temperature of from 30° C. to 80° C., preferably from 40° C. to 70° C. Suitable compounds include paraffins having a solidifying point of from 30° C. to 80° C., waxes, low molecular weight polypropylene having a solidifying point of from 20° C. to 80° C., beef tallow having a solidifying point of from 20° C. to 50° C. and hardened oils having a solidifying point of from 30° C. to 80° C. They may be employed individually or as a combination of two or more thereof.

Other characteristics required are same as those for the dispersion of resin grains used in the wet type developing method.

The resin grains used in the pseudo-wet type electrodeposition according to the present invention can stably maintain their state of dispersion without the occurrence of heat adhesion of dispersed resin grains by forming a core/shall structure wherein the core portion is composed of a resin having a lower glass transition point or softening point and the shell portion is composed of a resin having a higher glass transition point or softening point which is not softened at the temperature at which the medium used becomes liquid.

The amount of resin grain adhered to the light-sensitive element can be appropriately controlled, for example, by modifying an external bias voltage applied, a potential of the primary receptor charged and a processing time.

After the electrodeposition of grains, the liquid is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the resin grains in the form of a film, whereby the transfer layer is formed.

The electrodeposition coating method is particularly preferred since a device used therefor is simple and compact and a uniform layer of a small thickness can be stably and easily prepared.

Now, the formation of transfer layer by the transfer method from a releasable support will be described below. According to this method, the transfer layer provided on a releasable support typically represented by release paper (hereinafter simply referred to as release paper) is transferred onto the light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto-Kakushu Oyoseihin no Kaihatsu Siryo,* published by Keiei Kaihatsu Center Shuppan-bu (May 20, 1978), and *All Paper Guide Shi no Shohin Jiten, Jo Kan, Bunka Sangyo Hen,* published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicon is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale and also generally employed. Specific examples thereof include Separate Shi (manufactured by Oji Paper Co., Ltd.), King Rease (manufactured by Shikoku Seishi K. K.), San Release (manufactured by Sanyo Kokusaku Pulp K. K.) and NK High Release (manufactured by Nippon Kako Seishi K. K.).

In order to form the transfer layer on release paper, a composition for the transfer layer mainly composed of the resin (A) is applied to releasing paper in a conventional manner, for example, by bar coating, spin coating or spray coating to form a film. The transfer layer may also be formed on release paper by a hot-melt coating method or an electrodeposition coating method.

For a purpose of heat transfer of the transfer layer on release paper to the light-sensitive element, conventional heat transfer methods are utilized. Specifically, release paper having the transfer layer thereon is pressed on the light-sensitive element to heat transfer the transfer layer.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 200 mm/sec and more preferably from 10 to 150 mm/sec. The speed of transportation may differ from that of the electrophotographic step, or that of the heat transfer step of the transfer layer.

According to the method of the present invention, a non-fixing toner image is formed on the electrophotographic light-sensitive element having the transfer layer provided thereon as above by a conventional electrophotographic process using a liquid developer.

The non-fixing toner image means a toner image having adhesion to a non-tacky resin layer smaller than adhesion of the non-tacky resin layer to the transfer layer on the support for lithographic printing plate. The toner image may be subjected to a fixing treatment as long as the above described condition is maintained. The toner image preferably has the adhesion to the non-tacky resin layer not more than 20 g•f, more preferably not more than 5 g•f as described above.

The formation of non-fixing toner image can be easily performed using a conventionally known liquid developer by eliminating a fixing process with heat.

Where conduction of a certain amount of heat occurs during the electrophotographic process or the succeeding formation step of non-tacky resin layer, the condition described above can be fulfilled by modifying a material for forming the toner image. Specifically, there are (1) a method of using a resin having a glass transition point of not less than 40° C., preferably not less than 80° C. for forming a resin grain of toner, (2) a method of using a cured resin grain having a crosslinked structure therein as described, for example, in U.S. Pat. No. 5,334,475, JP-A-5-34998 and JP-A-5150562 as a resin grain of toner, and (3) a method of using a colored grain composed of a pigment and a binder resin wherein a content of the pigment is not less than 50% by weight, preferably not less than 80% by weight. A grain of pigment only may be employed.

In order to form the toner image by an electrophotographic process according to the present invention, any method conventionally known can be employed, as long as the above described condition is fulfilled.

The developer which can be used in the present invention includes conventionally known liquid developers for electrostatic photography. For example, specific examples of the liquid developer are described in *Denshishashin Gijutsu no Kiso to Oyo,* supra, pp. 497–505, Koichi Nakamura (ed.), *Toner Zairyo no Kaihatsu•Jitsuyoka,* Chs. 3 and 4, Nippon Kagaku Joho (1985), Gen Machida, *Kirokuyo Zairyo to Kankosei Jushi,* pp. 107–127 (1983), Denshishashin Gakkai (ed.), *Imaging,* Nos. 2–5, "Denshishashin no. Genzo•Teichaku•Taiden•Tensha", Gakkai Shuppan Center, Denshishashin Gakkai (ed.), *Imaging,* No. 1, "Densishashin no Genzo", pp. 34–42, Denshishashin Gakkai (1977), Soft Giken Shuppanbu (ed.), *Denshishashin Process Gijutsu,* pp. 397–408, Keiei Kaihatsu Center (1989), and Yuji Harasaki, *Denshishashin,* Vol. 16, No. 2, p. 44 (1977).

The typical liquid developer is basically composed of an electrically insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic pigment or dye) and a resin for imparting dispersion stability and chargeability to the developer. If desired, the liquid developer can contain various additives for enhancing charging characteristics or improving image characteristics.

The colorant is appropriately selected from known dyes and pigments, for example, benzidine type, azo type including metallized type, azomethine type, xanthene type, anthraquinone type, triphenylmethane type, phthalocyanine type (including metallized type), titanium white, zinc white, nigrosine, aniline black, and carbon black.

The resin includes one insoluble in the insulating organic solvent, one soluble in the insulating organic solvent which is used for stabilizing dispersion of colorant and/or insoluble resin and one having both an insoluble resin component and a soluble resin component. Suitable resin is not particularly limited and appropriately selected from conventionally known resins, for examples, those described for the binder resin of electrophotographic light-sensitive element.

An average diameter of the colored grain or resin grain dispersed in the insulating organic solvent is preferably from 0.05 to 5 μm, more preferably from 0.1 to 3 μm.

In order to migrate dispersed grains in the insulating organic solvent upon electrophoresis, the grains must be electroscopic grains of positive charge or negative charge. For the purpose of imparting or controlling the electroscopic property of dispersed disperse grains, other additives, for example, alkylsulfosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumaroneindene resins, petronate metal salts, and abietic acid-modified maleic acid resins may be added.

Further, compounds as described, for example, in British Patents 893,429 and 934,038, U.S. Pat. Nos. 1,122,397 3,900,412 and 4,606,989, JP-A-60-179751, JP-A-60-185963, JP-A-2-13965 and JP-A-60-61765 are also employed.

Furthermore, if desired, other additives may be added to the liquid developer in order to maintain dispersion stability and charging stability of grains and to improve transferability of grains. Suitable examples of such additives include rosin, petroleum resins, higher alcohols, polyethers, polyethylene glycols, polypropylene glycols, silicone oils, paraffin wax, triazine derivatives, fluororesins and acrylate resins containing organic base as described in JP-A-59-95543 and JP-A-59-160152.

The total amount of these additives is restricted by the electric resistance of the liquid developer. Specifically, if the electric resistance of the liquid developer in a state of excluding the grains therefrom becomes lower than $10^8$ Ω•cm, a sufficient amount of the grains deposited is reluctant to obtain and, hence, it is necessary to control the amounts of these additives in the range of not lowering the electric resistance than $10^8$ Ω•cm.

With respect to the content of each of the main components of the liquid developer, toner grains comprising a resin (and, if desired, a colorant) are preferably present in an amount of from 0.5 to 50 parts by weight per 1000 parts by weight of a carrier liquid. If the toner content is less than 0.5 part by weight, the image density may be insufficient, and if it exceeds 50 parts by weight, the occurrence of fog in the non-image areas may be tended to.

If desired, the above-described-resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the total amount of additive is preferably controlled so that the liquid developer exclusive of toner particles has an electrical resistivity of not less than $10^9$ Ω•cm. If the resistivity is less than $10^9$ Ω•cm, a continuous gradation image of good quality may hardly be obtained.

The liquid developer can be prepared, for example, by mechanically dispersing a colorant and a resin in a dispersing machine, e.g., a sand mill, a ball mill, a jet mill, or an attritor, to produce colored grains, as described, for example, in JP-B-35-5511 (the term "JP-B" as used herein means an examined Japanese patent publication), JP-B-35-13424, JP-B-50-40017, JP-B-49-98634, JP-B-58-129438, and JP-A-61-180248.

The liquid developer can also be obtained by a method comprising preparing dispersed resin grains utilizing a conventionally known non-aqueous dispersion polymerization method and mixing them with colored grains prepared separately by wet dispersion of colorant with a dispersant. The dispersed resin grains by non-aqueous dispersion polymerization method are described, for example, in U.S. Pat. No. 3,990,980, JP-B-4-31109 and JP-B-6-40229.

It is also known to color the dispersed resin grains. In such a case, the dispersed grains prepared can be colored by dyeing with an appropriate dye as described, for example, in JP-A-57-48738, or by chemical bonding of the dispersed grains with a dye as described, for example, in JP-A-53-54029. It is also effective to polymerize a monomer already containing a dye at the polymerization granulation to obtain a dye-containing copolymer as described, for example, in JP-B-44-22955.

The thickness of toner image is 0.5 μm or more, and preferably in a range of from 2 to 3 μm. In such a range of thickness, the toner image is easily remove in the succeeding removing step of toner image portion. This is also advantageous to prevent from using an unnecessarily large amount of the toner.

The toner image formed on the electrophotographic light-sensitive element in the state of non-fixing is then transferred together with the transfer layer via a primary receptor (an intermediate transfer medium) to a support for lithographic printing plate by a contact transfer method according to the present invention.

A primary receptor used in the contact transfer method has a function of receiving the toner image together with the transfer layer from the electrophotographic light-sensitive element under a condition of applying heat and/or pressure and then releasing and transferring the toner image together with the transfer layer to a support for lithographic printing plate under a condition of applying heat and/or pressure. It is important therefore that releasability of the surface of primary receptor is less than releasability of the surface of electrophotographic light-sensitive element but is sufficient for peeling and transferring onto the support for lithographic printing plate. Specifically, the primary receptor has the surface adhesion larger, preferably 10 g•f larger, more preferably 30 g•f larger, than the surface adhesion of electrophotographic light-sensitive element. On the other hand, the surface adhesion of primary receptor is preferably from 20 to 200 g•f, more preferably from 30 to 180 g•f.

The adhesion of the surface of primary receptor can be easily adjusted by applying the method as described with respect to the releasability of the surface of electrophotographic light-sensitive element hereinbefore, including the application of the compound (S). The surface of primary receptor has preferably an average roughness of 0.01 mm or below.

A primary receptor employed in the transfer step includes, for example, primary receptors of drum type and endless belt type which are repeatedly usable. A material of the primary receptor is appropriately selected taking the transfer method employed into consideration. In the primary receptor of drum type or endless belt type, an elastic material layer or a stratified structure of an elastic material layer and a reinforcing layer is preferably provided on the surface thereof stationarily or removably so as to be replaced.

Any of conventionally known natural resins and synthetic reins can be used as the elastic material. These resins may be used either individually or as a combination of two or more thereof in a single or plural layer. Specifically, various resins described, for example, in A.D. Roberts, *Natural Rubber Science and Technology,* Oxford Science Publications (1988), W. Hofmann, *Rubber Technology Handbook,* Hanser Publisher (1989) and *Plastic Zairyo Koza,* Vols. 1 to 18, Nikkan Kogyo Shinbunsha can be employed.

Specific examples of the elastic material include styrene-butadiene rubber, butadiene rubber, acrylonitrile-butadiene rubber, cyclized rubber, chloroprene rubber, ethylene-propylene rubber, butyl rubber, chloro-sulfonated polyethylene rubber, silicone rubber, fluoro-rubber, polysulfide rubber, natural rubber, isoprene rubber and urethane rubber. The desired elastic material can be appropriately selected taking releasability or durability into consideration. The thickness of elastic material layer is preferably from 0.01 to 10 mm.

Examples of materials used in the reinforcing layer for the elastic material layer include cloth, glass fiber, resin-impregnated specialty paper, aluminum and stainless steel. A spongy rubber layer may be provided between the surface elastic material layer and the reinforcing layer.

Conventionally known materials can be used as materials for the primary receptor of endless belt type. For example, those described in U.S. Pat. Nos. 3,893,761, 4,684,238 and 4,690,539 are employed. Further, a layer serving as a heating medium may be provided in the belt as described in JP-W-4-503265 (the term "JP-W" as used herein means an "unexamined published international patent application").

With respect to the primary receptor, further reference can be made to JP-W-5-503166, JP-A-2-264280, JP-A-3-243974, JP-A-4-9085, JP-A-5-341661 and JP-A-6-242658.

Since the transfer is performed through the primary receptor, a pressure applied to the toner image portion can be reduced with the elastic material layer due to a cushioning effect. Thus, the toner image of high accuracy is faithfully transferred without the occurrence of distortion or shear.

The heat-transfer of the toner image together with the transfer layer onto a primary receptor can be performed using known methods and devices. For instance, the light-sensitive element having the transfer layer and the toner image formed thereon is brought into intimate contact with a primary receptor under heating and pressing, whereby the toner image is transferred together with the transfer layer onto the primary receptor.

The nip pressure at the transfer is preferably in a range of from 0.1 to 10 kgf/cm$^2$ and more preferably from 0.2 to 5 kgf/cm$^2$. The pressure is applied by springs provided on opposite ends of the roller shaft or by an air cylinder using compressed air. A speed of the transportation is preferably in a range of from 10 to 300 mm/sec and more preferably in a range of from 50 to 200 mm/sec. The speed of transportation may differ between the electrophotographic process and the heat transfer step.

The surface temperature of light-sensitive element at the time of heat transfer is preferably in a range of from 30° to 80° C., and more preferably from 35° to 60° C. The surface temperature of primary receptor is preferably in a range of from 40° to 100° C., and more preferably from 45° to 70° C.

The toner image and transfer layer on the primary receptor is than heat-transferred onto a support for lithographic printing plate by a contact transfer method.

The heat-transfer can also be performed using known methods and devices. Preferred range of a nip pressure between the primary receptor and a backup roller for support for lithographic printing plate, a transportation speed and a surface temperature of primary receptor are same as those described for the heat transfer step from the light-sensitive element to the primary receptor. Particularly, in case of conducting the first transfer step and the second transfer step at the same temperature of primary receptor and the same transportation speed. These steps can be continuously performed and thus, a further reduction of processing time can be achieved.

The surface temperature of backup rollers for support for lithographic printing plate, i.e., a backup roller for transfer and a backup roller for release may be the same or different and preferably in a range of from 50° to 140° C., and more preferably from 70° to 120° C. Even if the surface temperature of backup roller is adjusted at a high temperature in the second transfer step, the effect of heat on the light-sensitive element can be reduced by controlling the temperature of primary receptor.

In the method of the present invention, the transfer of toner image together with the transfer layer from the light-sensitive element to the primary receptor first transfer step and the transfer of toner image together with the transfer layer from the primary receptor to the support for lithographic printing plate (the second transfer step) may be simultaneously performed within one sheet. Alternatively, after the transfer of all images of one sheet from the light-sensitive element to the primary receptor is completed, the image is then transferred to the support for lithographic printing plate.

As the support for lithographic printing plate used in the present invention, any support suitable for conventionally known offset printing plate can be employed. For increasing printing durability, a support having good mechanical strength, crumple-resistivity and stretch-resistivity is preferred.

Suitable examples of support include a plastic sheet, paper having been rendered durable to printing, paper laminates with a plastic sheet or a metal foil, an aluminum plate, a zinc plate, a bimetal plate, e.g., a copper-aluminum plate, a copper-stainless steel plate, or a chrominm-copper plate, a trimetal plate, e.g., a chromium-copper-aluminum plate, a chromium-lead-iron plate, or a chromium-copper stainless steel plate. The support preferably has a thickness of from 0.1 to 3 mm, and particularly from 0.1 to 1 mm.

Now, a non-tacky resin layer which is provided on the whole surface of support for lithographic printing plate having the toner image and the transfer layer will be described in detail below.

The non-tacky resin layer which can be used in the present invention is a resin layer having adhesion to the transfer layer (T) on the support for lithographic printing plate larger than adhesion thereof to the toner image, forming an ink repellant surface in order to prevent ink from sticking to the surface at the time of printing after the preparation of a waterless lithographic printing plate and having a good anti-abrasion property. The adhesion of non-tacky resin layer to the surface of transfer layer (T) is preferably not less than 200 g•f as described above.

In order to provide the difference in adhesion between the non-image portion and the image portion as described above, the following means are illustrated, but the present invention is not to be limited thereto.

I. Making the non-tacky resin layer of a specific composition.

i) Incorporating a specific component into the non-tacky resin layer.

ii) Incorporating a resin for adhesion into the non-tacky resin layer in addition to the non-tacky resin.

iii) Forming the non-tacky resin layer having a stratified structure composed of an adhesive layer and an ink repellant layer to divide the functions of non-tacky resin layer.

II. Providing the transfer layer having an affinity with the non-tacky resin layer on the support for lithographic printing plate.

III. Forming a chemical bond between the surface of transfer layer on the support for lithographic printing plate and the non-tacky resin layer.

These means may be employed individually or in a combination of two or more thereof. These means will be described in more detail hereinafter.

The surface of non-tacky resin layer preferably has a surface energy of not more than 30 erg•cm$^{-1}$ for ink repellency. To control the surface energy in such a range prevent the sticking of ink and provides clear prints free from stain in the non-image portion. The surface energy of non-tacky resin layer is preferably not more than 28 erg•cm$^{1}$, more preferably not more than 25 erg•cm$^{-1}$, and particularly preferably in a range of from 25 erg•cm$^{-1}$ to 15 erg•cm$^{-1}$.

One example for controlling the surface energy of non-tacky resin layer in the range described above is to incorporate a non-tacky resin, for example, a silicone resin or a fluorinated resin into the non-tacky resin layer.

A resin containing both a silicon atom and a fluorine atom is employed as the non-tacky resin in the present invention. Among the non-tacky resins, silicone resins are preferably employed in the method of the present invention.

The fluorinated resin includes resin mainly composed of polymer component containing a moiety having a fluorine atom.

The moiety having a fluorine atom contained in the resin includes that incorporated into the main chain of polymer and that contained as a substituent in the side chain of polymer.

The fluorine atom-containing moieties include monovalent or divalent organic residues, for example, $—C_nF_{2n+1}$ (wherein n represents an integer of from 1 to 22), $—CFH_2$, $—(CF_2)_mCF_2H$ (wherein m represents an integer of from 1 to 17), $—CF_2—$ and —CFH—.

The fluorine atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—, $$—\overset{d^1}{\overset{|}{N}}—,$$

—CO—, —SO—, $—SO_2—$, —COO—, —OCO—, —CONHCO—, —NHCONH—, $$—\overset{d^1}{\overset{|}{CON}}—, \text{ and } —\overset{d^1}{\overset{|}{SO_2N}}—,$$

wherein $d^1$ represents an alkyl group having from 1 to 3 carbon atoms.

The polymer component containing a fluorine atom is preferably present in a range of from 80 to 100 parts by weight per 100 parts by weight of the total polymer component of the resin.

The resin may contain a curable functional group. The content of curable functional group in the resin is preferably from 1 to 20% by weight. The curable functional group used will be described in greater detail with respect to the silicone resin hereinafter.

A weight average molecular weight of the fluorinated resin in preferably from $5\times10^3$ to $1\times10^6$, and more preferably from $2\times10^4$ to $5\times10^5$.

The silicone resin includes resins mainly composed of polymer component containing a moiety having a silicon atom. Specific examples of the silicone resins used in the present invention include polymers mainly composed of an organosiloxane repeating unit represented by the general formula (I) shown below.

$$\left[\begin{array}{c} R_1 \\ | \\ Si—O \\ | \\ R_2 \end{array}\right] \quad (I)$$

wherein $R_1$ and $R_2$, which may be the same or different, each represents an aliphatic or aromatic hydrocarbon group or a heterocyclic group.

The hydrocarbon group represented by $R_1$ or $R_2$ includes preferably a straight chain or branched chain alkyl group having from 1 to 18 carbon atoms which may be substituted (e.g., methyl, ethyl, propyl, butyl, pentyl, hexyl, heptyl, octyl, nonyl decyl, dodecyl, tridecyl, tetradecyl, hexadecyl, octadecyl, 2-fluoroethyl, trifluoromethyl, 2-chloroethyl, 2-bromoethyl, 2-cyanoethyl, 2-methoxycarbonylethyl, 2-methoxyethyl, 3-bromopropyl, 2-methoxycarbonylethyl, 2,3-dimethoxypropyl, $—(CH_2)_pC_rF_{2r+1}$ (wherein p represents an integer of 1 or 2; and r represents an integer of from 1 to 12), or $—(CH_2)_p—(CF_2)_s—R'$ (wherein p represents an integer of 1 or 2; s represents an integer of from 1 to 12 and R' represents $—CFHCF_3$ or $—CFHCF_2H$)), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, or linolyl) an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybehzyl, dimethylbenzyl, or dimethoxybenzyl), an alicyclic group having from 5 to 8 carbon atoms which may be substituted (e.g., cyclopentyl, cyclohexyl, 2-cyclohexylethyl, 2-cyclopentylethyl, polyfluorohexyl, methylcyclohexyl, or methoxycyclohexyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, fluorophenyl, chlorophenyl, difluorophenyl, bromophenyl, cyanophenyl, acetylphenyl, methoxycarbonylphenyl, ethoxycarbonylphenyl, butoxycarbonylphenyl, acetamidophenyl, propionamidophenyl, or trifluoromethylphenyl).

The heterocyclic group represented by $R_1$ or $R_2$ includes preferably a 5-membered or 6-membered heterocyclic ring containing at least one hetero atom selected from nitrogen atom, an oxygen atom and a sulfur atom which may be substituted and may form a condensed ring. Suitable examples of heterocyclic ring include pyrane, furan, thiophene, morpholine, pyrrole, thiazole, oxazole, pyridine, piperidine, pyrrolidone, benzothiazole, benzoxazole, quinoline, or tetrahydrofuran.

It is preferred that both $R_1$ and $R_2$ are methyl group.

Of the silicone resins, those having a dimethylsiloxane unit, i.e., $R_1$ and $R_2$ each represents a methyl group in the general formula (I), not less than 60% by weight based on the total organo siloxane unit are preferred. The content of dimethylsiloxane unit in the resin is more preferably not less than 75% by weight based on the total organic siloxane unit. By using such a silicone resin, the non-tacky resin layer exhibits excellent ink repellency and thus the occurrence of background stain is prevented.

As the specific component for increasing the adhesion between the non-tacky resin layer and the transfer layer on the support for lithographic printing plate in the non-image portion, a group represented by the general formula (I) wherein $R_1$ and $R_2$ each represents a substituted alkyl group (e.g. an alkyl group substituted with a halogen atom or a cyano group), or a substituted or unsubstituted aralkyl, aromatic or heterocyclic group is employed.

Further, the hydrocarbon group or heterocyclic group represented by $R_1$ or $R_2$ containing a polar group, for example, a carboxy group, a hydroxy group, a mercapto group, a phosphono group or an amido group, or a divalent connecting group, for example, a ureido group (—NHCONH—), a thioether group (—S—) or a urethane group (—NHCOO—) is also employed.

The content of an organo siloxane unit having such a substituent is preferably not more than 40% by weight, more preferably not more than 25% by weight based on the total organo siloxane unit.

The dimethylsiloxane unit preferred as the ink repellant component and the other organo siloxane unit for increasing adhesion are preferably present in the above described range and form any of a random copolymer, a block copolymer and a star copolymer without a particular limitation. Using such a resin in the non-tacky resin layer, it is possible to maintain the good ink repellant surface and increase the adhesion to the transfer layer on the support for lithographic printing plate.

A weight average molecular weight of the silicone resin is preferably from $5\times10^3$ to $1\times10^6$, and more preferably from $2\times10^4$ to $5\times10^5$.

It is preferred that the non-tacky resin layer containing the non-tacky resin used in the present invention is cured to from a crosslinked structure therein prior to the step of selective removing the non-tacky resin layer provided on the toner image. As a result, a mechanical strength of the non-tacky resin layer is increased and the non-image portion is not damaged during the step of removing the toner image portion. Further, its resistance against a mechanical pressure applied at printing is improved and printing durability is increased.

In order to from a cured non-tacky resin layer on the transfer layer bearing the toner image on the support for lithographic printing plate, a method of providing the resin layer containing a previously cured non-tacky resin (method (1)) or a method of providing the resin layer and then curing it (method (2)) can be employed.

Any conventionally known method for curing a resin to form a crosslinked structure can be employed to conduct the above described method (1) and (2). A silicone resin is used as an example in the following description.

For example, a self-crosslinking method of a silicone resin, a method of curing a silicone resin with a crosslinking agent or curing agent containing a group reactive to the silicone resin, a method of curing a silicone resin using a crosslinking agent or curing agent, or a combination thereof can be employed.

A reaction mode of the crosslinking reaction of resin includes any conventionally known chemical reaction to form a bond. Also, a combination of such a reaction can be used.

Specific examples of the reaction mode include the following reactions i) to iv):

i) Crosslinking with an ion bond formed by a chelate reaction between an acidic group (e.g., a carboxy group, a sulfo group, or a phosphono group) contained in the resin and a poly-valent metal ion including a cation of poly-valent metal (e.g., Ca, Mg, Ba, Al, Zn, Fe, Sn, Zr or Ti).

ii) Crosslinking with a chemical bond formed by an addition reaction, a substitution reaction or an elimination reaction between organic reactive groups (for example, a hydroxy group, a thiol group, a halogen atom (e.g., a chlorine atom, a bromine atom or an iodine atom), a carboxy group, an acid anyhydride group, an amino group, an isocyanate group, a protected isocyanate group (a blocked isocyanate group), an acid halide group, an epoxy group, an imino group, a formyl group, a diazo group or an azido group).

iii) Self-crosslinking with a self-coupling group (for example, $—CONHCH_2OR_1$, (wherein $R_1'$ represents a hydrogen atom or an alkyl group),

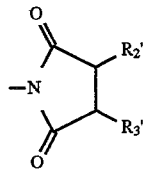

(wherein $R_2'$ and $R_3'$, which may be the same or different, each represents a hydrogen atom or an alkyl group, or $R_2'$ and $R_3'$ may combine each other to form a 5-membered or 6-membered alicyclic ring), a cinnamoyl group or $—Si(R_4')_s(OR_5')_t$ (wherein $R_4'$ represents an alkyl group, an alkenyl group or an aryl group; $R_5'$ represents an alkyl group, s represents an integer of from 0 to 2; and t represents an integer of from 1 to 3, provided that s+t=3)).

iv) Crosslinking by an addition polymerization reaction of a polymerizable double bond group or a polymerizable triple bond group. Suitable examples of the polymserizable double bond group include $CH_2=C(p)COO—$, $C(CH_3)H=CHCOO—$, $CH_2=C(CH_2COOH)COO—$, $CH_2=C(p)CONH—$, $CH_2=C(p)CONHCOO—$, $CH_2=C(p)CONHCONH—$, $C(CH_3)H=CHCONH—$, $CH_2=CHCO—$, $CH_2=CH(CH_2)_nOCO—$, $CH_2=CHO—$, $CH_2=CHC_6H_4—$ and $CH_2=CH—S—$ wherein p represents a hydrogen atom or a methyl group; and n represents an integer of from 0 to 3. Suitable examples of the polymerizable triple bond group include these groups described above but replacing the double bond with a triple bond.

The reactive group appropriately selected is introduced into the silicone resin through a linking group, if desired. Specifically, (1) either $R_1$, $R_2$ or both per se of the organo siloxane unit represented by the general formula (I) is replaced with the reactive group, or either $R_1$, $R_2$, or both of the organo siloxane unit includes the reactive group, (2) a repeating unit of the silicone resin other than the organo siloxane unit includes the reactive group, or (3) the silicone resin includes the reactive group at the terminal of its polymer chain.

Further, conventionally known specific crosslinking reactions of organo siloxanepolymer are effectively employed. These methods are described in details, for example, in Kunio Ito (ed.), *Silicone Handbook*, Nikkan Kogyo Shinbunsha (1990) and Makoto Kumade and Tadashi Wada (supervised), *Saishin Silicone Gijutsu—Kaihatsu to Oyo—*, C.M.C. (1986). Specific examples of the reactive group include the followings. $\equiv Si—H$, $\equiv Si—O—COR_1''$,

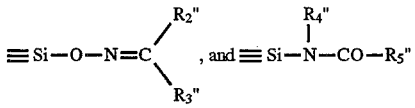

(wherein $R_1''$, $R_2''$, $R_3''$, $R_4''$ or $R_5''$ each represents an alkyl group).

The units containing curable reactive group are present at random in the polymer chain of silicone resin with organo siloxane units represented by the general formula (I) which exhibit ink repellency in case of a random copolymer. The silicone resin also can be a so-called black copolymer wherein a block for ink repellency and a block for curing are bonded. The forms of block include a graft type block, an AB type block (including an ABA type block) and a star type block.

The content of the block for ink repellent in the block copolymer is preferably not less than 30% by weight, and more preferably not less than 50% by weight based on the total polymer component of the silicone resin.

The crosslinking agents or curing agents capable of forming a crosslinked structure in the silicone resin include low molecular weight compounds, oligomers and polymers which are conventionally known as heat-, photo- or moisture-curable compounds. These compounds can be employed individually or in a combination of two or more thereof.

Suitable examples of the crosslinking agent or curing agent used in the present invention include those described, for example, in Shinzo Yamashita and Tosuke Kaneko (ed.), *Kakyozai Handbook*, Taiseisha (1981), Kobunshi Gakkai (ed.), *Kobunshi Data Handbook* (*Kiso-hen*), Baifukan (1986), Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei•Sekkei to Shinyoto Kaihatsu*, Chubu Kei-ei Kaihatsu Center Shuppanbu (1985), and *Silicone Handbook*, supra.

Specific examples of suitable crosslinking agents or curing agents include organo silane compounds (e.g., vinyltrimethoxy silane, vinyltriethoxysilane, γ-glycidoxypropyltrimethoxysilane, γ-mercaptopropyltriethoxysilane, γ-aminopropyltriethoxysilane), vinyltrichlorosilane, vinyltris-(t-butyl-peroxido)silane, γ-(β-aminoethyl) aminoproplytrimethoxysilane, γ-chloropropyltrimethoxysilane, γ-methacryloxypropyltrimethoxysilane, and silane coupling agents), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), blocked polyisocyanate compounds in which isocyanate groups of the above described polyisocyanate compounds are protected (examples of compounds used for the protection of isocyanate group including alcohols, β-diketones, β-ketoesters, and aminos), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum butylate, aluminum acetylacetate, aluminum oxide octate, and aluminum tris(acetylacetate)), polyepoxy-containing compounds and epoxy resins (e.g., the compounds as described in Hiroshi Kakiuchi (ed.), *Shin-Epoxy Jushi,* Shokodo (1985) and Kuniyuki Hashimoto (ed.), *Epoxy Jushi,* Nikkan Kogyo Shinbunsha (1969)), melamine resins (e.g., the compounds as described in Ichiro Miwa and Hideo Matsunaga (ed.), *Urea•Melamine Jushi,* Nikkan Kogyo Shinbunsha (1969)), and poly(meth)acrylate compounds (e.g., the compounds as described in Shin Okawara, Takeo Saegusa, and Toshinobu Higashimura (ed.), *Oligomer,* Kodansha (1976), and Eizo Omori, *Kinosei Acrylkei Jushi,* Techno System (1985)).

Specific examples of the polymerizable functional groups which are contained in the polyfunctional monomer or oligomer (the monomer will sometimes be referred to as a polyfunctional monomer (d)) having two or more polymerizable functional groups include $CH_2{=}CH{-}CH_2{-}$, $CH_2{=}CH{-}CO{-}O{-}$, $CH_2{=}CH{-}$, $CH_{2=C(CH3)}{-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{-}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allyl methacrylamide, allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl-containing carboxylic acids.

If desired, a reaction accelerator may be used together with the resin for accelerating the crosslinking reaction in the non-tacky resin layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include heat-polymerization initiators, such as peroxides and azobis compounds, and photo-polymerization initiators and sensitizers, such as those described, for example, in P. Walker, N. J. Webers, et al., *J. Phot. Sci.,* vol. 18, page 150 (1970) and Katsumi Tokumaru and Shin Okawara (ed.), *Zokanzai,* Kodansha (1987) and including carbonyl compounds, organic sulfur compounds, azine compounds and azo compounds.

In order to accelerate curing or control reaction of the silicone resin, a platinum catalyst, methylvinyltetra siloxane, or an acetylenealcohol is used.

The condition of curing is appropriately selected depending on each elements to be employed.

Heat-curing is conducted in a conventional manner. For example, the heat treatment is carried out at 60° to 150° C. for 5 to 120 minutes. The condition of the heat treatment may be made milder by using the above-described reaction accelerator in combination.

Curing of the resin containing a photocurable functional group can be carried out by incorporating a step of irradiation of actinic ray into the method. The actinic rays to be used include visible light, ultraviolet light, far ultraviolet light, electron beam, x-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 cm to 50 cm for 10 seconds to 10 minutes.

The content of non-tacky resin in the non-tacky resin layer is preferably 60% by weight or more, and more preferably 80% by weight or more based on the total weight of composition of the resin layer.

The non-tacky resin layer used in the present invention can contain other resins in a range which does not adversely affect the ink repellency together with the non-tacky resin in order to increase the adhesion between the non-tacky resin layer and the surface of transfer layer on the support for lithographic printing plate.

As the resin for increasing the adhesion, conventionally known various kinds of resins having a softening point of not less than 30° C. may be employed. Suitable examples of these resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymer, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, polycarbonate resins, ketone resins, polyester resins, amide resins, alkyl-modified nylon resins, hydroxy- or carboxy-modified polyester resins, butyral resins, polyvinyl acetal resins, cyclized rubber-methacrylic ester copolymers, cyclized rubber-acrylic ester copolymers, cellulose acetate resins, urethane resins, copolymers containing a heterocyclic ring which does not contain a nitrogen atom (the heterocyclic ring including, for example, furan, tetrahydrofuran, thiophene, dioxane, dioxofuran, lactone, benzofuran, benzothiophene and 1,3-dioxetane rings) and epoxy resins. Of the resins for increasing the adhesion, vinyl alkanoate polymers or copolymers, acrylic resins, methacrylic resins, vinyl chloride resins, cellulose acetate resins, urethane resins and epoxy resins are particularly preferred.

The content of resin for increasing the adhesion in the non-tacky resin layer is preferably less than 40% by weight, and more preferably less than 20% by weight based on the total weight of resins employed.

The resin for increasing the adhesion may contain a heat-, photo- or moisture-curable reactive group as describe above.

In order to achieve the good ink repellency and the good adhesion in the non-tacky resin layer, the resin for increasing the adhesion is made compatible with the non-tacky resin using the method described, for example, in Gijutsujoho Kyokai (ed.), *Kobunshi no Soyoka to Hyokagijutsu,* (1992) and Seiichi Nakahama et al, Kobunshi Gakkai (ed.), *Kokino Polymer Alloy,* Maruzen (1991).

In the layer composed of a mixture of the non-tacky resin and the resin for increasing the adhesion, the characteristic of the non-tacky resin in that it tends to be concentrated near the surface of the layer can be utilized. It such a case, it is preferred, as one of the resins for increasing the adhesion, to further employ a copolymer containing a block composed of a polymer component having a fluorine atom and/or a silicon atom same as in the non-tacky resin in a small amount in order to increase the interaction between the resins and to increase the cohesion in the layer.

The non-tacky resin layer used in the present invention may have a stratified structure as described above. For example, a double-layer structure wherein a resin layer having good adhesion (adhesive function layer) is provided adjacent to the transfer layer on the support for lithographic printing plate and thereon a layer of the non-tacky resin having good ink repellency is employed.

Maintenance of adhesion between the adhesive function layer and the layer of non-tacky resin having good ink repellency can be performed by adding a copolymer containing a block composed of a polymer component compatible with the resin for increasing the adhesion and a block composed of a polymer component compatible with the non-tacky resin preferably in the adhesive function layer.

As described above, it is preferred that the non-tacky resin layer is chemically bonded to the transfer layer (T) at the interface therebetween in the non-image portion in order to maintain sufficient adhesion.

The method for providing the non-tacky resin layer on the whole surface of transfer layer bearing the toner image is not particularly limited and any conventionally known method can be employed. Specifically, when a resin for the non-tacky resin layer is a liquid form or soluble in a solvent, methods using an air doctor coater, a blade coater, a knife coater, a squeeze coater, a dip ceater, a reverse roll coater, a transfer roll coater, a gravure coater, a kiss roll coater, a spray coater, a curtain coater, or a calender coater as described, for example, in Yuji Harasaki, *Coating Kogaku,* Asakura Shoten (1971), Yuji Harasaki, *Coating Hoshiki,* Maki Shoten (1979), and Hiroshi Fukada, *Hot-melt Secchaku no Jissai* Kobunshi Kankokai (1979) can be used. An ink Jet method as described in Shin Ohno (ed.), *Non-impact Printing,* C.M.C. (1986) including, a Sweet process or Hartz process of continuous jet type, a Winston process of an intermittent jet type, a pulse jet process of an ink on-demand type, a bubble jet process, and a mist process of an ink mist type can also be employed.

Further, a method wherein the non-tacking resin layer provided on a releasable support typically represented by release paper (hereinafter simply referred to as release paper) is transferred onto the transfer layer on the support for lithographic printing plate having the toner image thereon is usable.

The release paper having the non-tacky resin layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto•Kakushu Oyoseihin no Kaihatsu Siryo,* Published by Keiei Kaihatsu Center Shuppan-bu (May 20, 1978), and *All Paper Guide Shi no Shohin Jiten, Jo Kan, Bunka Sangyo Hen,* Published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K. K.), San Release (manufactured by Sanyo Kokusaku Pulp K. K.) and NK High Release (manufactured by Nippon Kako Seishi K. K.).

In order to form the non-tacky resin layer on release paper, a composition for the non-tacky resin layer is applied to releasing paper in a conventional manner, for example, by bar coating, spin coating or spray coating.

For a purpose of transfer of the non-tacky resin layer on release paper to the transfer layer bearing the toner image on the support for lithographic printing plate, a conventional heat transfer method is utilized. Specifically, release paper having the non-tacky resin layer thereon is pressed on the transfer layer on the support for lithographic printing plate to heat transfer the non-tacky resin layer.

The conditions for transfer of the non-tacky resin layer from release paper to the transfer layer on the support for lithographic printing plate are preferably as follows. A nip pressure of the roller is from 0.1 to 20 kgf/cm$^2$ and more preferably from 0.2 to 10 kgf/cm$^2$. A temperature at the transfer is from 25° to 200° C. and more preferably from 40° to 150° C.

The non-tacky resin layer is preferably cured to withstand a pressure applied at printing as described above. Further, it is preferred that the non-tacky resin layer firmly adheres to the surface of transfer layer on the support for lithographic printing plate by a chemical bond.

The formation of such a non-tacky resin layer can be achieved by appropriate application of heat and/or radiation during or after the coating or transfer of the layer. The application of heat and/or radiation is preferably conducted under the condition described above.

After providing the non-tacky resin layer on the transfer layer bearing the toner image on the support for lithographic printing plate, the support is subjected to selective removal of the non-tacky resin layer only in the toner image portion. In order to selectively remove the non-tacky resin layer, a wet process or a dry process can be employed.

In the wet process, the non-tacky resin layer on the toner image is swollen with a solvent and removed in the image portion, while applying a mechanical power such as rubbing if desired, as described, for example, in JP-A-49-121602.

The dry process is preferred in view of simplification of the operation. The dry process is not particularly limited and any method including application of power from outside can be utilized in the present invention.

Specific examples of the suitable method include a peel apart method using an adhesive sheet, a brushing method using a brush and a rubbing method using a rubber.

Further, in case of providing the non-tacky resin layer by the transfer method from release paper, the toner image portion is selectively removed at the time of peeling the release paper by appropriately controlling the releasability between the non-tacky resin layer and the release paper. Specifically, the non-tacky resin layer on release paper is pressed to the transfer layer on the support for lithographic printing plate and then the release paper is stripped. At that time, the non-tacky resin layer in the non-image portion is transferred and remains on the transfer layer on the support and on the other hand, the non-tacky resin layer in the toner image portion is removed together with the release paper (a so-called peel apart method).

Separation of the transfer layer on the support and the non-tacky resin layer in the toner image portion may take place at the interface between the toner image and the transfer layer or the non-tacky resin layer, or in the layer of the toner image (due to the so-called "cohesive failure"). The toner image may be removed together with the non-tacky resin layer upon the separation or may be left on the transfer layer on the support.

The lithographic printing plate thus-obtained according to the method of the present invention can be employed on various offset printing machines without using dampening water in the same manner as conventionally known waterless lithographic printing plate.

Now, the method for preparation of a waterless lithographic printing plate using an electrophotographic process according to the present invention will be described in more detail with reference to the accompanying drawings hereinbelow.

Figure 2:
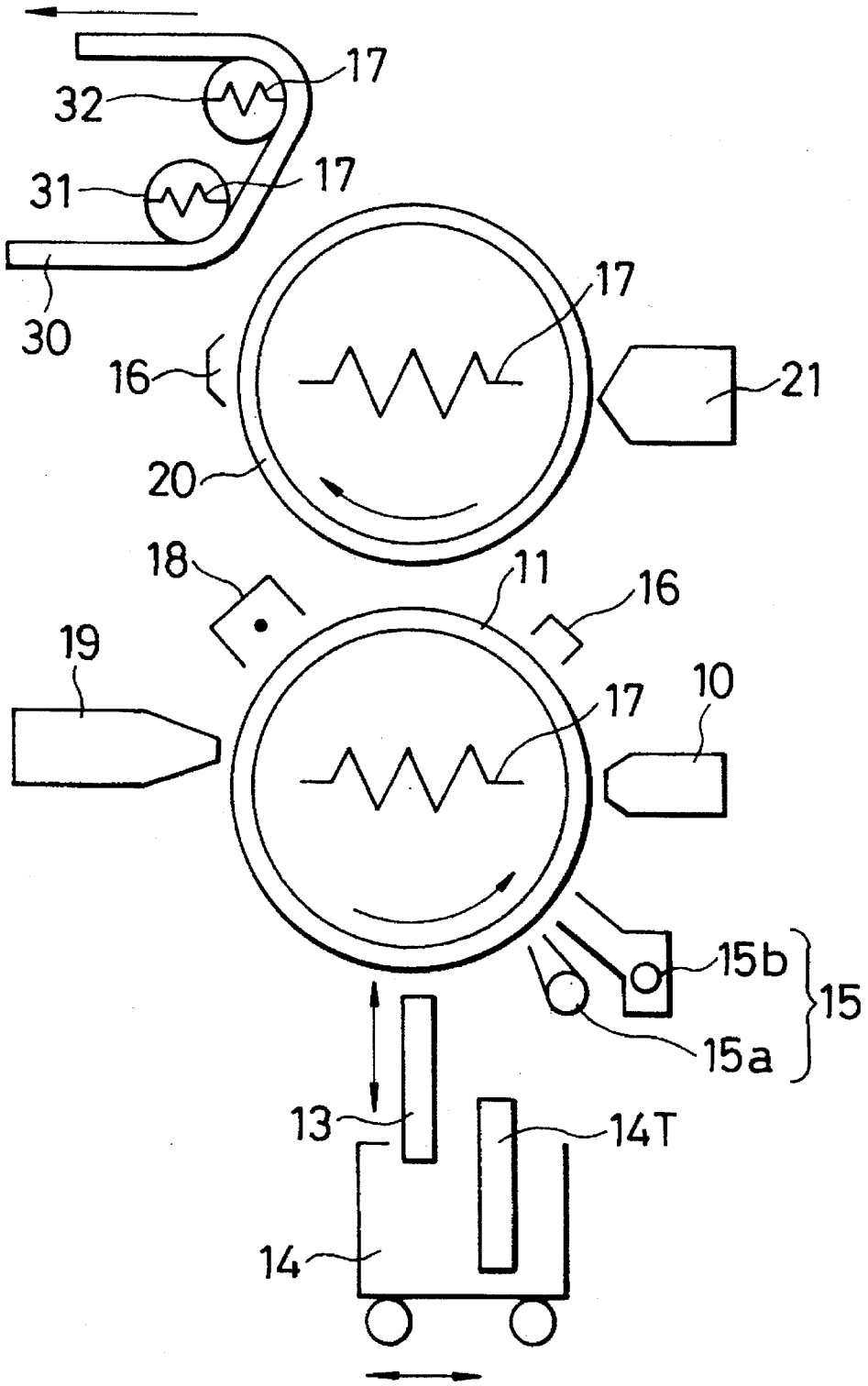
FIG. 2 is a schematic view of an apparatus suitable for performing the method according to the present invention in which a primary receptor of a drum type is used.

FIG. 2 is a schematic view of an apparatus for preparation of a printing plate precursor by an electrophotographic process suitable for conducting the method according to the present invention wherein a primary receptor of a drum type is employed.

On an electrophotographic light-sensitive element 11 is provided a transfer layer by a unit for providing transfer layer 13. In this embodiment, the transfer layer is formed by the electrodeposition coating method. An electrodeposition unit containing a dispersion of resin grains is first brought near the surface of electrophotographic light-sensitive element from a liquid developing unit set 14 and is kept stationary with a gap of 1 mm between the surface thereof and a development electrode of the electrodeposition unit. The light-sensitive element is rotated while supplying the dispersion of resin grains into the gap and applying an electric voltage across the gap from an external power source (not shown), whereby the grains are deposited over the entire areas of the surface of light-sensitive element.

The dispersion of resin grains adhering to the surface of the light-sensitive element is removed by a squeezing device built in the electrodeposition unit. Then the resin grains are fused by a heating means and thus a transfer layer in the form of resin film is obtained.

Figure 3:
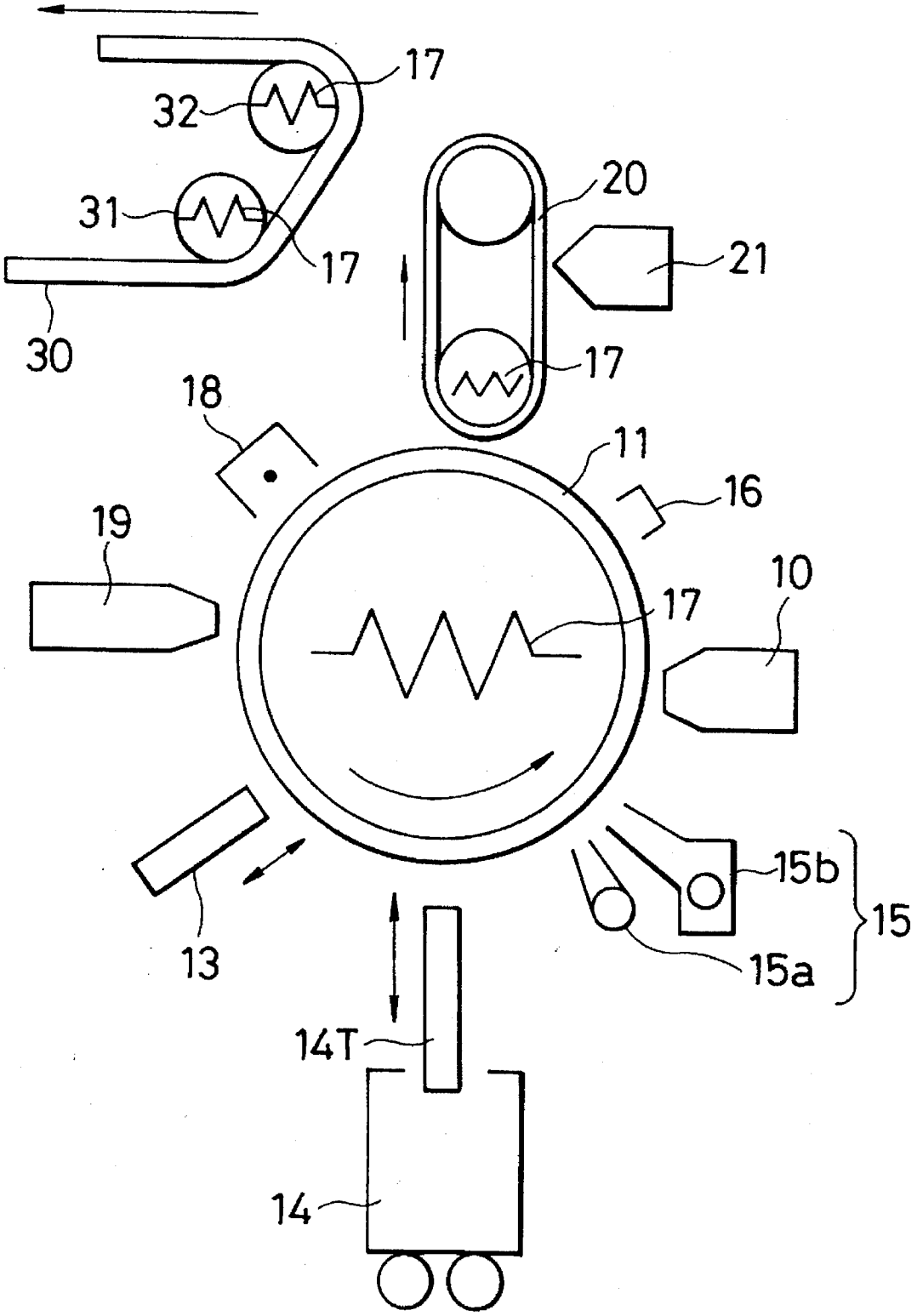
FIG. 3 is a schematic view of an apparatus suitable for performing the method according to the present invention in which a primary receptor of an endless belt type is used.

In order to conduct the exhaustion of solvent in the dispersion, the suction/exhaust unit 15 provided for an electrophotographic process of the electrophotographic light-sensitive element may be employed. While the electrodeposition unit is built in a liquid developing unit set 14 as shown in FIG. 2, it may be provided independently as a unit for providing transfer layer 13 as shown in FIG. 3.

After the transfer layer is formed on the light-sensitive element, the light-sensitive element is subjected to the electrophotographic process to form a toner image.

The light-sensitive element 11 having the transfer layer provided thereon is uniformly charged to, for instance, a positive polarity by a corona charger 18 and then is exposed imagewise by an exposure device (e.g., a semi-conductor laser) 19 on the basis of image information, whereby the potential is lowered in the exposed regions and thus, a contrast in potential is formed between the exposed regions and the unexposed regions. A unit for forming toner image 14T containing a liquid developer comprising resin grains having a positive electrostatic charge dispersed in an electrically insulating liquid is brought near the surface of a light-sensitive material comprising the light-sensitive element 11 and the transfer layer provided thereon from the liquid developing unit set 14 and is kept stationary with a gap of 1 mm therebetween.

The light-sensitive material is first pre-bathed by a prebathing means provided in the unit, and then the liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer adhering to the surface of light-sensitive material is subsequently washed off by a rinsing means provided in the liquid developing unit set 14 and the rinse solution adhering to the surface of light-sensitive material is removed by a squeeze means. As the prebathing solution and the rinse solution, a carrier liquid for a liquid developer is ordinarily used. Then, the light-sensitive material is dried by passing under a suction/exhaust unit 15. Meanwhile a primary receptor 20 is kept away from the surface of light-sensitive material.

The toner image formed on the transfer layer is then transferred form the light-sensitive element 11 onto the primary receptor 20 if desired. Specifically, the transfer layer is pre-heated in the desired range of temperature by a heating means 16, and the primary receptor 20 is also preheated in the desired range of temperature by a heating means 16 if desired, then the transfer layer is brought into close contact with the primary receptor, whereby the toner image is heat-transferred together with the transfer layer onto the primary receptor 20.

The toner image transferred together with the transfer layer 12 on the primary receptor 20 is then heat-transferred onto a support for lithographic printing plate 30 together with the primary receptor 20. Specifically, the primary receptor 20 is pre-heated in the desired range of temperature by the heating means 16, the support for lithographic printing plate 30 is also pre-heated in the desired range of temperature by a back-up roller for transfer 31, the primary receptor 20 bearing the transfer layer and toner image is brought into close contact with the support for lithographic printing plate 30 and then the support for lithographic printing plate 30 is cooled by a back-up roller for release 32, thereby heat-transferring the toner image together with the transfer layer to the support for lithographic printing plate. Thus a cycle of steps is terminated.

In the method of the present invention, the surface of electrophotographic light-sensitive element is first heated to the desired temperature and then the steps of from the formation of transfer layer to the transfer of toner image together with transfer layer onto primary receptor are conducted continuously. Thus, a load for controlling temperature at each step decreases and the total time for the steps is reduced. In case of conducting the heating of surface of electrophotographic light-sensitive element, a temperature for the heating is preferably 70° C. or below, more preferably 60° C. or below. In such a range of temperature, the electrophotographic light-sensitive element is repeatedly employed without damage due to the application of heat thereto.

Figure 4:
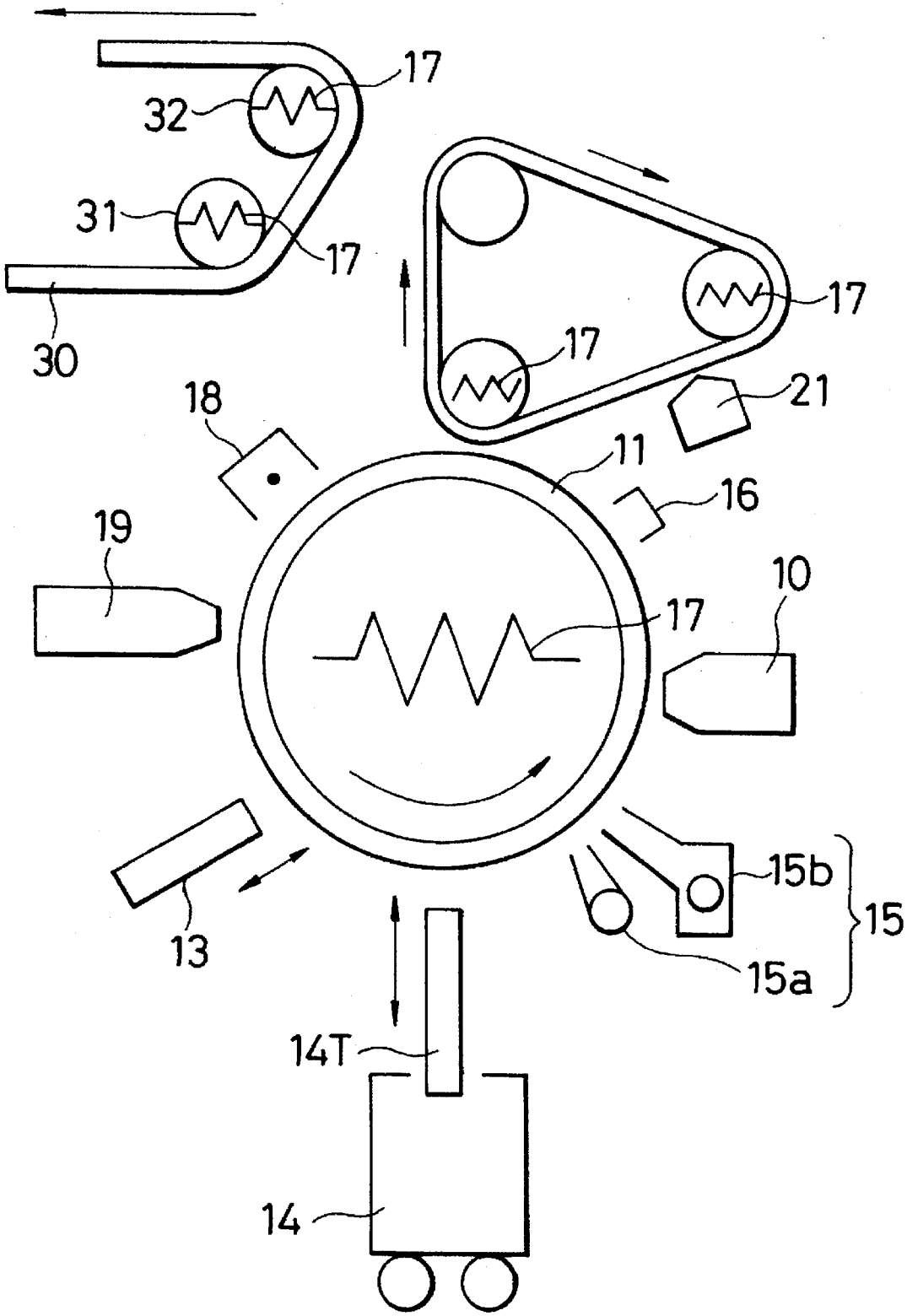
FIG. 4 is a schematic view of an apparatus suitable for performing the method according to the present invention in which a primary receptor of another endless belt type is used.

FIG. 3 and FIG. 4 each is a schematic view of another example of apparatus for preparation of a printing plate precursor by an electrophotographic process suitable for conductors the method according to the present invention wherein a primary receptor 20 of an endless belt type is employed. In the apparatus of FIGS. 3 and 4, their constructions other than the primary receptor are essentially similar to that of the apparatus shown in FIG. 2.

By employing the apparatus as shown in FIG. 4, control of temperature can be effectively performed when a difference in temperature between the first transfer step and the second transfer step.

Figure 5:
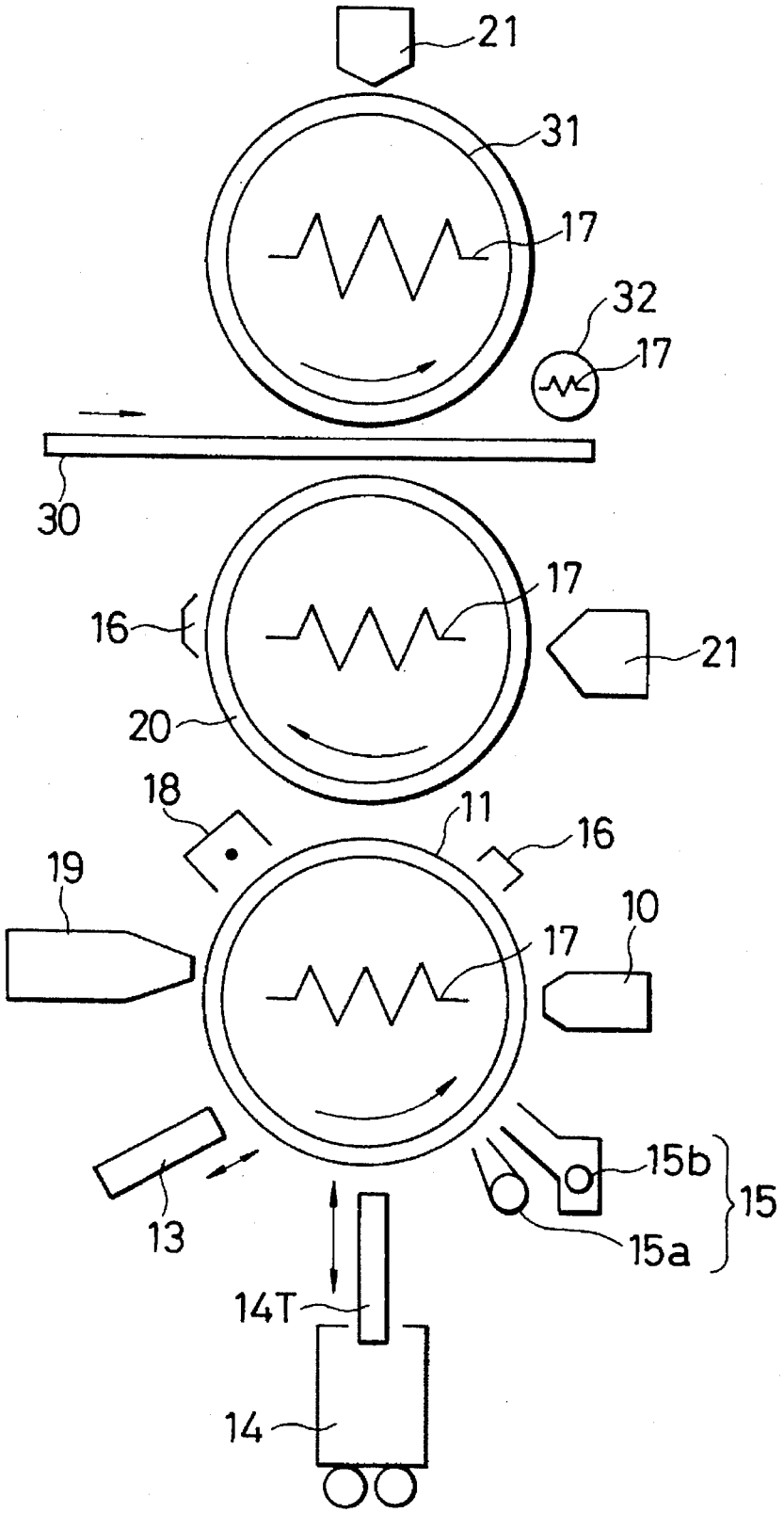
FIG. 5 is a schematic view of an apparatus suitable for performing the method according to the present invention in which a primary receptor of a drum type is used and an impression cylinder is adopted as a backup system for the second transfer.

FIG. 5 is a schematic view of a still another example of apparatus for preparation of a printing plate precursor by an electrophotographic process suitable for conducting the method according to the present invention wherein plane transportation can be conducted at the second transfer step from a primary receptor to a support for lithographic printing plate by using an impression cylinder as a backup roller. In the apparatus of FIG. 5, its construction is essentially similar to that of the apparatus shown in FIG. 2.

Further, in order to provide the transfer layer on the light-sensitive element, a device utilizing the hot-melt Coating method or a device utilizing the transfer method from a releasable support can be used in place of the device utilizing the electorodeposition coating method described above as the unit for providing transfer layer 13.

In case of using the hot-melt coating method, the thermoplastic resin (A) is coated on the surface of light-sensitive element provided on the peripheral surface of a drum by a hot-melt coater and is caused to pass under a suction/exhaust unit to be cooled to a predetermined temperature to form the transfer layer. Thereafter, the hot-melt coater is moved to a stand-by position.

Figure 6:
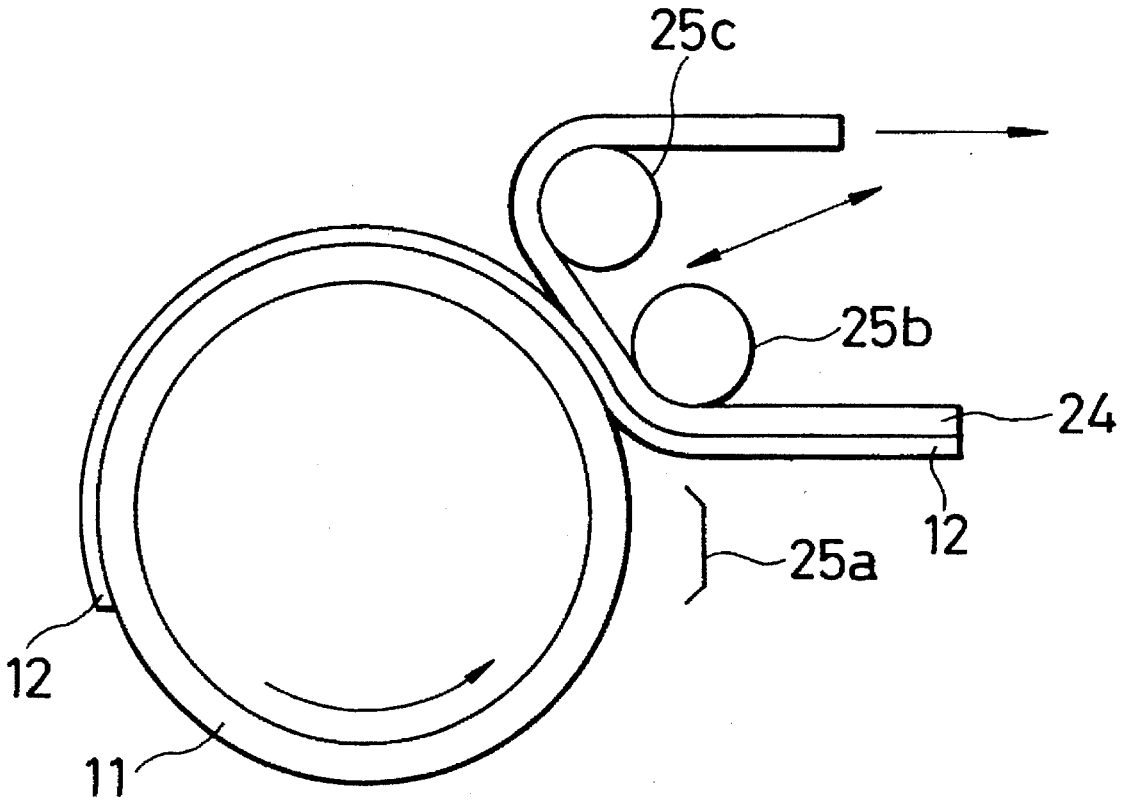
FIG. 6 is a schematic view of a simple device for providing a transfer layer on an electrophotographic light-sensitive element utilizing release paper.

A device for forming a transfer layer on the light-sensitive element using release paper is schematically shown in FIG. 6. In FIG. 6, release paper 24 having thereon the transfer layer 12 is heat-pressed on the light-sensitive element 11 by a heating roller **25*b*, thereby transferring the transfer layer 12 on the surface of light-sensitive element 11. The release paper 24 is cooled by a cooling roller 25*c* and recovered. The light-sensitive element 11 is heated by a heating means 25*a* to improve transferability of the transfer layer 12** upon heat-press, if desired.

The device for forming transfer layer shown in FIG. 6 is first employed to transfer a transfer layer 12 from release paper 24 to a light-sensitive element 11 and then used for transfer of the transfer layer 12 to a support for lithographic printing plate 30 as a transferring device as shown in FIG. 2, 3 or 4. Alternatively, both the device for forming transfer layer for transfer the transfer layer 12 from release paper 24 to the light-sensitive element 11 and the transferring device to a support for lithographic printing plate 30 for transfer the toner image together with the transfer layer 12 are installed in the apparatus according to the present invention.

In accordance with the present invention, the method for preparation of a waterless lithographic printing plate by an electrophotographic process which is suitable for a scanning exposure system using a laser beam of a low power and which provides a lithographic printing plate excellent in image qualities and printing durability in a simple, rapid and laborsaving manner is provided. The waterless lithographic printing plate obtained is capable of faithfully reproducing a highly accurate image.

The present invention is illustrated in greater detail with reference to the following examples, but the present invention is not to be construed as being limited thereto.

SYNTHESIS EXAMPLES OF RESIN GRAIN (AR):

SYNTHESIS EXAMPLE 1 OF RESIN GRAIN (AR): (AR-1)

A mixed solution of 16 g of Dispersion Stabilizing Resin (Q-1) having the structure shown below and 550 g of Isopar H was heated to a temperature of 50° C. under nitrogen gas stream while stirring. To the solution was dropwise added a mixed solution of 50 g of benzyl methacrylate, 40 g of 2-butoxyethyl methacrylate, 10 g Monomer (a-1) having the structure shown below, 2.6 g of methyl 3-mercaptopropionate and 1.2 g of 2,2'-azobis-(2-cyclopropylpropionitrile) (abbreviated as ACPP) over a period of one hour, followed by stirring for one hour. To the reaction mixture was added 0.8 g of ACPP, followed by reacting for 2 hours. Further, 0.5 g of 2,2'-azobis-(isobutyronitrile) (abbreviated as AIBN) was added thereto, the reaction temperature was adjusted to 80° C., and the reaction was continued for 3 hours. After cooling, the reaction mixture was passed through a nylon cloth of 200 mesh to obtain a white dispersion which was a latex of good monodispersity with a polymerization rate of 97% and an average grain diameter of 0.19 μm. The grain diameter was measured by CAPA-500 manufactured by Horiba Ltd. (hereinafter the same).

A part of the white dispersion was centrifuged at a rotation of $1\times10^4$ r.p.m. for one hour and the resin grains precipitated were collected and dried. A weight average molecular weight (Mw) of the resin grain measured by a GPC method and calculated in terms of polystyrene (hereinafter the same) was $8\times10^3$. A glass transition point (Tg) thereof was 34° C.

Dispersion Stabilizing Resin (Q-1)

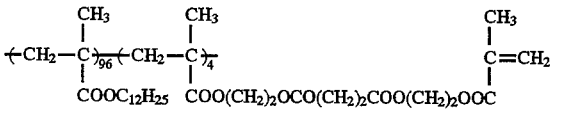

(weight ratio)

Mw $4\times10^4$

Monomer (a-1)

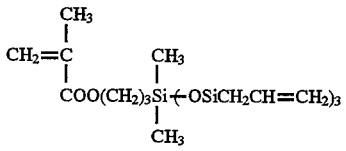

SYNTHESIS EXAMPLE 2 OF RESIN GRAIN (AR): (AR-2)

A mixed solution of 18 g of a dimethylsiloxane monofunctional macromonomer (FM-725 manufactured by Chisso Corp.; Mw: $1.0\times10^4$), 100 g of vinyl acetate and 382 g of Isopar G was heated to a temperature of 75° C. under nitrogen gas stream while stirring. To the solution was added 1.5 g of AIBN, followed by reacting for 3 hours, 0.8 g of AIBN was added to the reaction mixture, the temperature was immediately adjusted to 80° C., followed by reacting for 2 hours, and 0.5 g of AIBN Has further added thereto, followed by reacting for 2 hours. The temperature was adjusted to 100° C. and the unreacted monomer was distilled off. After cooling, the reaction mixture was passed through a nylon cloth of 200 mesh to obtain a white dispersion which was a latex of good monodispersity having a polymerization rate of 98% and an average grain diameter of 0.22 μm. An Mw of the resin grain was $9\times10^4$ and a Tg thereof was 38° C.

SYNTHESIS EXAMPLE 3 OF RESIN GRAIN (AR): (AR-3)

A mixed solution of 12 g of Dispersion Stabilizing Resin (Q-2) having the structure shown below, 65 g of vinyl acetate, 30 g of vinyl valerate, 5 g of crotonic acid and 275 g of Isopar H was heated to a temperature of 80° C. under nitrogen gas stream with stirring.

Dispersion Stabilizing Resin (Q-2)

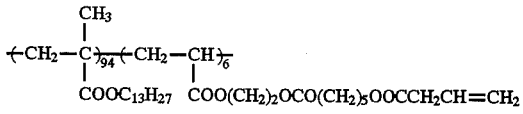

(weight ratio)

Mw $4\times10^4$

To the solution was added 1.6 g of 2,2'-azobis (isovaleronitrile) (abbreviated as AIVN), followed by reacting for 1.5 hours, 0.8 g of AIVN was added thereto, followed by reacting for 2 hours, and 0.5 g of AIBN was further added thereto, followed by reacting for 4 hours. Then, the temperature of the reaction mixture was raised to 100° C. and stirred for 2 hours to distil off the unreacted monomers. After cooling, the reaction mixture was passed through a nylon cloth of 200 mesh to obtain a white dispersion which was a monodispersed latex with a polymerization rate of 93% and an average grain diameter of 0.25 μm. An Mw of the resin grain was $8\times10^4$ and a Tg thereof was 24° C.

SYNTHESIS EXAMPLES 4 TO 9 OF RESIN GRAIN (AR): (AR-4) TO (AR-9)

A mixed solution of 20 g of Dispersion Stabilizing Resin (Q-3) having the structure shown below and 480 g of Isopar G was heated to a temperature of 50° C. under nitrogen gas stream while stirring.

Dispersion Stabilizing Resin (Q-3)

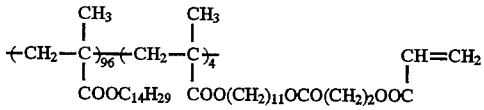

Mw $3.5\times10^4$

To the solution was added dropwise a mixed solution of each of the monomers shown in Table A below, 2.6 g of methyl 3-mercaptopropionate and 1.5 g of AIVN over a period of one hour, followed by reacting for one hour. Then, 1.0 g of AIVN was added thereto and the temperature was adjusted to 70° C. and the reaction was continued for 2 hours. To the reaction mixture was further added 0.8 g of AIBN and the temperature was immediately adjusted to 80° C., followed by reacting for 3 hours. To the reaction mixture was added 60 g of Isopar H, the unreacted monomers were distilled off under a reduced pressure of an aspirator at a temperature of 50° C. After cooling, the reaction mixture was passed through a nylon cloth of 200 mesh to obtain a white dispersion which was a latex of good monodispersity. An average grain diameter of each of the resin grains was in a range of from 0.18 to 0.25 μm. An Mw thereof was in a range of from $9\times10^3$ to $1.5\times10^4$ and a Tg thereof was shown in Table A below.

TABLE A

| Synthesis Example of Resin Grain (AR) | Resin Grain (AR) | Monomer | Amount (g) | Tg (°C.) |
|---|---|---|---|---|
| 4 | AR-4 | Benzyl methacrylate | 60 | 25 |
| | | Acrylic acid | 10 | |
| | | 2-(2-Butoxyethoxy)ethyl methacrylate | 30 | |
| 5 | AR-5 | Methyl methacrylate | 55 | 28 |
| | | Ethyl acrylate | 37 | |
| | | 3-Acryloxypropyl methyldiallylsilane (Monomer (a-2)) | 8 | |
| 6 | AR-6 | Methyl methacrylate | 65 | 36 |
| | | Butyl methacrylate | 35 | |
| | | 3-Methacryloxypropyl trimethoxysilane (Monomer (a-3)) | 10 | |
| 7 | AR-7 | Benzyl methacrylate | 48 | 20 |
| | | 2,3-Dipropionyloxypropyl methacrylate | 40 | |
| | | 3-Methacryloxypropyl tris(allyl-dimethylsiloxy)silane (Monomer (a-4)) | 12 | |
| 8 | AR-8 | Ethyl methacrylate | 70 | 26 |
| | | Glycidyl methacrylate | 20 | |
| | | Methyl methacrylate | 10 | |
| 9 | AR-9 | Benzyl methacrylate | 49 | 22 |
| | | 2-Hexyloxyethyl methacrylate | 40 | |
| | | 3-Methacryloxypropyl bis(vinyl-dimethylsiloxy)methyl silane (Monomer (a-5)) | 11 | |

SYNTHESIS EXAMPLES 10 TO 14 OF RESIN GRAIN (AR): (AR-10) TO (AR-14)

A mixed solution of 8 g of Dispersion Stabilizing Resin (Q-4) having the structure shown below, 12 g of each of the macromonomers shown in Table B below and 392 g of Isopar H was heated to a temperature of 50° C. under nitrogen gas stream while stirring.

Dispersion Stabilizing Resin (Q-4)

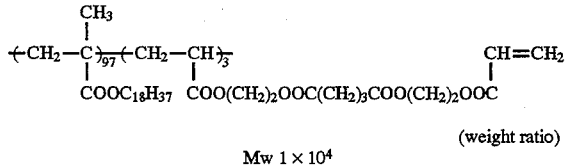

(weight ratio)

Mw $1\times10^4$

To the solution was added dropwise a mixed solution of 50 g of phenethyl methacrylate, 38 g of ethylene glycol propylether methacrylate, 3 g of ACPP and 150 g of methyl ethyl ketone over a period of one hour, followed by reacting for one hour. To the reaction mixture was further added 1.0 g of ACPP, followed by reacting for 2 hours. Then, 1.0 g of AIVN was added thereto and the temperature was immediately adjusted to 75° C., and the reaction was continued for 2 hours. To the reaction mixture was further added 0.8 g of AIVN, followed by reacting for 2 hours. After cooling, the reaction mixture was passed through a nylon cloth of 200 mesh to obtain a white dispersion.

A polymerization rate of each of the resin grains was in a range of from 93 to 99% and an average grain diameter thereof was in a range of from 0.15 to 0.25 μm with a narrow size distribution. An Mw of each of the resin grains was about $1.5\times10^4$ and Tg thereof was in a range of from 30° C. to 35° C.

TABLE B

| Synthesis Example of Resin Grain (AR) | Resin Grain (AR) | Macromonomer | |
|---|---|---|---|
| 10 | AR-10 | 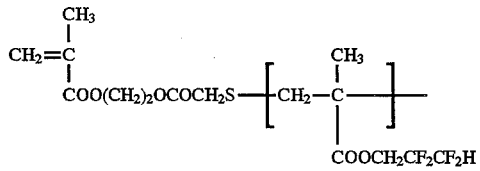 | (M-2) |
| 11 | AR-11 | 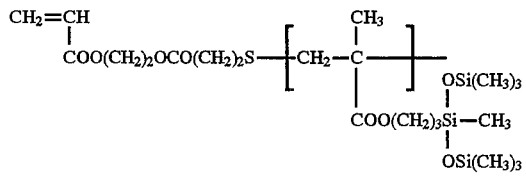 | (M-3) |

TABLE B-continued

| Synthesis Example of Resin Grain (AR) | Resin Grain (AR) | Macromonomer | |
|---|---|---|---|
| 12 | AR-12 | 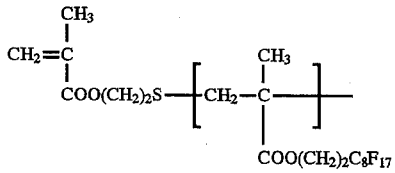 | (M-4) |
| 13 | AR-13 | 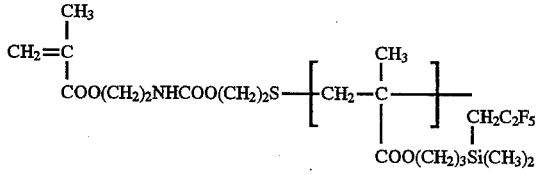 | (M-5) |
| 14 | AR-14 | 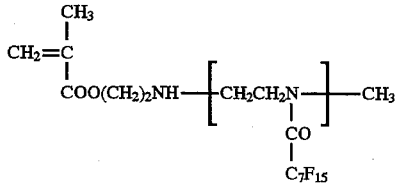 | (M-6) |

SYNTHESIS EXAMPLE 15 OF RESIN GRAIN (AR): (AR-15)

A mixture of resins (A) comprising a vinyl acetate/ethylene (46/54 by weight ratio) copolymer (Evaflex 45X manufactured by Du Pont-Mitsui Polychemicals Co., Ltd.) having a Tg of −25° C. and polyvinyl acetate having a Tg of 38° C. in a weight ratio of 1:1 was melted and kneaded by a three-roll mill at a temperature of 120° C. and then pulverized by a trio-blender. A mixture of 5 g of the resulting coarse powder, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m for 6 hours, and then passed through a nylon cloth of 200 mesh to obtain a white dispersion which was a latex having an average grain diameter of 0.4 μm.

SYNTHESIS EXAMPLE 1 OF RESIN GRAIN (ARW): (ARW-1)

A mixture of 8 g of Dispersion Stabilizing Resin (Q-1) described above, 70 g of vinyl acetate, 30 g of vinyl propionate and 388 g of Isopar H was heated to a temperature of 80° C. under nitrogen gas stream while stirring. To the solution was added 1.5 g of AIBN as a polymerization initiator, followed by reacting for 2 hours. To the reaction mixture was added 0.8 g of AIBN was added thereto, followed by reacting for 2 hours. Further, 0.8 g of AIBN was added thereto, followed by reacting for 2 hours. After cooling the reaction mixture was passed through a nylon cloth of 200 mesh to obtain a white dispersion which was a latex of good monodispersity with a polymerization rate of 93% and an average grain diameter of 0.14 μm. An Mw of the resin grain was $8\times10^4$ and a Tg thereof was 17° C. The resin grain thus obtained is designated as Resin Grain (AR-16).

A mixed solution of the whole amount of the above-described resin grain dispersion (as seed) and 10 g of Dispersion Stabilizing Resin (Q-1) described above was heated to a temperature of 60° C. under nitrogen gas stream with stirring. To the mixture was added dropwise a mixture of 50 g of benzyl methacrylate, 40 g of 2-butoxyethyl methacrylate, 10 g of Monomer (a-1) described above, 2.6 g of methyl 3-mercaptopropionate, 1.0 g of AIVN and 400 g of Isopar G over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization rate of 98% and an average grain diameter of 0.25 μm. The composition of resins used for the shell portion was the same as that of Resin Grain (AR-1).

In order to investigate that the resin grain (ARW-1) thus-obtained was composed of the two kinds of resins, the state of resin grain was observed using a scanning electron microscope (SEM).

Specifically, the dispersion of Resin Grain (ARW-1) was applied to a polyethylene terephthalate film so that the resin grains were present in a dispersive state on the film, followed by heating at a temperature of 30° C. or 60° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 30° C. On the contrary, with the sample heated at 60° C. the resin grains had been melted by heating and were not observed.

The state of resin grain was observed in the same manner as described above with respect to resin grains formed from respective two kinds of resins (copolymers) constituting Resin Grain (ARW-1), i.e., Resin Grain (AR-16) and Resin Grain (AR-1), and a mixture of these resin grains in a weight ratio of 1:1.

As a result, it was found that with Resin Grain (AR-16), the resin grains were already not observed in the sample heated at 30° C. On the other hand, with Resin Grain (AR-1), the resin grains were observed in the sample heated at 30° C. but not observed in the sample heated at 60° C. Further, with the mixture of two kinds of resin grains, disappearance of the resin grains was observed in the sample heated at 30° C. in comparison with the sample before heating.

From these results it was confirmed that Resin Grain (ARW-1) described above was not a mixture of two kinds of resin grains but contained two kinds of resins therein, and had a core/shell structure wherein the resin having a relatively high Tg formed shell portion and the resin having a relatively low Tg formed core portion.

SYNTHESIS EXAMPLES 2 TO 7 OF RESIN GRAIN (ARW): (ARW-2) TO (ARW-7)

Each of Resin Grains (ARW-2) to (ARW-7) was synthesized in the same manner as in Synthesis Example 1 of Resin Grain (ARW) except for using each of the monomers shown in Table C below in place of the monomers employed in Synthesis Example 1 of Resin Grain (ARW). A polymerization rate of each of the resin grains obtained in latexes was in a range of from 95% to 99% and an average grain diameter thereof was in a range of from 0.20 μm to 0.30 μm with good monodispersity.

TABLE C

| Synthesis Example of Resin Grain (ARW) | Resin Grain (ARW) | Monomer for Seed Grain | Amount (g) | Monomer for Feeding | Amount (g) |
|---|---|---|---|---|---|
| 2 | ARW-2 | Methyl methacrylate | 60 | Benzyl methacrylate | 40 |
| | | Ethyl acrylate | 40 | 2-Pentyloxyethyl methacrylate | 32 |
| | | | | 2-Isocyanatoethyl methacrylate | 8 |
| 3 | ARW-3 | 2-Methoxybenzyl methacrylate | 88 | Methyl methacrylate | 40 |
| | | Monomer (a-1) | 12 | 2-(2-Hexyloxyethoxy)ethyl-methacrylate | 55 |
| | | | | Macromonomer M-3 | 5 |
| 4 | ARW-4 | Vinyl acetate | 60 | Benzyl methacrylate | 60 |
| | | Vinyl butyrate | 40 | Methyl acrylate | 30 |
| | | | | Monomer (a-5) | 10 |
| 5 | ARW-5 | Ethyl methacrylate | 76 | 2,6-Dimethylbenzyl methacrylate | 87 |
| | | Methyl acrylate | 15 | Monomer (a-4) | 8 |
| | | 3-Methacryloxypropyl-methyldivinylsilane | 9 | Macromonomer M-4 | 5 |
| 6 | ARW-6 | Benzyl methacrylate | 70 | 3-Phenylpropyl methacrylate | 65 |
| | | Ethyl acrylate | 20 | 2-Ethoxy-1-ethoxymethyethyl methacrylate | 35 |
| | | 3-Methacryloxypropyltris(2-methoxyethoxy) silane | 10 | | |
| 7 | ARW-7 | Vinyl acetate | 65 | Vinyl acetate | 100 |
| | | Vinyl valerate | 30 | | |
| | | Crotonic acid | 5 | | |

EXAMPLE 1

A mixture of 2 g of X-form metal-free phthalocyanine (manufactured by Dainippon Ink and Chemicals, Inc.), 14.4 g of Binder Resin (B-1) having the structure shown below, 3.6 g of Binder Resin (B-2) having the structure shown below, 0.15 g of Compound (A) having the structure shown below, and 80 g of cyclohexanone was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-1)

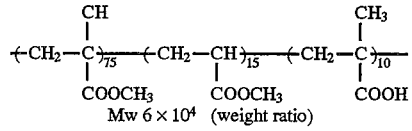

Binder Resin (B-2)

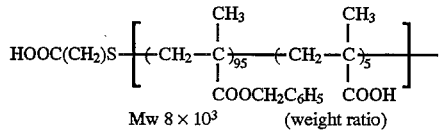

Compound (A)

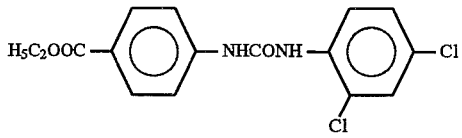

The resulting dispersion was coated on an aluminum plate having a thickness of 0.2 mm, which had been subjected to degrease treatment, by a wire bar, set to touch, and heated in a circulating oven at 110° C. for 20 seconds to form a light-sensitive layer having a thickness of 8 μm.

Then, a surface layer for imparting releasability was provided on the light-sensitive layer.

Formation of Surface Layer for Imparting Releasability

A coating composition comprising 10 g of silicone resin having the structure shown below, 1 g of crosslinking agent having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The surface adhesion of the resulting light-sensitive element was not more than 1 g•f.

Silicone Resin

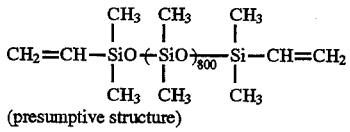

(presumptive structure)

Crosslinking Agent

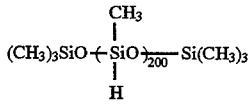

(presumptive structure)

The light-sensitive element having the surface of releasability was installed in an apparatus as shown in FIG. 2 as an electrophotographic light-sensitive element 11. On the other hand, a hollow drum having a temperature controller incorporate therein and being wound with a blanket for offset printing (9600-A manufactured by Meiji Rubber & Co., Ltd.) having the surface adhesion of 190 g•f and a thickness of 1.6 mm was installed as primary receptor 20.

On the light-sensitive element was provided a transfer layer (T) by the electrodeposition coating method using a unit for providing transfer layer 13.

Specifically, on the surface of light-sensitive element which was rotated at a circumferential speed of 100 mm/sec, Dispersion of Resin (A) (L-1) shown below was supplied using a slit electrodeposition device, while putting the light-sensitive element to earth and applying an electric voltage of +130 V to an electrode of the slit electrodeposition device, whereby the resin grains were electrodeposited. The dispersion medium was removed by air-squeezing, and the resin grains were fused by an infrared line heater to form a film, whereby the transfer layer (T) composed of a thermoplastic resin was prepared on the light-sensitive element. A thickness of the transfer layer was 1.5 μm.

| Dispersion of Resin (A) (L-1) | |
|---|---|
| Resin Grain (AR-3) | 20 g (solid basis) |
| Positive-Charge Control Agent (CD-1) (octadecyl vinyl ether/N-tert-dodecyl maleic monoamide (1/1 by molar ratio) copolymer) | 0.08 g |
| Isopar G | up to make 1 liter |

A toner image was then formed on the transfer layer provided on the light-sensitive element by ah electrophotographic process. Specifically, the light-sensitive element 11 was charged to +480 V with a corona charger 18 in dark and image-exposed to light using a semiconductor laser having an oscillation wavelength of 788 nm as an exposure device 19 at an irradiation dose on the surface of light-sensitive element of 30 erg/cm$^2$ based on digital image data of an information which had been obtained by reading an original by a color scanner, conducting several corrections relating to color reproduction specific far color separation system and stored in a hard disc.

Thereafter, the exposed light-sensitive element was subjected to reversal development using Liquid Developer (LD-1) prepared in the manner as described below in a developing machine while applying a bias voltage of +400 V to a development electrode to thereby electrodeposit toner particles on the exposed areas. The light-sensitive element was then rinsed in a bath of Isopar H alone to remove stains on the non-image areas.

Preparation of Liquid Developer (LD-1)

1) Synthesis of Toner Particles:

A mixed solution of 60 g of methyl methacrylate, 40 g of methyl acrylate, 20 g of a dispersion polymer having the structure shown below, and 680 g of Isopar H was heated to 65° C. under nitrogen gas stream with stirring. To the solution was added 1.0 g of 2,2'-azobis(isovaleronitrile) (AIVN), followed by reacting for 4 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C. and the mixture was stirred under a reduced pressure of 30 mmHg for 1 hour to remove any unreacted monomers. After cooling to room temperature, the reaction mixture was filtered through a nylon cloth of 200 mesh to obtain a white dispersion. The reaction rate of the monomers was 98% by weight, and the resulting dispersion had an average grain diameter of resin grain of 0.25 μm (grain diameter being measured by CAPA-500 manufactured by Horiba, Ltd.) and good monodispersity. A Tg of the resin grain was 115° C.

Dispersion Polymer

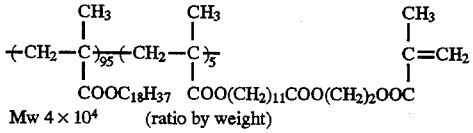

Mw 4 × 10$^4$ (ratio by weight)

2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho. Co.) together with glass beads and dispersed for 4 hours to prepare a fine dispersion of nigrosine.

3) Preparation of Liquid Developer:

A mixture of 45 g of the above-prepared toner particle dispersion, 25 g of the above-prepared nigrosine dispersion, 0.6 g of a hexadecene/maleic acid mono-octadecylamide (1/1 ratio by mole) copolymer, and 10 g of branched octadecyl alcohol (FOC-1800 manufactured by Nissan Chemical Industries, Ltd.) was diluted with 1 l of Isopar G to prepare Liquid Developer (LD-1) for electrophotography.

The drum of light-sensitive element 11, the surface temperature of which had been adjusted at 60° C., and the drum of primary receptor 20 whose surface temperature had been adjusted at 90° C. were brought into contact with each other under the condition of a nip pressure of 4 kgf/cm$^2$ and a drum circumferential speed of 10 mm/sec, whereby the toner image was wholly transferred together with the transfer layer onto the primary receptor.

Then, a support used for an electrophotographic lithographic printing plate precursor (ELP-IX manufactured by Fuji Photo Film Co. Ltd.) was introduced as a support for lithographic printing plate 30 between the drum of primary receptor 20 and a backup roller for transfer 31 adjusted at 130° C. and a backup roller for release 32 adjusted at 25° C., under the condition of a nip pressure of 8 kgf/cm$^2$ and a drum circumferential speed of 10 mm/sec. Thus, the toner image was wholly transferred together with the transfer layer onto the support. The transfer layer sufficiently adhered to the surface of support and the adhesion between the transfer layer and the support was not less than 1 Kg•f.

The toner image transferred on the support was observed by an optical microscope of 200 magnifications. It was found that the image was excellent in that distortion or shear of fine lines or fine letters did not occur, dots of 150 lines per inch was well reproduced and uniformity in high density areas was sufficiently maintained. The adhesion of toner image portion to the transfer layer on the support was 10 g•f.

On the transfer layer bearing the toner image on the support was provided a non-tacky resin layer composed of silicone rubber. Specifically, a mixed solution of 6 g of silicone rubber of condensation type (KS705F manufacture by Shin-Etsu Silicone Co., Ltd.), 240 mg of CAT-PS-1 (manufactured by Shin-Etsu Silicone Co., Ltd.), 120 mg of CAT-PD (manufactured by Shin-Etsu Silicone Co., Ltd.), 2 g of vinyl acetate/crotonic acid (99/1 ratio by mole) copolymer and 34 g of a mixed solvent of heptane and tetrahydrofuran (3:1 ratio by weight) was coated on the whole transfer layer bearing the toner image by a wire bar and heated at 80° C. for 2 minutes to conduct drying and curing, thereby forming a non-tacky resin layer having a thickness of 2.12 μm. The adhesion between the transfer layer and the non-tacky resin layer in the non-image portion was 500 g•f.

Then, the non-tacky resin layer was uniformly rubbed with a PS sponge (manufactured by Fuji Photo Film Co., Ltd.) to remove the non-tacky resin layer only in the toner image portion. As a result, a pattern of the non-tacky resin layer of silicone rubber corresponding to the non-image portion was formed.

The resulting printing plate was subjected to printing using a printing machine (Toko Offset 810L manufactured by Tokyo Koku Keiki Co., Ltd.) and a black ink (Dri-O-Color manufactured by Dainippon Ink and Chemicals, Inc.) without supplying dampening water. More than 3,000 good prints wherein the image was clear without cutting of fine line and fine letter and background stain was not recognized at all in the non-image portion were obtained.

The preparation of printing plate and printing were conducted in the same manner as described in Example 1 above except for using 20 g of Resin Grain (ARW-7) in place of 20 g of Resin Grain (AR-3) in Dispersion of. Resin (A) (L-1) employed for the formation of transfer layer (T). Similar results to Example 1 above were obtained.

Further, the drum circumferential speed in the transfer step was increased from 10 mm/sec to 50 mm/sec. The transfer layer was completely transferred and the resulting duplicated image on the support was excellent without distortion or shear of image. On the contrary, the transfer of transfer layer was insufficient at the drum circumferential speed of 50 mm/sec in case of Example 1. It can be seen that the transfer layer formed from Resin Grain (ARW-7) having a core/shell structure exhibits the more improved transferability.

It is believed that the resin in the transfer layer and the resin in the non-tacky resin layer interact with each other at the interface between two layers to make the sufficient adhesion therebetween according to the method of the present invention.

COMPARATIVE EXAMPLE 1

The support having the transfer layer bearing the toner image same as in Example 1 was heated at 140° C. for 3 minutes to fix the toner image. The adhesion of toner image portion to the transfer layer on the support was 250 g•f.

On the transfer layer bearing the toner image on the support was provided a non-tacky resin layer in the same manner as in Example 1. A thickness of the resulting non-tacky resin layer of silicone rubber was 2.15 μm.

Then, the non-tacky resin layer was rubbed to remove it in the toner image portion under the same condition as in Example 1 to prepare a lithographic printing plate. Using the resulting printing plate, printing was performed in the same manner as in Example 1. Only prints of poor image reproduction were obtained due to insufficient adhesion of ink to the image portion.

As a result of observation of the printing plate using a scanning electron microscope (JSM-T330 manufactured by JEOL Ltd.), it was found that the non-tacky resin layer was not sufficiently removed in the image portion.

The sufficient removal of non-tacky resin layer in the image portion was achieved by conducting rubbing with the sponge under a hard condition. Under such condition, however, many scratches occurred in the non-image portion of non-tacky resin layer which resulted in stains on prints. Consequently, it is difficult to sufficiently remove the non-tacky resin layer in the image portion without damaging the non-image portion of non-tacky resin layer, and the condition is strictly limited, even if it is possible.

It is believed that a reason for the poor removal of non-tacky resin layer in the image portion as described in Comparative Example 1 resides in an insufficiently small difference between the adhesion in the non-image portion and the adhesion in the image portion. The measurement of adhesion was conducted by the method described above.

On the contrary, in the method of Example 1, the toner image was not fixed and the non-tacky resin layer in the image portion did not substantially adhere to the transfer layer on the support. Therefore, the non-tacky resin layer in the image portion was easily removed without suffering any damage on the non-tacky resin layer in the non-image portion.

COMPARATIVE EXAMPLE 2

The same procedure as in Example 1 was performed except that the transfer layer (T) was not provided on the light-sensitive element to form a transferred toner image on a support for ELP-IX. The toner image on the support was unable to be practically employed because of severe cuttings of image. Also, the residue was observed on both the light-sensitive element and the primary receptor. Thus, it is almost impossible to completely transfer the non-fixing toner image from the light-sensitive element to the support for lithographic printing plate without using the transfer layer.

COMPARATIVE EXAMPLE 3

The same procedure as in Example 1 was performed except that the vinyl acetate/crotonic acid copolymer was omitted from the composition for non-tacky resin layer. The non-tacky resin layer in the non-image portion was partially removed by rubbing with the PS sponge and the selective removal of non-tacky resin layer only in the toner image portion could not be carried out.

It is believed that in Comparative Example 3, adhesion of the non-tacky resin layer composed of silicone rubber above to the transfer layer on the support is insufficient and thus, the difference in the adhesion of non-tacky resin layer to the transfer layer and to the toner image is not enough for the selective removal of non-tacky resin layer only in the image portion.

EXAMPLE 2

Five grams of 4,4'-bis(diethylamino)-2,2'-dimethyltriphenylmethane as an organic photoconductive Binder Resin (B-3) having the structure shown below, 40 mg of Methine Dye (D-1) having the structure shown below, and 0.2 g of Compound(A) described above as a chemical sensitizer were dissolved in a mixed solvent of 30 ml of methylene chloride and 30 ml of ethylene chloride to prepare a solution for light-sensitive layer.

Binder Resin (B-3)

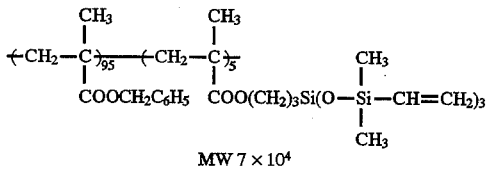

MW $7\times10^4$

Methine Dye (D-1)

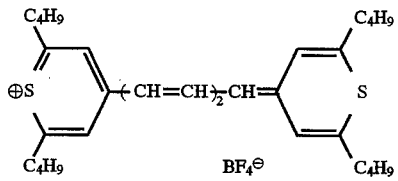

The resulting solution for light-sensitive layer was coated on a conductive transparent substrate composed of a 100 μm thick polyethylene terephthalate film having a deposited layer of indium oxide thereon (surface resistivity: $10^3\Omega$) by a wire round rod and heated at 70° C. for 2 hours for crosslinking to prepare a light-sensitive element having an organic light-sensitive layer having a thickness of about 5 μm.

On the surface of light-sensitive element was coated silicon rubber of ultraviolet ray-curable type (TFC 7700 manufactured by Toshiba Silicone Co., Ltd.) by a wire bar and irradiated with a high pressure mercury lump (UM 102 manufactured by Ushio Inc.) at a distance of 5 cm for 30 seconds. A thickness of the resulting surface layer for imparting releasability was 0.6 μm. The surface adhesion of light-sensitive element was 1 g•f.

On the other hand, a primary receptor was prepared by applying a mixture of 100 g of isoprene rubber, 1 g of Resin having the structure shown below and 0.001 g of phthalic anhydride to the surface of blanket for offset printing (9600A) described in Example 1 and heated at 140° C. for 2 hours to form a cured layer having a thickness of 2 μm. The surface adhesion of the resulting primary receptor was 130 g•f.

Resin

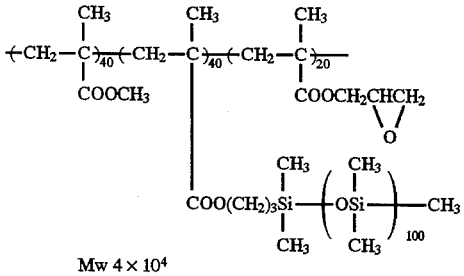

Mw $4\times10^4$

The light-sensitive element and primary receptor described above were installed in an apparatus as shown in FIG. 2.

On the surface of light-sensitive element which had been adjusted at 50° C., a transfer layer having a thickness of 1.6 μm was provided by the electrodeposition coating method in the same manner as in Example 1 except for using Dispersion of Resin (A) (L-2) and applying an electric voltage of +150 V to the developing electrode.

| Dispersion of Resin (A) (L-2) | |
|---|---|
| Resin Grain (AR-1) | 20 g (solid basis) |
| Positive-Charge Control Agent (CD-1) | 0.08 g |
| Isopar G | up to make 1 liter |

While maintaining the surface temperature of light-sensitive element at 50° C., a toner image was formed on the transfer layer, followed by rinsing in the same manner as in Example 1.

The drum of light-sensitive element having the transfer layer bearing the toner image and the drum of primary receptor whose surface temperature had been adjusted at 50° C. were brought into contact with each other under the condition of a nip pressure of 4 kgf/cm$^2$ and a drum circumferential speed of 30 mm/sec, whereby the toner image was wholly transferred together with the transfer layer onto the primary receptor.

Successively, a sheet of OK Master (manufactured by Nippon Seihaku Co., Ltd.) was introduced as a support for lithographic printing plate between the drum of primary receptor and a backup roller for transfer adjusted at 120° C. and a backup roller for release adjusted at 25° C., under the condition of a nip pressure of 8 kgf/cm$^2$ and a drum circumferential speed of 30 mm/sec. Thus, the toner image was wholly transferred together with the transfer layer onto the support. The adhesion of transfer layer to the support was 800 g•f.

The duplicated image thus-obtained on the support was visually observed using an optical microscope of 200 magnifications. None of background stain was observed in the non-image portion and the duplicated image was excellent even in high definition regions or highly accurate image portions in that spread, cutting or distortion of fine lines such as lines of 10 μm in width and dots such as a range of from 3% to 95% in dots of 150 lines per inch were not found. The transfer layer and toner image were wholly transferred onto the support without remains on the light-sensitive element and the primary receptor. The adhesion of toner image portion to the transfer layer on the support was 8 g•f.

On the transfer layer bearing the toner image on the support was coated silicone rubber of ultraviolet ray-curable type (TFC7700 manufactured by Toshiba silicone co., Ltd.) by a wire bar and irradiated with a high pressure mercury lump (UM 102 manufactured by Ushio INC.) at a distance of 5 cm for 30 seconds. A thickness of the resulting non-tacky resin layer was 2.2 μm.

The non-tacky resin layer was uniformly brushed to remove the non-tacky resin layer only in the image portion, whereby a pattern of the non-tacky resin layer of silicone rubber corresponding to the non-image portion was formed.

The resulting lithographic printing plate was subjected to printing in the same manner as in Example 1. More than 10,000 good prints of clear image without stain in the non-image portion were obtained.

EXAMPLE 3

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. To the mixture was added 520 g of tetrahydrofuran with stirring. The resulting dispersion was coated on a conductive transparent substrate same as described in Example 2 by a wire round rod to prepare a charge generating layer having a thickness of about 0.7 μm.

Bisazo Pigment

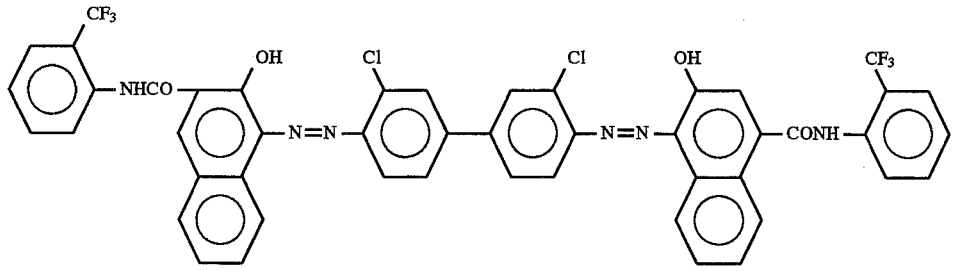

A mixed solution of 20 g of a hydrazone compound having the structure shown below, 30 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm, whereby an electrophotographic light-sensitive element having a double-layered structure was prepared.

Hydrazone Compound

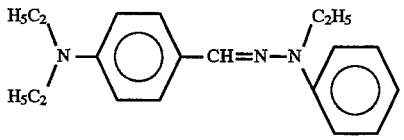

On the electrophotographic light-sensitive element thus-prepared was coated a mixed solution of 30 g of silicone adhesive of tack-free type at a normal temperature (TSR 1520[A] manufactured by Toshiba Silicone Co., Ltd.), 300 mg of a crosslinking agent (TSR 1520[B] manufactured by Toshiba Silicone Co., Ltd.) and 90 g of heptane by a wire bar at a dry thickness of 5 μm, and heated in an oven at 125° C. for 2 minutes to cure. The surface adhesion of the resulting electrophotographic light-sensitive element was 2 g•f.

The light-sensitive element thus-obtained and the primary receptor same as in Example 1 were installed in an apparatus as shown in FIG. 2.

On the light-sensitive element whose surface temperature was adjusted at 50° C. and which was rotated at a circumferential speed of 100 mm/sec, Dispersion of Resin (A) (L-3) shown below was supplied using a slit electrodeposition device, while putting the light-sensitive element to earth and applying an electric voltage of 180 V to an electrode of the slit electrodeposition device to cause the grains to electrodeposit and fix. A thickness of the resulting transfer layer was 2 μm.

| Dispersion of Resin (A) (L-3) | |
|---|---|
| Resin Grain (AR-5) | 20 g (solid basis) |
| Positive-Charge Control Agent (CD-2) (Zirconium naphthenate) | 0.16 g |
| Isopar G | up to make 1 liter |

The light-sensitive element while maintaining its surface temperature at 50° C. was charged to −550 V and exposed to light using a helium-neon laser having an output of 5 mW and an oscillation wavelength of 633 nm at an irradiation dose on the surface of light-sensitive element of 25 erg/cm$^2$ on the basis of digital image data of an information which had been obtained by reading an original by a color scanner, conducting several corrections relating to color reproduction specific for color separation system and stored in a hard disc. Then, the exposed light-sensitive element was developed using Liquid Developer (LD-2) shown below while applying a bias voltage of 50 V and rinsed with Isopar G.

Liquid Developer (LD-2) having a positive charge was prepared in the following manner.

A mixture of 5 g of ethylene/methacrylic acid copolymer (Nucrel N-699 manufactured by Du Pont-Mitsui Polychemicals Co., Ltd.), 0.8 g of polyvinyl acetate having a Tg of 38° C. 6 g of Alkali Blue and 30 g of Isopar L (manufactured by Exxon Co., Ltd.) was kneaded in a kneader at 100° C. for 2 hours to prepare a kneading product. The kneading product was cooled and then pulverized in the kneader. 10 g of the pulverized product and 40 g of Isopar H were dispersed in a paint shaker for 6 hours. The resulting dispersion was diluted with Isopar G so that the concentration of solid material was 6 g per liter, and Positive-Charge Control Agent (CD-2) was added thereto in an amount of 0.1 g per one liter as a charge control agent for imparting a positive charge to prepare Liquid Developer (LD-2).

The primary receptor whose surface temperature had been adjusted at 50° C. was pressed to the light-sensitive element under the condition of a nip pressure of 4 kgf/cm$^2$ and a transfer speed of 50 mm/sec, whereby the toner image was wholly transferred together with the transfer layer onto the primary receptor.

Successively, a polyethylene terephthalate film having a thickness of 150 μm was passed as a support for lithographic printing plate between the primary receptor and a backup roller for transfer whose temperature had been adjusted so as to make a surface temperature of the primary receptor at 90° C. at the time of transfer and a backup roller for release whose temperature had not been controlled under a nip pressure of 7 kgf/cm$^2$ and at the same transfer speed as above. Thus, the toner image was wholly transferred together with the transfer layer onto the polyethylene terephthalate film.

The duplicated image thus-obtained on the polyethylene terephthalate film was visually observed using an optical microscope of 200 magnifications. None of background stain was observed in the non-image portion and the duplicated image was excellent even in high definition regions or highly accurate image portions in that spread, cutting or distortion of fine lines such as lines of 10 μm in width and dots such as a range of from 3% to 95% in dots of 150 lines per inch were not found. The transfer layer and toner image were wholly transferred onto the polyethylene terephthalate film without remains on the light-sensitive element and the primary receptor. The adhesion of toner image portion to the transfer layer on the support was 12 g•f.

Then, a mixed solution of 6 g silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane was coated on the transfer layer bearing the toner image on the polyethylene terephthalate film by a wire bar and heated at 90° C. for 2 minutes to conduct drying and crosslinking, thereby forming a non-tacky resin layer having a thickness of 2.1 μm. The adhesion of non-tacky resin layer to the transfer layer in the non-image portion was not less than 800 g•f and the non-tacky resin layer adhered sufficiently to the transfer layer in the non-image portion.

The non-tacky resin layer was removed only in the image portion by brushing to prepare a lithographic printing plate. As a result of visual observation of the toner image portion on printing plate using an optical microscope of 200 magnifications, it was found that a highly accurate image such as a fine line of 10 μm in width and a range of from 3 to 95% in dots of 150 lines per inch was clearly formed without cutting.

Using the printing plate, printing was conducted in the same manner as in Example 1. More than 50,000 good prints wherein the highly accurate image was reproduced without substantial degradation and background stain was not recognized at all in the non-image portion were obtained.

It is believed that the formation of chemical bond at the interface between the non-tacky resin layer composed of silicone rubber of addition reaction type and the non-image portion of the transfer layer (T) containing Resin (AR-5) on the support for lithographic printing plate by a chemical reaction remarkably improves adhesion therebetween. As a result, even the fine image portion is easily removed due to the sufficient difference in the adhesion in the image portion and in the non-image portion, and the highly accurate image is well reproduced on the print. Further, printing durability of the printing plate is improved.

EXAMPLE 4

An amorphous silicon electrophotographic light-sensitive element (manufactured by Kyocera Corp.) was immersed in a solution containing 1.0 g of Compound (S-1) for imparting releasability shown below dissolved in one liter of Isopar G and dried. By this treatment, the surface of amorphous silicon electrophotographic light-sensitive element was modified so as to exhibit the desired releasability and its surface adhesion was decreased from 250 g•f to 3 g•f.

Compound (S-1)

Silicone surface active agent (SILWet FZ-2171 manufactured by Nippon Unicar Co., Ltd.)

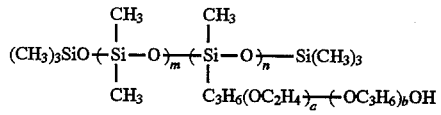

(presumptive structure)

The light-sensitive element thus-obtained and the primary receptor same as in Example 1 were installed in an apparatus as shown in FIG. 2.

On the light-sensitive element whose surface temperature was adjusted at 55° C., a first transfer layer having a thickness of 1 μm was provided using Dispersion of Resin (A) (L-4) shown below and then a second transfer having a thickness of 1 μm was provided thereon using Dispersion of Resin (A) (L-5) shown below, whereby a transfer layer having a stratified structure was formed.

| | |
|---|---|
| Dispersion of Resin (A) (L-4) | |
| Resin Grain (AR-7) | 20 g (solid basis) |
| Positive-Charge Control Agent (CD-1) | 0.07 g |
| Isopar G | up to make 1 liter |
| Dispersion of Resin (A) (L-5) | |
| Resin Grain (AR-4) | 20 g (solid basis) |
| Positive-Charge Control Agent (CD-1) | 0.075 g |
| Isopar G | up to make 1 liter |

The resulting electrophotographic light-sensitive element while maintaining its surface temperature at 55° C. was charged to +700 V with a corona discharge in a dark place and exposed to light using a semiconductor laser having an oscillation wavelength of 780 nm on the basis of digital image data of an information which had been obtained by reading an original by a color scanner, conducting several corrections relating to color reproduction specific for color separation system and stored in a hard disc. The potential in the exposed area was +220 V while it was +600 V in the unexposed area.

The exposed electrophotographic light-sensitive element was pre-bathed with Isopar G (manufactured by Esso Standard Oil Co.) by a pre-bathing means installed in a developing unit and then subjected to reversal development by supplying Liquid Developer (LD-3) having the composition described below from the developing unit to the surface of electrophotographic light-sensitive element while applying a bias voltage of +500 V to the developing unit side to thereby electrodeposit toner particles on the unexposed areas. The electrophotographic light-sensitive element was then rinsed in a bath of Isopar G alone to remove a stain in the non-image areas and dried by a suction/exhaust unit.

Liquid Developer (LD-3)

A copolymer of methyl methacrylate and octadecyl methacrylate (95/5 ratio by weight) having a glass transition point of 100° C. as a coating resin and carbon black (#40 manufactured by Mitsubishi Kasei Corporation) were thoroughly mixed in a weight ratio of 1:1 and kneaded by a three-roll mill heated at 150° C. A mixture of 12 g of the resulting kneading product, 4 g of a copolymer of styrene and butadiene (Sorprene 1205 manufactured by Asahi Kasei Kogyo K. K.) and 76 g of Isopar G was dispersed in a Dyno-mill the toner concentrate obtained was diluted with Isopar G so that the concentration of solid material was 6 g per liter, and $1\times10^{-4}$ mol per liter of sodium dioctylsulfosuccinate was added. thereto to prepare Liquid Developer (LD-3).

The primary receptor whose surface temperature had been adjusted at 55° C. was pressed to the light-sensitive element udder the condition of a nip pressure of 4 kgf/cm$^2$ and a transfer speed of 50 mm/sec, whereby the toner image was wholly transferred together with the transfer layer onto the primary receptor.

Successively, a plate of SUS-430 (manufactured by Kawasaki Steel Corporation) having a thickness of 100 μm was passed as a support for lithographic printing plate between the primary receptor and a backup roller for transfer whose temperature had been adjusted so as to make a surface temperature of the primary receptor at 90° C. at the time of transfer and a backup roller for release whose temperature had not been controlled under a nip pressure of 7 kgf/cm$^2$ and at the same transfer speed as above. Thus, the toner image was wholly transferred together with the transfer layer onto the support. The adhesion of toner image portion to the transfer layer on support was 10 g•f, and the toner image was in a non-fixing state.

A mixed solution of 6 g of silicone rubber of ultraviolet ray-curable type (UV9300 manufactured by Toshiba Silicone Co., LTD.), 60 mg of UV9310C (manufactured by Toshiba Silicone Co., LTD.) and 34 g of heptane was coated on the transfer layer bearing the toner image on the support by a coating machine having a head unit and control unit of a small type ink-jet printer (manufactured by EPSON Co., Ltd.) equipped with an appropriate convey system and ink-feeding system and irradiated with a high-pressure mercury lamp (UM102 manufactured by Ushio Inc.) at a distance of 3 cm for 7 seconds. A thickness of the resulting non-tacky resin layer was 2.5 μm.

The removal of non-tacky resin layer in the image portion to prepare a lithographic printing plate and printing using the resulting plate were conducted in the same manner as in Example 1. More than 50,000 good prints of clear image without stain in the non-image portion similar to those in Example 1 were obtained.

EXAMPLE 5

An amorphous silicon electrophotographic light-sensitive element (manufactured by Kyocera Corp.) having the surface adhesion of 250 g•f was installed in an apparatus as shown in FIG. 2.

On the light-sensitive element, a first transfer layer having a thickness of 1 μm was provided in the same manner as in Example 4 except for using Dispersion of Resin (A) (L-6) shown below in place of Dispersion of Resin (A) (L4),

| Dispersion of Resin (A) (L-6) | |
|---|---|
| Resin Grain (AR-6) | 20 g (solid basis) |
| Positive-Charge Control Agent (CD-1) | 0.08 g |
| Compound (S-2) Carboxy-modified silicone (X-22-3701E manufactured by Shin-Etsu Silicone Co., Ltd.) | 1.5 g |
| 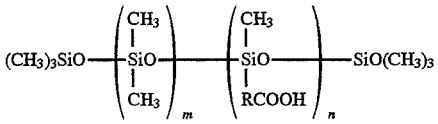 (presumptive structure) | |
| Isopar G | up to make 1 liter |

The releasability of the first transfer layer was evaluated and it was found that the adhesion was 3 g•f. The transfer layer was uniformly released with base from the surface of light-sensitive element.

On the contrary, a transfer layer formed from a dispersion which had the same composition as in Dispersion of Resin (A) (L-6) except for eliminating Compound (S-2) did not exhibit releasability at all.

On the first transfer layer described above, the second transfer layer was provided in the same manner as in Example 4, followed by the procedure same as in Example 4 to prepare a lithographic printing plate. Using the printing plate, printing was conducted in the same manner as in Example 4, and the results similar to those in Example 4 were obtained.

EXAMPLE 6

A mixture of 100 g of photoconductive zinc oxide (Sazex-2000 manufactured by Sakai Chemical Industry Co., Ltd.), 2 g of Binder Resin (B-4) having the structure shown below 20 g of Binder Resin (B-5) having the structure shown below, 0.020 g of Methine Dye (D-2) having the structure shown below, 0.25 g of phthalic anhydride and 300 g of toluene was dispersed by a homogenizer (manufactured by Nippon Seiki K. K.) at a rotation of $1\times10^4$ r.p.m. for 20 minutes to prepare a Binder Resin (B-4)

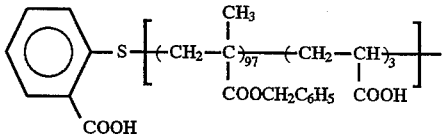

Mw $8 \times 10^3$

Binder Resin (B-5)

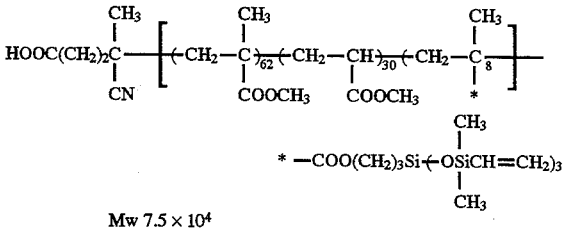

Mw $7.5 \times 10^4$

Methine Dye (D-2)

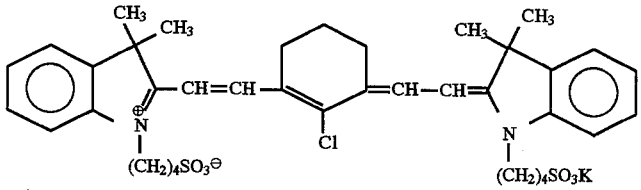

The resulting dispersion was coated on a support used for an electrophotographic lithographic printing plate precursor (ELP-IIX manufactured by Fuji Photo Film Co., Ltd.) by a wire bar at a dry coverage of 25 g/m$^2$, and heated at 110° C. for one minute to prepare an electrophotographic light-sensitive element.

On the light-sensitive element, a surface layer for imparting releasability was provided in the following manner.

A mixed solution of 9 g of a silicone polymer having the structure shown below, 400 mg of a crosslinking agent having the structure shown below, 40 mg of a catalyst (X92-1114 manufactured by Shin-Etsu Silicon Co,, Ltd.) and 150 g of heptane was coated uniformly on the light-sensitive element by a wire bar and heated at 90° C. for 2 minutes to conduct drying and curing, thereby forming the surface layer having a thickness of 1.0 μm. The surface adhesion of the resulting electrophotographic light-sensitive element was not more than 1 g•f.

Silicone Polymer

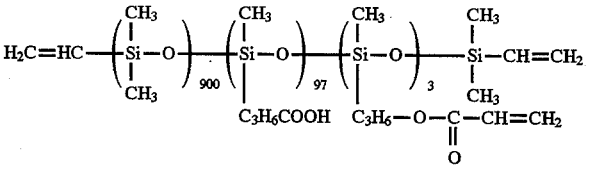

-continued

Crosslinking Agent

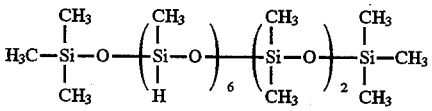

The light-sensitive element thus-obtained and the primary receptor of drum type same as in Example 2 were installed in an apparatus as shown in FIG. 2.

On the light-sensitive element, Dispersion of Resin (A) (L-7) shown below was supplied while applying an electric voltage of −190 V to cause the resin grains to electrodeposit and heated at 60° C. for one minute to form a transfer layer having a thickness of 4 μm.

| Dispersion of Resin (A)(L-7) | |
|---|---|
| Resin Grain (AR-13) | 8 g (solid basis) |
| Resin Grain (AR-9) | 12 g (solid basis) |
| Positive-Charge Control Agent (CD-3) | 0.09 g |

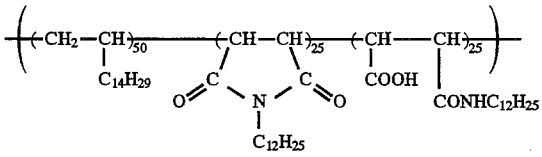

Mw $1\times10^4$ (molar ratio)

| | |
|---|---|
| Isopar G | up to make 1 liter |

The resulting light-sensitive element having the transfer layer was charged to a surface potential of −600 V by a corona charger, exposed using a semiconductor laser having an oscillation wavelength of 833 nm at an irradiation dose of the surface of light-sensitive element of 30 erg/cm$^2$ subjected to development using Liquid Developer (LD-1) described above while applying a bias voltage of 100 V to a developing unit and then rinsed with Isopar G.

Each surface temperature of the light-sensitive element and the primary receptor was adjusted at 50° C., the primary receptor was pressed to the light-sensitive element under the condition of a nip pressure of 3.5 kgf/cm$^2$ and a drum circumferential speed of 40 mm/sec, whereby the toner image was transferred together with the transfer layer on the primary receptor.

Successively, paper laminated with an aluminum foil and subjected to water-proof treatment was passed as a support for lithographic printing plate between the primary receptor and a backup roller for transfer whose surface temperature had been adjusted at 120° C. under a nip pressure of 8 kgf/cm$^2$ and at the same circumferential speed as above. The toner image was wholly transferred together with the transfer layer from the primary receptor to the support.

The duplicated image thus-obtained on the support was visually observed using an optical microscope of 200 magnifications. It was found that the non-image portion had no stain and the image portion suffered no defects (such as cutting of fine and fine letters) in high definition regions.

The adhesion of toner image portion to the transfer layer was 12 g•f and the toner image was in a non-fixing state.

Then, a mixed solution of 6 g silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane was coated on the transfer layer bearing the toner image on the support by a wire bar and heated at 90° C. for 2 minutes to conduct drying and crosslinking, thereby forming a non-tacky resin layer having a thickness of 2.1 μm. The adhesion of non-tacky resin layer to the transfer layer in the non-image portion was not less than 800 g•f.

The removal of non-tacky resin layer in the image portion to prepare a lithographic printing plate and printing using the resulting plate were conducted in the same manner as in Example 1. More than 10,000 good prints of clear image without stain in the non-image portion were obtained.

EXAMPLE 7

The formation of transfer layer on light-sensitive element was performed by the hot-melt coating method using a unit for providing transfer layer as shown in FIG. 3 instead of the electrodeposition coating method as described in Example 1.

Formation of Transfer Layer

A mixture of Resin (A-1) having the structure shown below and Resin (A-2) having the structure shown below in a weight ratio of 1:1 was coated on the surface of light-sensitive element at a rate of 20 mm/sec by a hot-melt coater adjusted at 90° C. as a unit for providing transfer layer and cooled by blowing cool air from a suction/exhaust unit maintain the surface temperature of light-sensitive element at 60° C. thereby providing a transfer layer having a thickness of 2.0 μm.

Resin (A-1)

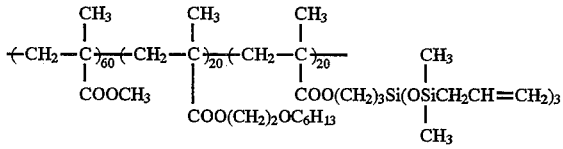

Mw $1\times10^4$ Tg 22° C.

Resin (A-2)

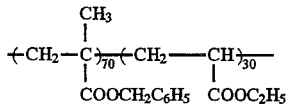

Mw $3\times10^4$ Tg 33° C.

Using the light-sensitive element having the transfer layer thus-obtained, a lithographic printing plate was prepared, followed by conducting printing in the same manner as in Example 1. The results similar to those in Example 1 were obtained.

EXAMPLE 8

The formation of transfer layer on light-sensitive element was performed by the transfer method from release paper using a device as shown in FIG. 6 instead of the electrodeposition coating method as described in Example 3. Specifically, on Separate Shi (manufactured by Oji Paper Co., Ltd.) as release paper 24, was coated a mixture of Resin (A-3) having the structure shown below and Resin (A-4) having the structure shown below in a weight ratio of 1:2 to prepare a transfer layer having a thickness of 2.5 μm. The resulting paper was brought into contact with the light-sensitive element same as described in Example 3 under the condition of a pressure between rollers of 3 kgf/cm$^2$, a surface temperature of 60° C. and a transportation speed of 50 mm/sec, whereby the transfer layer having a thickness of 2.5 μm was formed on the light-sensitive element.

Resin (A-3)

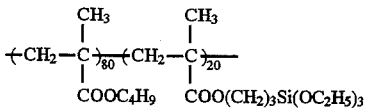

Mw $2\times10^4$ Tg 35° C.

Resin (A-4)

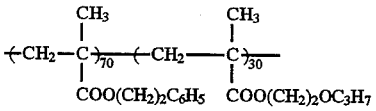

Mw $1.5\times10^4$ Tg 23° C.

Using the light-sensitive element having the transfer layer thus-obtained, a lithographic printing plate was prepared, followed by conducting printing in the same manner as in Example 3. The image quality of prints obtained and printing durability were good as those in Example 3.

EXAMPLE 9

A mixture of 1 g of X-form metal-free phthalocyanine (manufactured by Dainippon Ink and Chemicals, Inc.), 7.5 g of Binder Resin (B-6) having the structure shown below, 0.15 g of Compound (B) having the structure shown below, and 80 g of cyclohexanone was put into a 500 ml-volume glass container together with glass beads and dispersed in a paint shaker (manufactured by Toyo Seiki Seisakusho Co.) for 60 minutes. To the dispersion were added 1.5 g of Binder Resin (B-7) having the structure shown below, 0.03 g of phthalic anhydride and 0.002 g of o-chlorophenol, followed by further dispersing for 2 minutes. The glass beads were separated by filtration to prepare a dispersion for a light-sensitive layer.

Binder Resin (B-6)

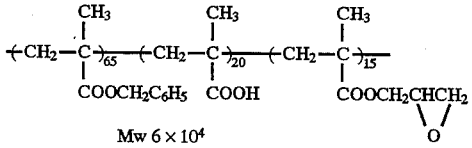

Mw $6\times10^4$

Binder Resin (B-7)

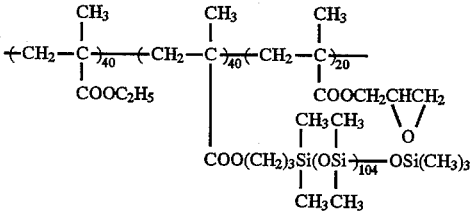

Mw $4\times10^4$

-continued

Compound (B)

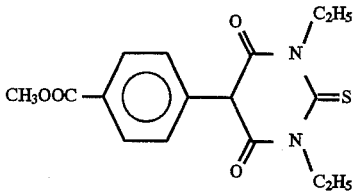

The resulting dispersion was coated on an aluminum plate having a thickness of 0.2 mm, which had been subjected to degrease treatment, by a wire bar, set to touch, and heated in a circulating oven at 120° C. for 30 minutes to form a light-sensitive layer having a thickness of 8 μm. The surface adhesion of the resulting electrophotographic light-sensitive element was 8 g•f.

For comparison, an electrophotographic light-sensitive element was prepared in the same manner as described above except for eliminating 1.5 g of Binder Resin (B-7). The surface adhesion of the light-sensitive element-was not less than 400 g•f and the light-sensitive element did not exhibit releasability at all.

On the other hand, a primary receptor was prepared in the following manner. On a hollow roller, a sheet of natural rubber having a rubber hardness of 75 degree and a thickness of 4 nm (manufactured by Kokugo Co., Ltd.) was fixed, and a layer of methoxymethyl-modified nylon resin (Diamide MX-100 manufactured by Daicel Co., Ltd.) having a thickness of 2 μm was provided thereon. To the surface thereof was applied the composition shown below and heated at 120° C. for 2 hours to form the cured uppermost layer having a thickness of 3 μm. The surface adhesion of the resulting primary receptor was 160 g•f.

| Composition for Uppermost Layer | |
|---|---|
| Resin (a) | 10 g |
| 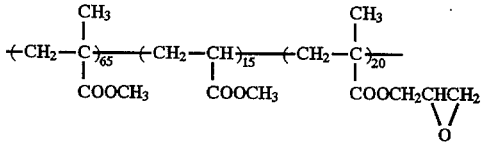 | |
| Mw $5\times10^4$ | |
| Resin (b) | 0.08 g |
| 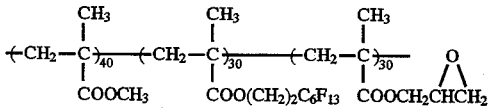 | |
| Mw $6\times10^4$ | |
| Phthalic anhydride | 0.2 g |
| o-Chlorophenol | 0.02 g |
| Tetrahydrofuran | 70 g |

The light-sensitive element and primary receptor described above were installed in an apparatus as shown in FIG. 2.

On the surface of light-sensitive element which had been adjusted at 50° C., a transfer layer having a thickness of 3 μm was provided by the electrodeposition coating method in the same manner as in Example 1 except for using Dispersion of Resin (A) (L-8).

| Dispersion of Resin (A) (L-8) | |
|---|---|
| Resin Grain (ARW-1) | 20 g (solid basis) |
| Positive-Charge control Agent (CD-1) | 0.09 g |
| Charge Adjuvant (AD-1) | 1 g |
| $\left(CH_2-\underset{\underset{COOC_{12}H_{25}}{\vert}}{\overset{\overset{CH_3}{\vert}}{C}}\right)_{95}\left(CH_2-\underset{\underset{COOH}{\vert}}{CH}\right)_{5}$ Mw $3\times10^4$ | |
| Isopar G | up to make 1 liter |

While maintaining the surface temperature of light-sensitive element at 50° C., a toner image was formed on the transfer layer in the same manner as in Example 1, followed by rinsing with Isopar L (manufactured by Exxon Co., Ltd.).

The primary receptor whose surface temperature had been adjusted at 50° C. was pressed to the light-sensitive element under the condition of a nip pressure of 4 kgf/cm$^2$ and a transfer speed of 50 mm/sec, whereby the toner image was wholly transferred together with the transfer layer onto the primary receptor.

Successively, an aluminum plate having a thickness of 150 μm was passed as a support for lithographic printing plate between the primary receptor and a backup roller for transfer whose temperature had been adjusted at 120° C. and a backup roller for release under the condition of a nip pressure of 7 kgf/cm$^2$ and a transfer speed of 50 mm/sec. Thus, the toner image was wholly transferred together with the transfer layer from the primary receptor to the aluminum plate. The residual transfer layer was not observed on the light-sensitive element and primary receptor. The adhesion between the transfer layer and the support for lithographic printing plate was not less than 1 kg•f and the transfer layer was not released from the support.

The duplicated image thus-obtained on the support was excellent even in high definition regions or highly accurate image portions in that cutting or distortion of fine lines such as lines of 12 μm in the width, fine letters such as 3.6 point size of Ming-zhao character and dots such as a range of from 4% to 95% in dots of 150 lines per inch were not found.

On the transfer layer bearing the toner image on the support was uniformly provided a non-tacky resin layer in the following manner.

Preparation of Donor Sheet (DS-1)

On a PET film having a thickness of 100 μm treated a surface thereof with polyvinyl acetate (manufactured by Fuji Photo Film Co., Ltd.) was coated a mixed solution of 6 g of silicon rubber of addition type for release paper (X56-A5730 manufactured by Toshiba Silicone Co., Ltd.) and 36 g of heptane by a wire bar and dried at 90° C. for 2 minutes to prepare a non-tacky resin layer having a thickness of 2.2 μm.

On the transfer layer bearing the toner image on the support described above was coated a crosslinking agent (CM620 manufactured by Toshiba Silicone Co., Ltd.) at a coverage of 30 μg/cm$^2$ by a wire bar. Then Donor-Sheet (DS-1) was superpopsed thereon so that the non-tacky resin layer was brought into contact with the layer of crosslinking agent on the support, and the laminate was passed between a pair of rollers adjusted at 90° C. at a nip pressure of 5 Kgf/cm$^2$ and a transportation speed of 40 cm/min. The PET film was then peeled off and the silicon rubber was cured to provide the non-tacky resin layer on the transfer layer on aluminum support. The adhesion between the non-tacky resin layer and the transfer layer was not less than 800 g•f.

The removal of non-tacky resin layer in the image portion to prepare a lithographic printing plate and printing using the resulting plate were conducted in the same manner as in Example 1. More than 50,000 good prints of highly accurate image without stain in the non-image portion were obtained.

Further, the same procedure as described above was repeated except for using a transfer layer having a stratified structure described below and changing the temperature of backup roller for transfer to 90° C. and the transfer speed to 70 mm/sec in the transfer step of from the primary receptor to the aluminum support. The results similar to those described above were obtained.

Formation of Transfer Layer

First transfer layer was formed on the light-sensitive element in the same manner as in the formation of transfer layer in Example 1 except for using 20 g of Resin Grain (AR-1) having a Tg of 34° C. in place of 20 g of Resin Grain (AR-3) in Dispersion of Resin (A) (L-1). The first transfer layer had a thickness of 1.5 μm and a relatively high Tg.

Second transfer layer was formed on the first transfer layer in the same manner as above except for using 20 g of Resin Grain (AR-16) having a Tg of 17° C. in place of 20 g of Resin Grain (AR-1). The second transfer layer had a thickness of 1.5 μm and a relatively low Tg.

EXAMPLE 10

A toner image was formed on an aluminum plate in the same manner as in Example 9.

Preparation of Donor Sheet (DS-2)

On a PET film having a thickness of 100 μm treated a surface thereof with polyvinyl acetate (manufactured by Fuji Photo film Co., Ltd.) was coated a mixed solution of 6 g of silicone rubber of addition type (KS774 manufactured by Shin-Etsu Silicone Co., Ltd.), 180 mg of CAT-PL-4 (manufactured by Shin-Etsu Silicone Co., Ltd.) and 34 g of heptane by a wire bar and heated at 90° C. for 2 minutes to conduct drying and crosslinking, thereby forming a non-tacky resin layer having a thickness of 2.0 μm.

Donor Sheet (DS-2) was superposed on the transfer layer bearing the toner image on the support described above so that the non-tacky resin layer of Donor Sheet (DS-2) was brought into contact with the transfer layer on the support, and thelaminate was passed between a pair or rollers adjusted at 110° C. at a nip pressure of 5 Kgf/cm$^2$ and a transportation speed of 20 cm/min.

The PET film was then peeled off at an angle of 150 degree and a speed of 10 cm/sec. The non-tacky resin layer of cured silicone rubber in the image portion was removed together with the PET film while remaining the non-tacky resin layer on the transfer layer on support in the non-image portion, whereby a lithographic printing plate was prepared.

This is because the non-tacky resin layer firmly adhered to the transfer layer on the support in the non-image portions, while the non-tacky resin layer in the image portion did not substantially adhere to the transfer layer on support since the transfer layer in the image portion was masked by the toner image.

Printing was conducted using the printing plate in the same manner in Example 1 and more than 50,000 good prints of clear image without stain in the non-image portion were obtained. Fine lines and letters on the prints were clearcut in comparison with those in Example 9. It was found as a result of the observation using an electron microscope that the diagonal cut of the non-tacky resin layer at the edge of non-image portion due to the rubbing for removing the non-tacky resin layer in the image portion did not occur in the peel-apart method as descried above.

In the example, the adhesion between the transfer layer and the support for lithographic printing plate was not less than 1 Kg•f, and the adhesion between the non-tacky resin layer and the transfer layer was not less than 800 g•f.

EXAMPLE 11 TO 22

A lithographic printing plate was prepared and printing was conducted using the printing plate in the same manner as in Example 2 except for employing each of the resin grains shown in Table D below in place of Resin Grain (AR-1) used in Dispersion of Resin (A) (L-2) for the formation of transfer layer.

More than 10,000 excellent prints similar to those in Example 2 without cutting or distortion of fine lines, fine letters and dots in high definition regions or highly accurate image portions were obtained.

TABLE D

| Example | Resin Grain |
|---|---|
| 11 | AR-5 |
| 12 | AR-7 |
| 13 | AR-9 |
| 14 | AR-5/AR-10 (80/20 in weight ratio) |
| 15 | AR-5/AR-13 (75/25 in weight ratio) |
| 16 | AR-15/AR-1 (50/50 in weight ratio) |
| 17 | ARW-1 |
| 18 | ARW-3 |
| 19 | ARW-4 |
| 20 | ARW-5 |
| 21 | ARW-1/AR-4 (60/40 in weight ratio) |
| 22 | ARW-4/AR-2 (80/20 in weight ratio) |

EXAMPLE 23

The same procedure as in Example 9 was repeated to prepare a lithographic printing plate except that the formation of transfer layer and the formation of non-tacky resin layer were conducted as shown below respectively.

The transfer layer was formed in the same manner as in Example 9 except for using 15 g of Resin Grain (AR-8) and 5 g of Resin Grain (AR-9) in place of 20 g of Resin Grain (ARW-1) in Dispersion of Resin (A) (L-8) for the formation of transfer layer. A thickness of the transfer layer was 2.8 μm.

The non-tacky resin layer was formed in the following manner.

A mixed solution of 9 g of Silicone Rubber Base Polymer (SB-1) having the structure shown below, 400 mg of Crosslinking Agent (SV-1) having the structure shown below, 40 mg of a catalyst (X92-1114 manufactured by Shin-Etsu Silicone Co., Ltd.) and 60 g of heptane was coated on the transfer layer bearing the toner image by a wire bar and heated at 90° C. for 2 minutes to conduct drying and curing, thereby forming the non-tacky resin layer. A thickness of the non-tacky resin layer was 2.21 μm.

Silicon Rubber Base Polymer (SB-1)

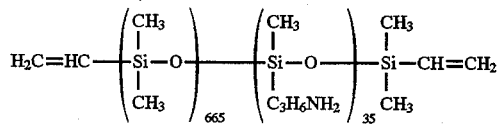

Crosslinking Agent (SV-1)

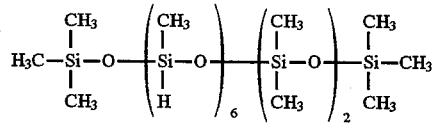

The resulting lithographic printing plate had an improved adhesion of the non-tacky resin layer to the transfer layer. The adhesion between the transfer layer and the support for lithographic printing plate was not less than 1 Kg•f, and the adhesion between the non-tacky resin layer and the transfer layer was not less than 800 g•f.

Using the lithographic printing plate, printing was performed in the same manner as in Example 9. More than 50,000 good prints of clear image without background stain in the non-image portion were obtained.

Similar results were also obtained using Resin Grain (ARW-2) in place of Resin Grain (AR-9) for the formation of transfer layer.

EXAMPLE 24

The same procedure as in Example 23 was repeated except for using Silicone Rubber Base Polymer (SB-2) having the structure shown below in place of Silicone Rubber Polymer (SB-1). More than 50,000 good prints similar to those in Example 23 were obtained.

Silicon Rubber Base Polymer (SB-2)

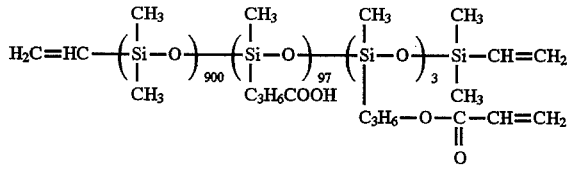

EXAMPLE 25

The same procedure as in Example 1 was repeated to prepare a lithographic printing plate except that the formation of transfer layer and the formation of non-tacky resin layer were conducted as shown below respectively.

The transfer layer was formed in the same manner as in Example 1 except for using 20 g of Resin Grain (AR-6) in place of 20 g of Resin Grain (AR-3) in Dispersion of Resin (A) (L-1) for the formation of transfer layer. A thickness of the transfer layer was 2.0 μm.

The non-tacky resin layer was formed in the following manner.

A mixed solution of 5 g of Silicone Rubber Base Polymer (SB-3) having the structure shown below, 5 g of Silicone Polymer having the structure shown below, 400 mg of Crosslinking Agent (SV-1) described above, 40 mg of a catalyst (X92-1114 manufactured by Shin-Etsu Silicone Co., Ltd.) and 60 g of heptane was coated on the transfer layer bearing the toner image by a wire bar and heated at 90° C. for 2 minutes to conduct drying and curing, thereby forming the non-tacky resin layer. A thickness of the non-tacky resin layer was 2.50 μm.

Silicon Rubber Base Polymer (SB-3)

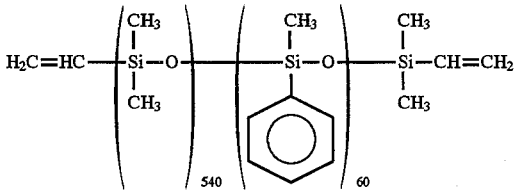

Silicone Polymer

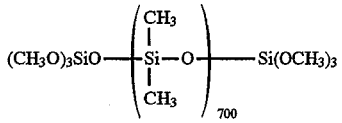

The resulting lithographic printing plate had an improved adhesion of the non-tacky resin layer to the transfer layer.

Using the lithographic printing plate, printing was performed in the same manner as in Example 1. More than 3,000 good prints of clear image without background stain in the non-image portion were obtained.

Similar results were also obtained using Resin Grain (ARW-6) in place of Resin Grain (AR-6) for the formation of transfer layer.

While the invention has been described in detail and with reference to specific embodiments thereof, it will be apparent to one skilled in the art that various changes and modifications can be made therein without departing from the spirit and scope thereof.

What is claimed is:

1. A method for preparation of a waterless lithographic printing plate by an electrophotographic process comprising providing a peelable transfer layer (T) containing a thermoplastic resin (A) on a surface of an electrophotographic light-sensitive element, forming a non-fixing toner image by an electrophotographic process using a liquid developer on the transfer layer, transferring the toner image together with the transfer layer (T) from the electrophotographic light-sensitive element onto a primary receptor, transferring the toner image together with the transfer layer (T) from the primary receptor onto a support for lithographic printing plate, providing on the transfer layer (T) bearing the toner image a non-tacky resin layer having adhesion to the transfer layer (T) larger than adhesion between the toner image and the non-tacky resin layer, and selectively removing the non-tacky resin layer provided on the toner image.

2. A method for preparation of waterless lithographic printing plate by an electrophotographic process as claimed in Claim 1, wherein a force necessary for releasing the non-tacky resin layer from the transfer layer (T) on support for lithographic printing plate in the non-image portion is not less than 200 gram•force and a force necessary for removing the non-tacky resin layer from the transfer layer (T) on support for lithographic printing plate in the image portion is not more than 20 gram•force.

3. A method for preparation of waterless lithographic printing plate by an electrophotographic process as claimed in claim 1, wherein the electrophotographic light-sensitive element has a surface adhesion of not more than 20 grams•force.

4. A method for preparation of waterless lithographic printing plate by an electrophotographic process as claimed in claim 3, wherein the electrophotographic light-sensitive element comprises amorphous silicon as a photoconductive substance.

5. A method for preparation of waterless lithographic printing plate by an electrophotographic process as claimed in claim 3, wherein the electrophotographic light-sensitive element contains a polymer having a polymer component containing at least one of a silicon atom and a fluorine atom in the region near to the surface thereof.

6. A method for preparation of waterless lithographic printing plate by an electrophotographic process as claimed in claim 5, wherein the polymer is a block copolymer comprising at least one polymer segment (α) containing at least 50% by weight of a fluorine atom and/or silicon atom-containing polymer component and at least one polymer segment (β) containing 0 to 20% by weight of a fluorine atom and/or silicon atom-containing polymer component, the polymer segments (α) and (β) being bonded in the form of blocks.

7. A method for preparation of waterless lithographic printing plate by an elctrophotographic process as claimed in claim 5, wherein the polymer further contains a polymer component containing a photo- and/or heat-curable group.

8. A method for preparation of waterless lithographic printing plate by an electrophotographic process as claimed in claim 6, wherein the polymer further contains a polymer component containing a photo- and/or heat-curable group.

9. A method for preparation of waterless lithographic printing plate by an electrophotographic process as claimed in claim 3 wherein the electrophotographic light-sensitive element is an electrophotographic light-sensitive element to the surface of which a compound (S) which contains a fluorine atom and/or a silicon atom has been applied.

10. A method for preparation of waterless lithographic printing plate by an electrophotographic process as claimed in claim 1, wherein the transfer layer is peelable from the light-sensitive element at a temperature of not more than 180° C. or at a pressure of not more than 20 Kgf/cm$^2$.

11. A method for preparation of waterless lithographic printing plate by an electrophotographic process as claimed in claim 1, wherein the resin (A) has a glass transition point of not more than 90° C. or a softening point of not more than 100° C.

12. A method for preparation of waterless lithographic printing plate by an electrophotographic process as claimed in claim 1, wherein the transfer layer contains a resin (AH) having a glass transition point of from 25° C. to 90° C. or a softening point of from 35° C. to 100° C. and a resin (AL) having a glass transition point of not more than 30° C. or a softening point of not more than 45° C. in which a difference in the glass transition point or softening point between the resin (AH) and the resin (AL) is at least 2° C.

13. A method for preparation of waterless lithographic printing plate by an electrophotographic process as claimed in claim 1, wherein the transfer layer is composed of a first layer which is positioned on the light-sensitive element and which contains a resin (AH) having a glass transition point of from 25° C. to 90° C. or a softening point of from 35° C. to 100° C. and a second layer provided thereon containing a resin (AL) having a glass transition point of not more than 30° C. or a softening point of not more than 45° C. in which a difference in the glass transition point or softening point between the resin (AH) and the resin (AL) is at least 2° C.

14. A method for preparation of waterless lithographic printing plate by an electrophotographic process as claimed in claim 1, wherein the transfer layer is provided by a hot-melt coating method.

15. A method for preparation of waterless lithographic printing plate by an electrophotographic process as claimed in claim 1, wherein the transfer layer is provided by an electrodeposition coating method.

16. A method for preparation of waterless lithographic printing plate by an electrophotographic process as claimed in claim 1, wherein the transfer layer is provided by a transfer method from a releasable support.

17. A method for preparation of waterless lithographic printing plate by an electrophotographic process as claimed in claim 15, wherein the electrodeposition coating method is carried out using grains comprising the resin (A) supplied as a dispersion thereof in an electrically insulating solvent having an electric resistance of not less than $10^8$ Ω•cm and a dielectric constant of not more than 3.5.

18. A method for preparation of waterless lithographic printing plate by an electrophotographic process as claimed in claim 15, wherein the electrodeposition coating method is carried out using grains comprising the resin (A) which are supplied between the electrophotographic light-sensitive element and an electrode placed in face of the light-sensitive element, and migrated by electrophoresis according to a potential gradient applied from an external power source to cause the grains to adhere to or electrodeposit on the electrophotographic light-sensitive element, thereby forming a film.

19. A method for preparation of waterless lithographic printing plate by an electrophotographic process as claimed in claim 17, wherein the grains contain a resin (AH) having a glass transition point of from 25° C. to 90° C. or a softening point of from 35° C. to 100° C. and a resin (AL) having a glass transition point of not more than 30° C. or a softening point of not more than 45° C. in which a difference in the glass transition point or softening point between the resin (AH) and the resin (AL) is at least 2° C.

20. A method for preparation of waterless lithographic printing plate by an electrophotographic process as claimed in claim 19, wherein the grains have a core/shell structure.

21. A method for preparation of waterless lithographic printing plate by an electrophotographic process as claimed in claim 1, wherein the primary receptor has the surface adhesion lager than the surface adhesion of electrophotographic light-sensitive element.

22. A method for preparation of waterless lithographic printing plate by an electrophotographic process as claimed in claim 1, wherein before the provision of transfer layer, a compound (S) containing a fluorine atom and/or a silicon atom is applied to a surface of the electrophotographic light-sensitive element.

23. A method for preparation of waterless lithographic printing plate by an electrophotographic process as claimed in claim 1, wherein a surface of the non-tacky resin layer has a surface energy of not more than 30 $erg.cm^{-1}$.

24. A method for preparation of waterless lithographic printing plate by an electrophotographic process as claimed in claim 23, wherein the non-tacky resin layer contains a silicone resin.

25. A method for preparation of waterless lithographic printing plate by an electrophotographic process as claimed in claim 23, wherein the non-tacky resin layer contains a fluorinated resin.

26. A method for preparation of waterless lithographic printing plate by an electrophotographic process as claimed in claim 24, wherein the silicone resin is a polymer composed of an organosiloxane repeating unit represented by the following general formula (I):

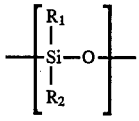

(I)

wherein $R_1$ and $R_2$, which may be the same or different, each represents an aliphatic or aromatic hydrocarbon group or a heterocyclic group.

27. A method for preparation of waterless lithographic printing plate by an electrophotographic process as claimed in claim 1, wherein the non-tacky resin layer is cured.

28. A method for preparation of waterless lithographic printing plate by an electrophotographic process as claimed in claim 1, wherein a chemical bond is formed at the interface between the transfer layer on support for lithographic printing plate and the non-tacky resin layer in the non-image portion.

29. A method for preparation of waterless lithographic printing plate by an electrophotographic process as claimed in claim 1, wherein the toner image is not fixed.

30. A method for preparation of waterless lithographic printing plate by an electrophotographic process as claimed in claim 1, wherein the removal of the non-tacky resin layer in the image portion is conducted by a dry process.

31. A method for preparation of waterless lithographic printing plate by an electrophotographic process as claimed in claim 1, wherein both the toner image and the non-tacky resin layer provided thereon are removed from the transfer layer on support for lithographic printing plate.

* * * * *